US011599041B2

(12) United States Patent
Kitamura

(10) Patent No.: US 11,599,041 B2
(45) Date of Patent: Mar. 7, 2023

(54) POWDER CONTAINER AND IMAGE FORMING APPARATUS

(71) Applicant: Gen Kitamura, Shizuoka (JP)

(72) Inventor: Gen Kitamura, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/694,696

(22) Filed: Mar. 15, 2022

(65) Prior Publication Data

US 2022/0317592 A1 Oct. 6, 2022

(30) Foreign Application Priority Data

Mar. 31, 2021 (JP) ..... JP2021-061010

(51) Int. Cl.
*G03G 15/08* (2006.01)

(52) U.S. Cl.
CPC ..... *G03G 15/0867* (2013.01)

(58) Field of Classification Search
CPC ..... G03G 15/08; G03G 15/0865; G03G 15/0867; G03G 15/0872; G03G 15/0877
USPC ..... 399/252, 258, 262
See application file for complete search history.

(56) References Cited

U.S. PATENT DOCUMENTS 5,598,254 A 1/1997 Ikesue et al.
5,866,419 A 2/1999 Meder
10,133,211 B2 * 11/2018 Yomoda ..... G03G 15/0886
2003/0133722 A1 7/2003 Kaiho
2020/0192243 A1 6/2020 Kitamura et al.

FOREIGN PATENT DOCUMENTS

EP 2 058 709 A1 5/2009
JP 10-171231 6/1998
JP 2017-173501 9/2017

OTHER PUBLICATIONS

Extended European Search Report dated Dec. 23, 2022, in corresponding European Patent Application No. 22158185.3 ,7 pp.

* cited by examiner

*Primary Examiner* — Hoan H Tran
(74) *Attorney, Agent, or Firm* — Xsensus LLP

(57) ABSTRACT

A powder container includes a container body to store powder. The container body includes an inner peripheral surface of a spiral shape and rotates around a longitudinal axis to convey the powder by the spiral shape in one direction. The inner peripheral surface has a substantially polygonal shape having rounded corners or a shape in which sides of the substantially polygonal shape are recessed, in cross section orthogonal to a longitudinal direction of the longitudinal axis at a predetermined position. The inner peripheral surface has a region in which the cross-sectional shape at a position shifted from the predetermined position by a predetermined amount within one pitch of the spiral shape in the longitudinal direction is a shape obtained by rotating the substantially polygonal shape having the rounded corners or the shape in which the sides of the substantially polygonal shape are recessed, around the longitudinal axis.

17 Claims, 41 Drawing Sheets

POWDER CONTAINER AND IMAGE FORMING APPARATUS

CROSS-REFERENCE TO RELATED APPLICATION

This patent application is based on and claims priority pursuant to 35 U.S.C. § 119(a) to Japanese Patent Application No. 2021-061010, filed on Mar. 31, 2021, in the Japan Patent Office, the entire disclosure of which is hereby incorporated by reference herein.

BACKGROUND

Technical Field

Embodiments of the present disclosure generally relate to a powder container and an image forming apparatus.

Related Art

When a toner container is molded by direct blow molding, a technique is known that adjusts a wall thickness and molds the toner container with a thin wall (for example, see Japanese Unexamined Patent Application Publication No. 2017-173501).

Toner containers often have a bottle shape in which a spiral groove is formed in a cylindrical body. In such a toner container molded to have a thin wall, when a force is applied perpendicularly to a linear portion parallel (horizontal) to an axial direction of a toner container (bottle) with respect to a circumferential direction in which a groove is not formed, a curved surface portion may be recessed toward an inner wall and plastically deformed.

Further, when the toner container is filled with toner and grip portions at both ends of the bottle are held, the entire bottle may be bent and largely deformed, causing a disadvantage in strength and operability in thinning the toner container.

When the bent toner bottle is rotated in the attached image forming apparatus, the bent toner bottle is periodically hit against a member (e.g., guide member) around the bottle. Accordingly, there may occur failures such as abnormal noise caused by hitting, a banding image caused by vibration due to hitting, an increase in toner remaining amount, and an increase in driving torque.

SUMMARY

According to an embodiment of the present disclosure, there is provided a powder container that includes a container body to store powder. The container body includes an inner peripheral surface of a spiral shape and rotates around a longitudinal axis to convey the powder by the spiral shape in one direction. The inner peripheral surface has a substantially polygonal shape having rounded corners or a shape in which sides of the substantially polygonal shape are recessed, in cross section orthogonal to a longitudinal direction of the longitudinal axis at a predetermined position. The inner peripheral surface has a region in which the cross-sectional shape at a position shifted from the predetermined position by a predetermined amount within one pitch of the spiral shape in the longitudinal direction is a shape obtained by rotating the substantially polygonal shape having the rounded corners or the shape in which the sides of the substantially polygonal shape are recessed, around the longitudinal axis.

According to another embodiment of the present disclosure, there is provided a powder container including a container body to store powder. The container body includes an inner peripheral surface of a spiral shape and rotates around a longitudinal axis to convey the powder by the spiral shape in one direction. A cross section of the inner peripheral surface passing through the longitudinal axis in a direction parallel to the longitudinal direction of the longitudinal axis does not include a straight line parallel to the longitudinal axis.

According to still another embodiment of the present disclosure, there is provided a powder container including a container body to store powder. The container body includes an inner peripheral surface of a spiral shape and rotates around a longitudinal axis to convey the powder by the spiral shape in one direction. The inner peripheral surface has a substantially polygonal shape having rounded corners or a shape in which sides of the substantially polygonal shape are recessed, in cross section orthogonal to a longitudinal direction of the longitudinal axis at a predetermined position. The inner peripheral surface has a region in which the cross-sectional shape at a position shifted from the predetermined position by a predetermined amount within one pitch of the spiral shape in the longitudinal direction is a shape obtained by rotating, around the longitudinal axis, the substantially polygonal shape having the rounded corners or the shape in which the sides of the substantially polygonal shape are recessed. A cross section of the inner peripheral surface passing through the longitudinal axis in a direction parallel to the longitudinal direction does not include a straight line parallel to the longitudinal axis.

According to still yet another embodiment of the present disclosure, there is provided an image forming apparatus that includes the powder container according to any one of the above-described embodiments, an image bearer, an image forming device, and a powder supply device. The powder container stores powder for image formation. The image bearer bears an image thereon. The image forming device forms an image on the image bearer, using the powder conveyed from the powder container. The powder supply device conveys the powder from the powder container to the image forming device.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
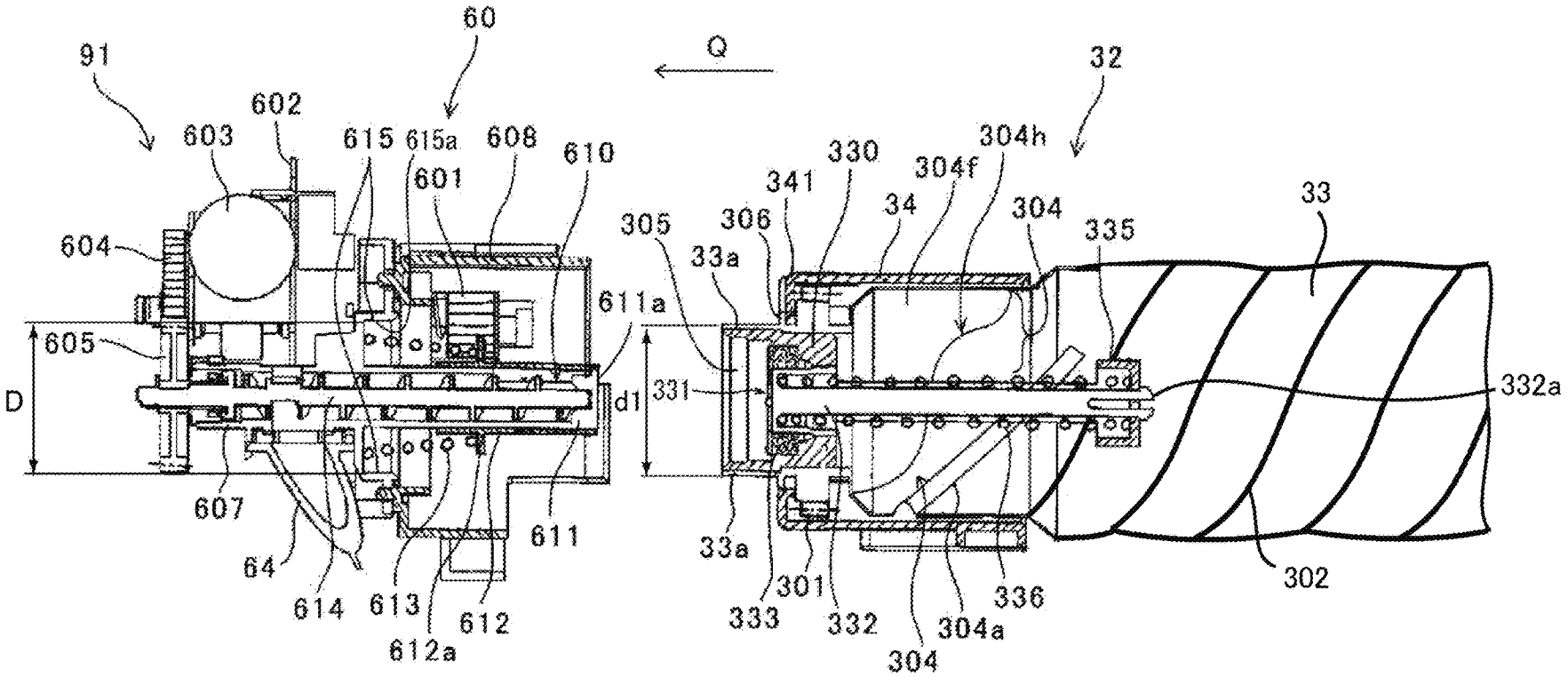
FIG. 1 is a cross-sectional view of a toner supply device and a toner container according to an embodiment, before attachment of the toner container.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, embodiments of the present disclosure including examples will be described in detail with reference to the drawings. Throughout the embodiments, examples, and the like, constituent elements (members, constituent parts) having the same members, the same functions, and the like are denoted by the same reference numerals after being described once unless there is a possibility of confusion, and description thereof will be omitted. In order to simplify the drawings and descriptions, elements that do not demand descriptions may be omitted from the drawings as a matter of convenience without notice. In the drawings, Y, M, C, and K are suffixes attached to constituent members corresponding to yellow, magenta, cyan, and black, respectively, and are omitted as appropriate.

Figure 2:
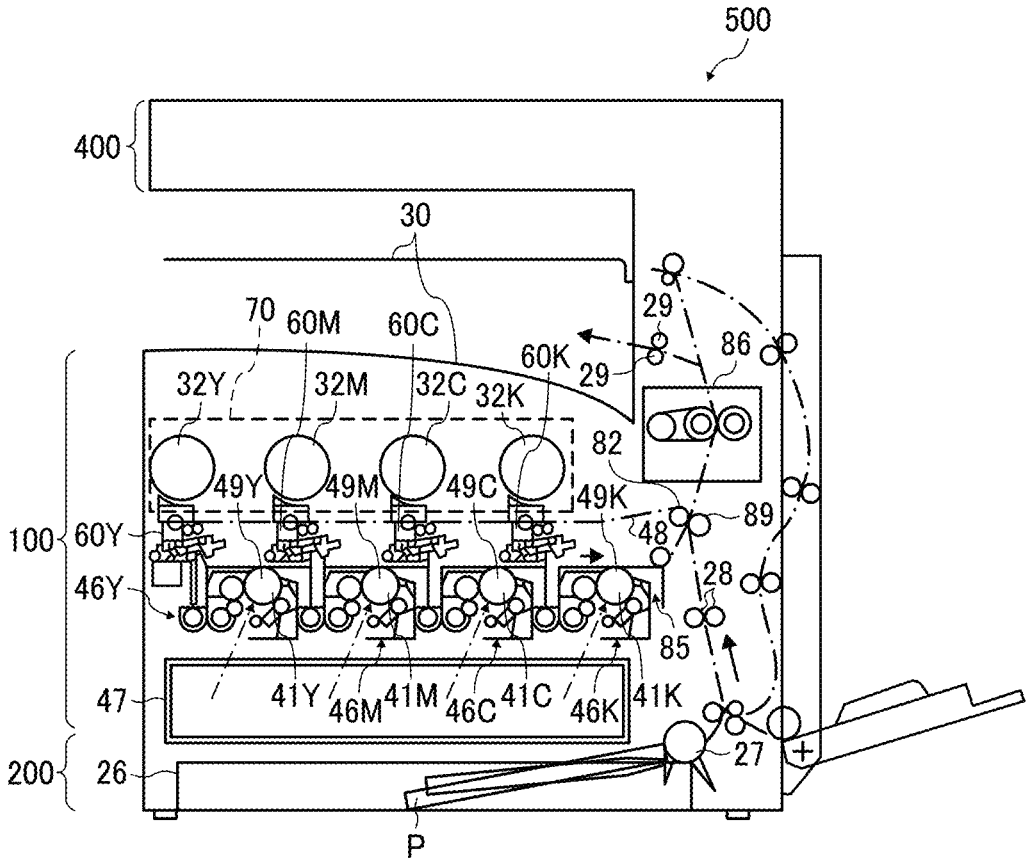
FIG. 2 is a diagram illustrating an overall configuration of an image forming apparatus according to an embodiment of the present disclosure.

FIG. 2 is a schematic diagram illustrating an overall configuration of an electrophotographic tandem-type color copier (hereinafter, referred to as "a copier 500") serving as an image forming apparatus according to an embodiment of the present disclosure.

The copier 500 includes a main body (hereinafter referred to as "printer unit 100"), a sheet feeding table (hereinafter referred to as "sheet feeder 200"), and a document reader (hereinafter referred to as "scanner unit 400") disposed above the printer unit 100.

A toner container mount 70 serving as a powder container mount is disposed in an upper portion of the printer unit 100. Four detachable (replaceable) toner containers 32Y, 32M, 32C, and 32K as powder containers (also collectively referred to as "toner containers 32") to contain yellow, magenta, cyan, and black toners, respectively, are disposed in the toner container mount 70. An intermediate transfer unit 85 is disposed below the toner container mount 70.

The intermediate transfer unit 85 includes an intermediate transfer belt 48 (serving as an intermediate transferor), four primary-transfer bias rollers 49Y. 49M. 49C, and 49K, a secondary-transfer backup roller 82, a plurality of tension rollers, and an intermediate transfer belt cleaner. The intermediate transfer belt 48 is stretched and supported by the above-described multiple rollers and is rotated in the direction indicated by arrow in FIG. 2 as the secondary-transfer backup roller 82 of the multiple rollers rotates.

In the printer unit 100, four image forming units 46Y, 46M, 46C, and 46K (also collectively referred to as "image forming units 46") as image forming devices corresponding to yellow, magenta, cyan, and black are arranged in parallel, facing the intermediate transfer belt 48 to form yellow, magenta, cyan, and black toner images, respectively. Four toner supply devices 60Y, 60M, 60C, and 60K (also collectively referred to as "toner supply devices 60") serving as four powder supply devices are disposed below the corresponding four toner containers 32Y, 32M, 32C, and 32K, respectively. The toner supply devices 60Y, 60M, 60C, and 60K supply toners (serving as powder) contained in the corresponding toner containers 32Y, 32M, 32C, and 32K to developing devices 50 (see developing device 50Y in FIG. 2) of the corresponding image forming units 46Y, 46M, 46C, and 46K, respectively.

As illustrated in FIG. 2, the printer unit 100 further includes an exposure device 47 as a latent image forming device below the four image forming units 46. The exposure device 47 irradiates and scans surfaces of photoconductors 41Y, 41M, 41C, and 41K described below, based on image data read by the scanner unit 400, and forms latent images on the surfaces of the photoconductors 41Y, 41M, 41C, and 41K. The image data may be either that read by the scanner unit 400 or that input from an external device such as a personal computer connected to the copier 500.

Although the exposure device 47 in the configuration illustrated in FIG. 1 employs laser beam scanning using a laser diode, other configurations such as those using light-emitting diode (LED) arrays may be used.

Figure 3:
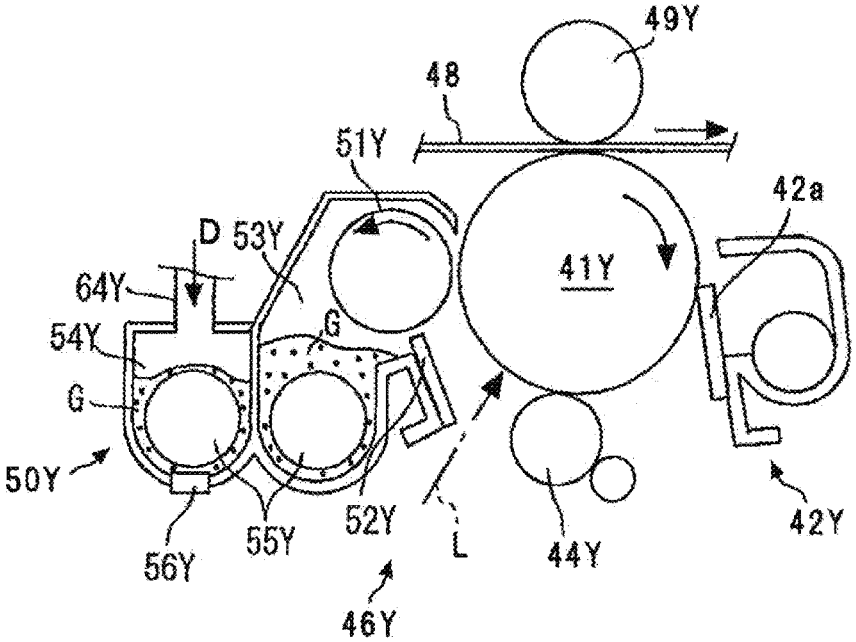
FIG. 3 is a schematic diagram illustrating a configuration of an image forming unit of the image forming apparatus illustrated in FIG. 2.

FIG. 3 is a schematic end-on axial view of the image forming unit 46Y for yellow.

The image forming unit 46Y includes the drum-shaped photoconductor 41Y serving as a latent image bearer. In the image forming unit 46Y, around the photoconductor 41Y, a charging roller 44Y serving as a charging device, a developing device 50Y, a photoconductor cleaning device 42Y to clean the photoconductor 41Y, and a discharger are disposed. A series of image forming processes, which are a charging process, an exposure process, a developing process, a transfer process and a charging process) is performed on the photoconductor 41Y, and a yellow image is formed on a surface of the photoconductor 41Y.

Note that the other three image forming units 46M, 46C, and 46K have a similar configuration to that of the yellow image forming unit 46Y except the color of the toner used therein and form toner images of the respective colors on the photoconductors 41M, 41C, and 41K. Thus, only the image forming unit 46Y is described below and descriptions of other three image forming units 46M, 46C, and 46K are omitted.

The photoconductor 41Y is driven by a drive motor to rotate clockwise in FIG. 3. The surface of the photoconductor 41Y is uniformly charged by the charging roller 4Y at a position facing the charging roller 44Y (charging process). When the photoconductor 41Y reaches a position to receive a laser beam L emitted from an exposure device 47, the photoconductor 41Y is scanned with the laser beam L, and thus an electrostatic latent image for yellow is formed thereon (exposure process). Then, the photoconductor 41Y reaches a position opposite the developing device 50Y, where the electrostatic latent image is developed with yellow toner into a yellow toner image (developing process).

The four primary-transfer bias rollers 49Y, 49M, 49C, and 49K of the intermediate transfer unit 85 sandwich the intermediate transfer belt 48 with the corresponding photoconductors 41Y, 41M, 41C, and 41K, respectively, forming primary transfer nips therebetween. The primary-transfer bias rollers 49Y, 49M, 49C, and 49K are applied with a primary transfer bias having a polarity opposite a polarity of electric charge of toner.

When the surface of the photoconductor 41Y on which the toner image has been formed in the developing process reaches the position opposite the primary-transfer bias roller 49Y via the intermediate transfer belt 48, the toner image is transferred from the photoconductor 41Y onto the intermediate transfer belt 48 in the primary transfer nip (primary transfer process). After the primary transfer process, a slight amount of toner is likely to remain untransferred on the photoconductor 41Y. After the toner image is transferred onto the intermediate transfer belt 48 at the primary transfer nip, the surface of the photoconductor 41Y reaches a position facing the photoconductor cleaning device 42Y. The untransferred toner remaining on the photoconductor 41Y is mechanically collected by a cleaning blade 42*a* of the photoconductor cleaning device 42Y at the position facing the photoconductor cleaning device 42Y (cleaning process). Finally, the surface of the photoconductor 41Y reaches a position facing the discharger, at which the residual potential on the photoconductors 41Y is removed. In this way, a series of image forming processes performed on the photoconductor 41Y is completed.

Such a series of image forming processes is also performed in the other image forming units 46 (M, C, and K) similarly to the image forming unit 46Y for yellow. That is, the exposure device 47 disposed below the image forming units 46M, 46C, and 46K irradiates photoconductors 41M, 41C, and 41K of the image forming units 46M, 46C, and 46K, respectively, with laser beams L based on image data. Specifically, the exposure device 47 includes light sources to emit the laser beams L, multiple optical elements, and a polygon mirror that is rotated by a motor. The exposure device 47 directs the laser beams L to the respective photoconductors 41M, 41C, and 41K via the multiple optical elements while deflecting the laser beams L with the polygon mirror. Then, the toner images are transferred from the respective photoconductors 41M, 41C, and 41K onto the intermediate transfer belt 48 and superimposed one on another thereon.

While rotating in the direction indicated by the arrow illustrated in FIG. 2, the intermediate transfer belt 48 sequentially passes through the respective primary transfer nips of the primary-transfer bias rollers 49Y, 49M, 49C, and 49K. Thus, yellow, magenta, cyan, and black toner images are primarily transferred from the respective photoconductors 41Y, 41M, 41C, and 41K and superimposed one on another, into a multicolor toner, on the intermediate transfer belt 48.

The intermediate transfer belt 48 bearing the multicolor toner image reaches a position opposite a secondary transfer roller 89 disposed opposite the secondary-transfer backup roller 82. At this position, the secondary-transfer backup roller 82 and the secondary transfer roller 89 nip the intermediate transfer belt 48 therebetween to form a secondary transfer nip. The color toner image formed on the intermediate transfer belt 48 is transferred onto a recording medium P such as a transfer sheet conveyed to the position of the secondary transfer nip, for example, by the action of a transfer bias applied to the secondary-transfer backup roller 82. At this time, untransferred toner that has not been transferred to the recording medium P remains on the intermediate transfer belt 48. The intermediate transfer belt 48 having passed through the secondary transfer nip reaches a position of an intermediate transfer cleaning device, and untransferred toner on the surface of the intermediate transfer belt 48 is collected. Thus, a series of transfer processes performed on the intermediate transfer belt 48 ends.

Next, the movement of the recording medium P will be described.

The recording medium P conveyed to the secondary transfer nip is conveyed from a sheet feed tray 26 of a sheet feeder 200 disposed below the printer unit 100 via, for example, a sheet feed roller 27 and a registration roller pair 28. Specifically, a plurality of recording media P are stacked and stored in the sheet feed tray 26. When the sheet feed roller 27 is driven to rotate counterclockwise in FIG. 2, the uppermost recording medium P is conveyed toward a roller nip formed by two rollers of the registration roller pair 28.

The registration roller pair 28 stops rotating temporarily, stopping the recording medium P with a leading edge of the recording medium P nipped in the roller nip between the registration roller pair 28. The registration roller pair 28 is rotationally driven in accordance with the timing at which the color toner image on the intermediate transfer belt 48 reaches the secondary transfer nip. Accordingly, the recording medium P is conveyed toward the secondary transfer nip. Thus, the multicolor toner image is transferred onto the recording medium P.

The recording medium P onto which the color toner image has been transferred at the secondary transfer nip is conveyed to a position of a fixing device 86. In the fixing device 86, the color toner image transferred to the surface of the recording medium P is fixed onto the recording medium P by heat and pressure from a fixing belt and a pressure roller. The recording medium P having passed through the fixing device 86 is ejected to the outside of the copier 500 via the rollers of an ejection roller pair 29. The recording medium P ejected to the outside of the copier 500 by the ejection roller pair 29 is sequentially stacked on the stacking unit 30 as an output image. Thus, a sequence of image forming processes performed in the copier 500 is completed.

Next, a configuration and operation of the developing device 50Y in the image forming unit 46Y are described in further detail below. Although the yellow image forming unit 46Y is described as a representative here, the image forming units 46 for other colors are similar in configuration and operation to the image forming unit 46Y.

As illustrated in FIG. 2, the developing device 50Y includes, for example, a developing roller 51Y serving as a developer bearer, a doctor blade 52Y serving as a developer regulation plate, two developer conveying screws 55Y, and a toner concentration sensor 56Y. The developing roller 51Y faces the photoconductor 41Y, and the doctor blade 52Y faces the developing roller 51Y. The two developer conveying screws 55Y are disposed inside two developer containing compartments, namely, first developer containing compartment 53Y and the second developer containing compartment 54Y. The developing roller 51Y includes a stationary magnet roller (or multiple magnets), a sleeve that rotates around the magnet roller, and the like. The first developer containing compartment 53Y and the second developer containing compartment 54Y contain two-component developer G including carrier (carrier particles) and toner (toner particles). The second developer containing compartment 54Y communicates, via an opening on an upper side thereof, with a downward toner conveyance passage 64Y. The toner concentration sensor 56Y detects the concentration of toner in developer in the second developer containing compartment 54Y.

Inside the developing device 50Y, the developer G is stirred by the two developer conveying screws 55Y and circulated between the first developer containing compartment 53Y and the second developer containing compartment 54Y. While being transported by the developer conveying screw 55Y, the developer G in the first developer containing compartment 53Y is attracted by magnetic fields generated by the magnet roller inside the developing roller 51Y and carried onto the sleeve surface of the developing roller 51Y. The developer G carried on the developing roller 51Y moves along the circumference of the developing roller 51Y as the sleeve of the developing roller 51Y rotates counterclockwise in FIG. 3 as indicated by an arrow in FIG. 3. At that time, toner particles in developer G are charged through friction with carrier particles to have a potential in the polarity opposite the polarity of carrier particles. Then, the toner particles are electrostatically attracted to the carrier particles and carried on the developing roller 51Y together with the carrier particles by the magnetic field generated on the developing roller 51Y.

The developer G carried on the developing roller 51Y is transported as indicated by an arrow in FIG. 3 to a position where the doctor blade 52Y faces the developing roller 51Y. When the developer G on the developing roller 51Y posses through the portion, the amount of the developer G is regulated to an appropriate amount, and then the developer G is conveyed to a developing region which is a position facing the photoconductor 41Y. In the developing region, the toner in developer G adheres to the latent image formed on the photoconductor 41Y due to the effect of the developing electrical field generated between the developing roller 51Y and the photoconductor 41Y. As the sleeve rotates, the developer G remaining on the surface of the developing roller 51Y having passed the developing region reaches an upper part in the first developer containing compartment 53Y and then drops from the developing roller 51Y.

The concentration of toner in developer G contained in the developing device 50Y is adjusted within a predetermined range. Specifically, the toner supply device 60Y, described below, supplies the toner from the toner container 32Y to the second developer containing compartment 54Y according to the consumption of toner in the developing device 50Y. The developer conveying screws 55Y stir the toner supplied to the second developer containing compartment 54Y, together with the developer G, and circulate the toner between the first developer containing compartment 53Y and the second developer containing compartment 54Y.

Next, the toner supply devices 60Y, 60M, 60C, and 60K are further described below.

Figure 4:
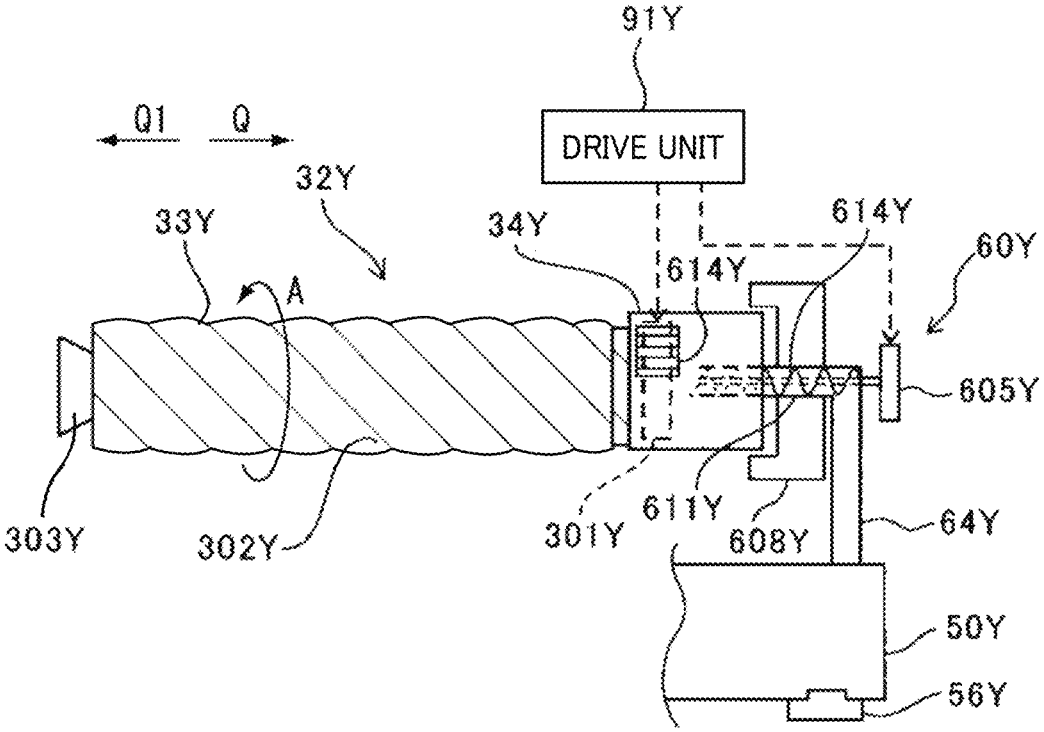
FIG. 4 is a schematic diagram illustrating a toner container attached to a toner supply device in the image forming apparatus illustrated in FIG. 2.
Figure 5:
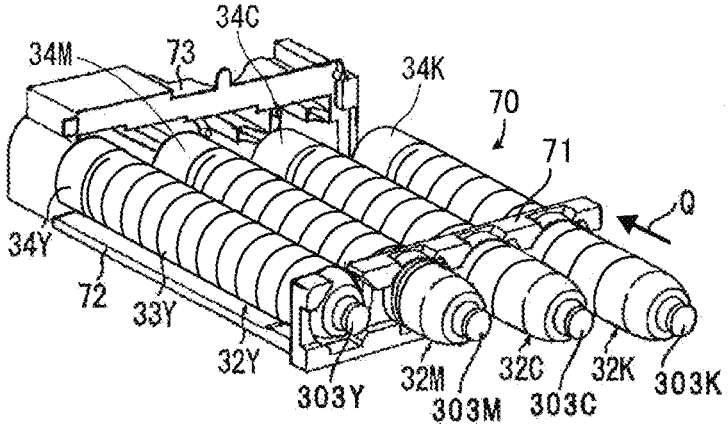
FIG. 5 is a perspective view of toner containers attached to the toner supply device.

FIG. 4 is a schematic diagram illustrating the toner container 32Y attached to the toner supply device 60Y. FIG. 5 is a perspective view of the four toner containers 32Y, 32M, 32C, and 32K attached to the toner container mount 70.

Color toners contained in the toner containers 32Y, 32M, 32C, and 32K attached in the toner container mount 70 of the printer unit 100 are supplied into the corresponding developing devices 50Y, SM, 50C, and 50K of the image forming units 46Y, 46M, 46C, and 46K according to the amount of toner consumption in the developing devices 50Y, 50M, 50C, and 50K, respectively. The toner supply devices 60Y, 60M, 60C, and 60K supply the respective color toners from the toner containers 32Y, 32M, 32C, and 32K to the corresponding developing devices 50Y, 50M, 50C, and 50K, respectively. The four toner supply devices 60Y, 60M, 60C, and 60K have substantially the same configurations except the color of the toner used in the image forming processes. The toner containers 32Y, 32M, 32C, and 32K have substantially the same configurations except the color of the toner used in the image forming processes. Therefore, the toner supply device 60Y and the toner container 32Y for yellow are described below as representatives, and descriptions of the toner supply devices 60M, 60C, and 60K and the toner containers 32M, 32C, and 32K for other three colors may be omitted below for simplicity.

The toner supply device 60Y includes the toner container mount 70, a conveying nozzle 611Y as a conveyance tube, a conveying screw 614Y as a conveyor, a downward toner conveyance passage 64Y, and a drive unit 91Y.

When the toner container 32Y is moved in an attachment direction indicated by arrow Q in FIG. 4 by an attachment operation in which the user pushes the toner container 32Y into the toner container mount 70 of the printer unit 100, the conveying nozzle 611Y of the toner supply device 60Y is inserted from the front end side of the toner container 32Y in conjunction with the attachment operation. With this action, the interior of the toner container 32Y communicates with the conveying nozzle 611Y. Details of the configuration for communicating in conjunction with this attachment operation will be described below. In FIG. 4, arrow Q1 indicates a detachment direction in which the toner container 32Y is removed from the toner container mount 70.

The toner container 32Y is, for example, a substantially cylindrical toner bottle, as a form of the toner container. The toner container 32Y includes a container front-end cover 34Y irrotationally held by the toner container mount 70 and a container body 33Y (serving as a powder storage member) molded together with a container gear 301Y. The container body 33Y is held to be rotatable relative to the container front-end cover 34Y.

The toner container mount 70 mainly includes a container-cover receiver 73, a container receiver 72, and an insertion port part 71, as illustrated in FIG. 5. The container-cover receiver 73 holds the container front-end cover 34Y and the container body 33Y of the toner container 32Y.

The container receiver 72 is a portion for supporting the container body 33Y of the toner container 32Y. The insertion port part 71 forms an insertion port into which the toner container 32Y is inserted in the attachment operation.

When a front cover of the copier 500 (on the front side of the plane on which FIG. 1 is drawn) is opened, the insertion port pan 71 of the toner container mount 70 is exposed. The attachment and detachment operations of the toner containers 32Y, 32M, 32C, and 32K are performed from the toner container mount 70 from the front side of the copier 500 with the long axis of the toner containers 32Y, 32M, 32C, and 32K kept horizontal. In the attachment and detachment operations, the longitudinal direction of each toner container 32 is a direction in which each toner container 32 is attached to or detached from the toner container mount 70. Note that a mounting cover 608Y illustrated in FIG. 4 is a portion of the container-cover receiver 73 of the toner container mount 70.

The longitudinal length of the container receiver 72 is approximately equal to the longitudinal length of the container body 33Y. The container-cover receiver 73 is disposed at one end of the container receiver 72, on which the front end of the toner container 32Y is placed, in the longitudinal direction (the direction of attachment) of the container receiver 72. The insertion port part 71 is disposed at the other end of the container receiver 72 in the longitudinal direction of the container receiver 72. Each of the four toner containers 32 is slidably movable on the container receiver 72. Accordingly, in the attachment operation of the toner container 32Y, the container front-end cover 34Y passes through the insertion port part 71, slides on the container receiver 72 for a certain distance, and is then attached to the container-cover receiver 73.

Figure 8:
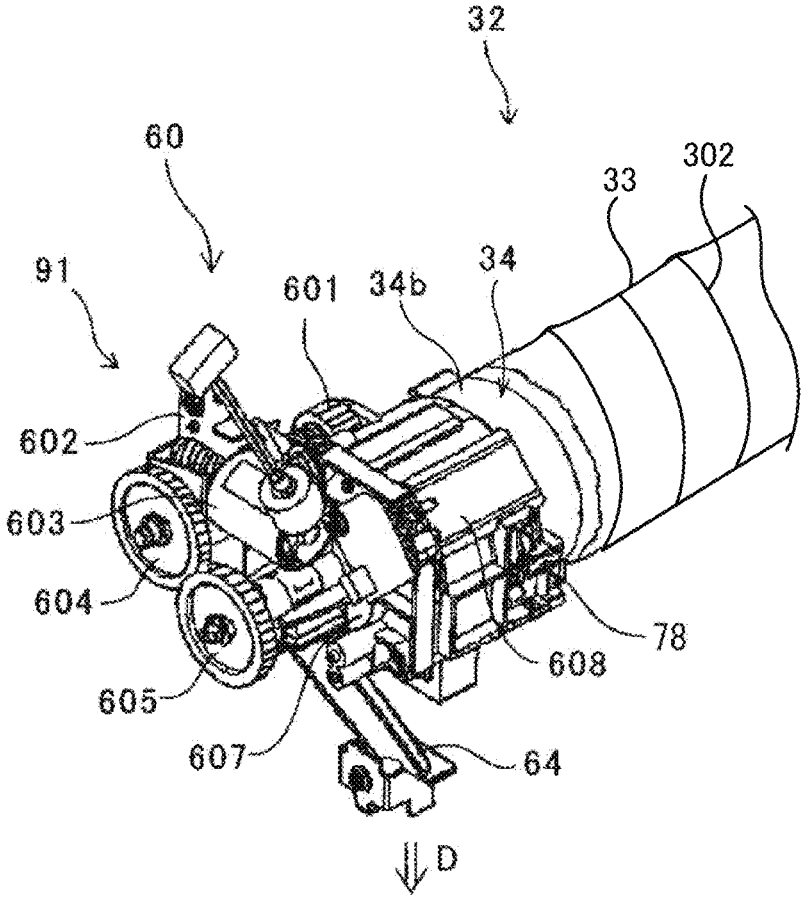
FIG. 8 is a perspective view of the toner container of FIG. 6 attached to the toner supply device.

In a state in which the container front-end cover 34Y is attached to the container-cover receiver 73, a rotation driving force is input to the container gear 301Y (see FIG. 10) of the container body 33Y, via a main-body-side container drive gear 601Y of the toner supply device 60, from the drive unit 91Y including a drive motor and a drive gear as illustrated in FIG. 8. Accordingly, the container body 33Y is driven to rotate in the direction indicated by arrow A illustrated in FIG. 4 (hereinafter "rotation direction A"). The container body 33Y includes a spiral rib 302Y serving as a conveyance member formed in a spiral shape on an inner surface of the container body 33Y. As the container body 33Y rotates, the spiral rib 302Y conveys toner in the container body 33Y from one end to the other end (e.g., from the left end to the right end in FIG. 4) in the longitudinal direction of the container body 33Y. Thus, toner is supplied from the container front-end cover 34Y on the other end into the conveying nozzle 611Y.

The conveying screw 614Y is disposed in the conveying nozzle 611Y. When a rotational driving force is input from the drive unit 91Y to the conveying screw gear 605Y, the conveying screw 614Y rotates and conveys the toner supplied into the conveying nozzle 611Y. A downstream end of the conveying nozzle 611Y in a conveyance direction in which toner is conveyed is connected to the downward toner conveyance passage 64Y. The toner conveyed by the conveying screw 614Y falls by its own weight along the downward toner conveyance passage 64Y and is supplied into the developing device 50Y (or the second developer containing compartment 54Y).

Each of the toner container 32Y, 32M, 32C, and 32K is replaced when the service life thereof has expired, that is, when almost all toner in each toner container 32 has been consumed. A grip portion 303Y is disposed at one end of the toner container 32Y opposite the container front-end cover 34Y in the longitudinal direction of the toner container 32. An operator can grasp and draw the grip portion 303Y out in the detachment direction Q1 opposite the attachment direction Q to remove the toner container 32Y from the copier 500 in replacement.

In the toner supply device 60Y according to the present embodiment, the amount of toner supplied to the developing device 50Y is controlled with the rotation speed of the conveying screw 614Y. Accordingly, on a downstream area from the conveying nozzle 611 in a direction in which toner is supplied, the amount of toner to be supplied to the developing device 50 is not restricted, and the toner is conveyed through the downward toner conveyance passage 64 directly to the developing device 50Y. Alternatively, in the toner supply device 60Y in which the conveying nozzle 611Y is inserted into the toner container 32Y as in the present embodiment, a temporary toner reservoir such as a toner hopper may be provided.

Next, the toner containers 32Y, 32M, 32C, and 32K and the toner supply devices 60Y, 60M, 60C, and 60K according to the present embodiment are further described. As described above, the four toner containers 32Y, 32M, 32C, and 32K have substantially the same configurations except the color of toner contained therein, and the four toner supply devices 60Y, 60M, 60C, and 60K have substantially the same configurations except the color of toner contained therein. For this reason, the suffixes Y, M, C, and K indicating the colors of the toners may be omitted in the following description.

Figure 6:
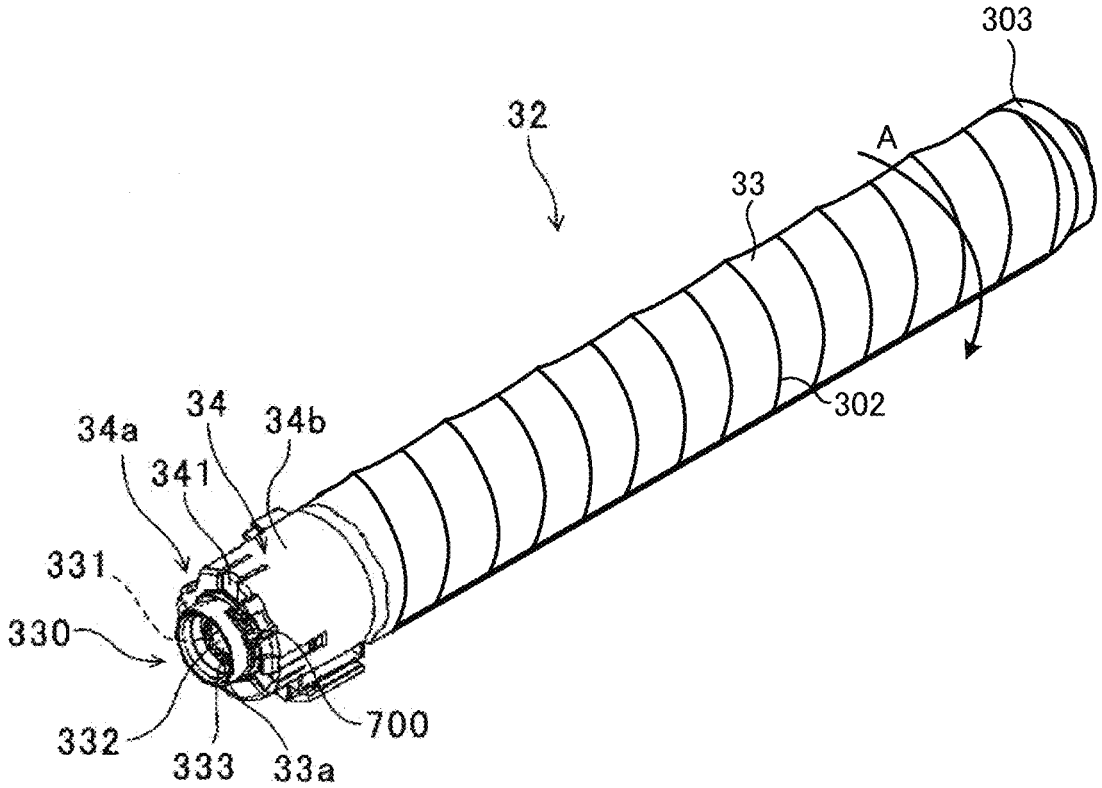
FIG. 6 is a perspective view of a toner container according to an embodiment of the present disclosure.
Figure 7:
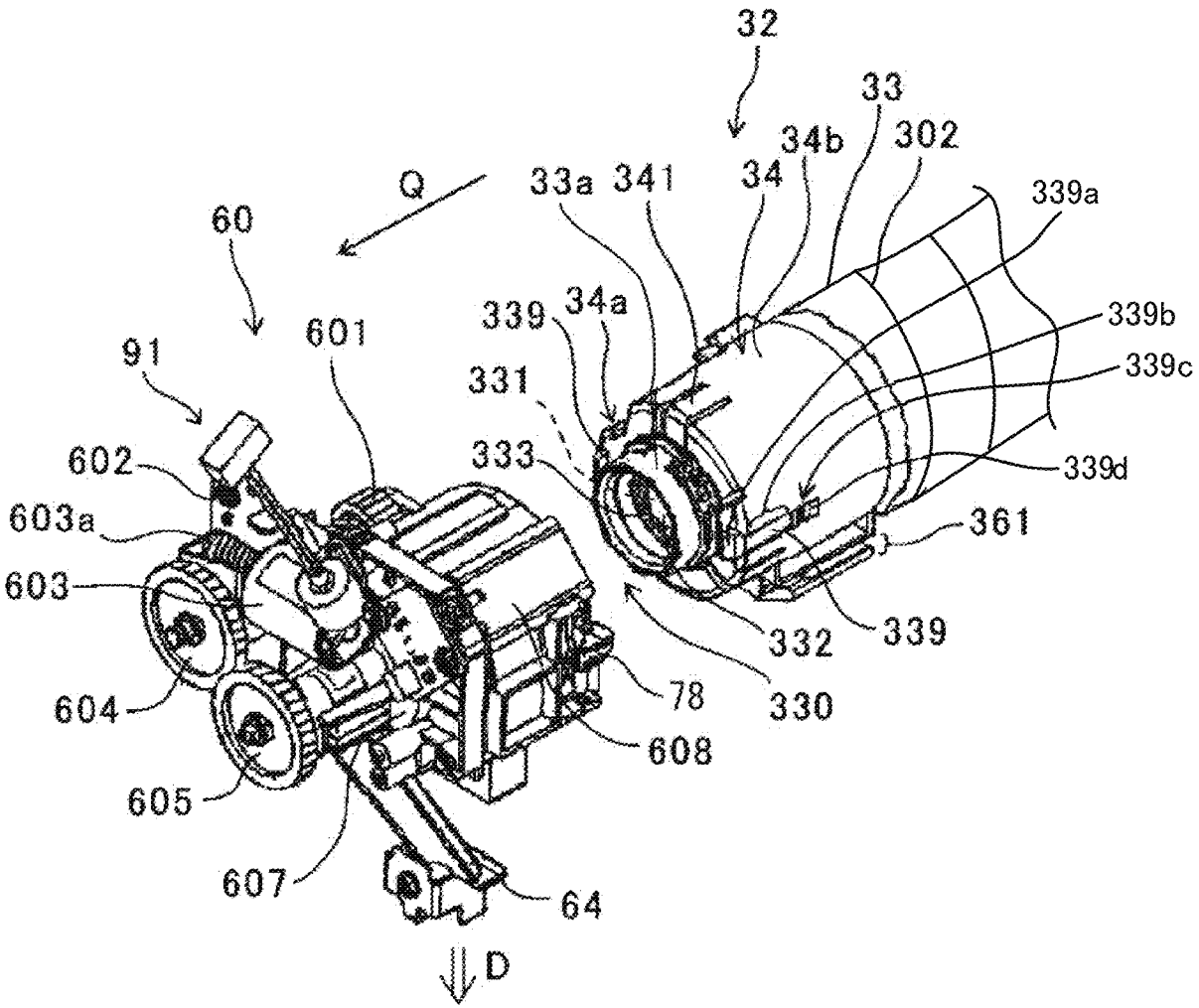
FIG. 7 is a perspective view of the toner container of FIG. 6 before attachment to the toner supply device.
Figure 9:
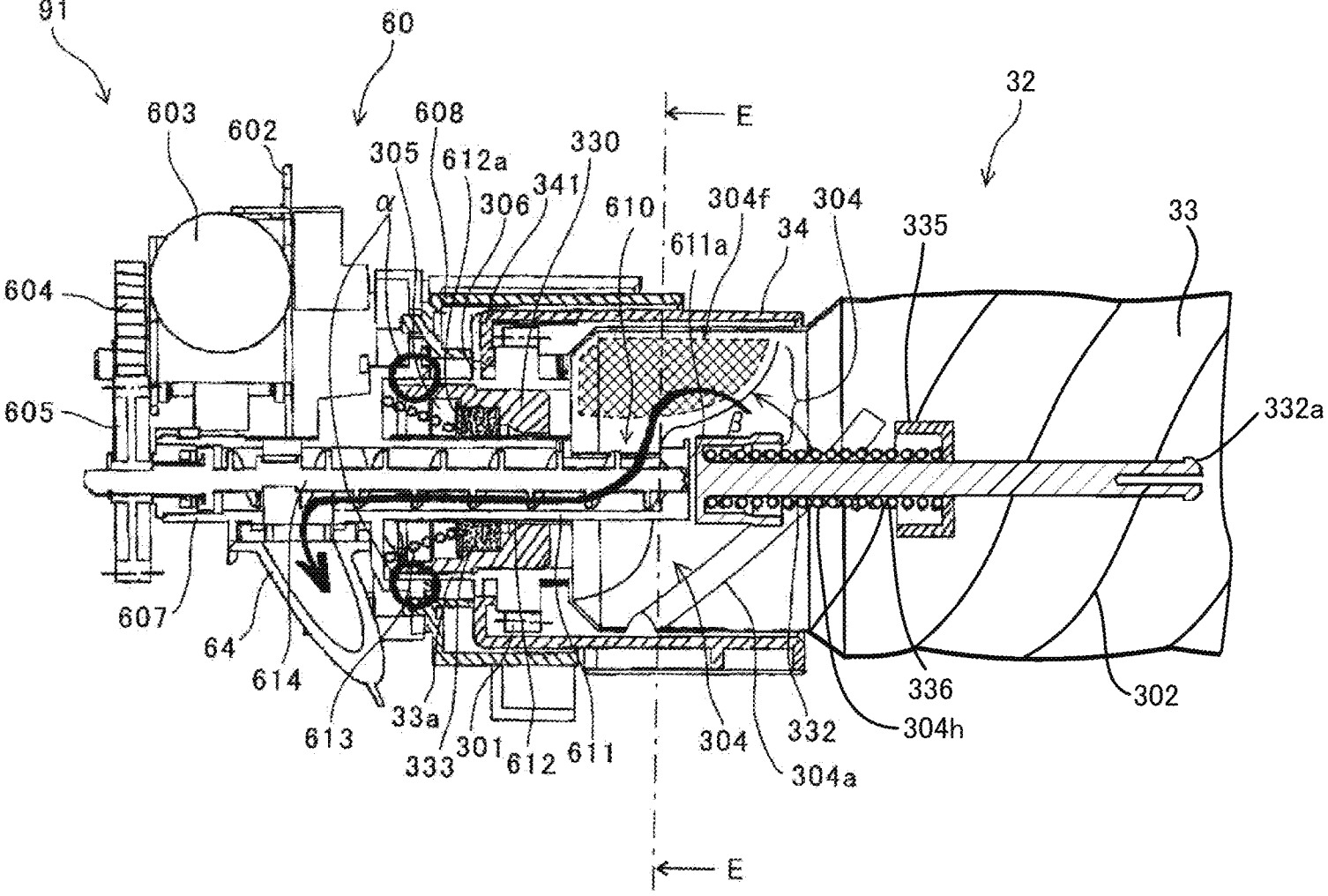
FIG. 9 is a cross-sectional view of the toner container of FIG. 6 attached to the toner supply device.

FIG. 1 is a cross-sectional view of the toner supply device 60 before the toner container 32 is attached and a front end portion of the toner container 32. FIG. 9 is a cross-sectional view of the toner supply device 60 with the toner container 32 attached and the front end portion of the toner container 32. FIG. 6 is a perspective view of the toner container 32. FIG. 7 is a perspective view of the toner supply device 60 before the toner container 32 is attached and the front end portion of the toner container 32. FIG. 8 is a perspective view of the toner supply device 60 with the toner container 32 attached and the front end portion of the toner container 32.

The toner supply device 60 includes the conveying nozzle 611 and a nozzle shutter 612. The conveying nozzle 611 includes the conveying screw 614. The nozzle shutter 612 serves as a member that opens and closes a powder receiving port. The nor-le shutter 612 closes a nozzle opening 610 serving as the powder receiving port formed in the conveying nozzle 611 in the state in which the toner container 32 is not attached (the state of FIGS. 1 and 7). The nozzle shutter 612 opens the nozzle opening 610 in the state in which the toner container 32 is attached (the state of FIGS. 8 and 9). In a center area of a front-end face of the toner container 32 (in other words, an end of the toner container 32 on the other end), a nozzle receiving port 331 is disposed that serves as a nozzle insertion port for receiving the insertion of the conveying nozzle 611 in the state in which the toner container 32 is attached. A container shutter 332 serving as a container opening-and-closing member is disposed to close the nozzle receiving port 331 in the state in which the toner container 32 is not attached.

The toner container mount 70 includes the container receiver 72 on which the toner container 32 slides and moves when the toner container 32 is attached to the toner supply device 60. As illustrated in FIG. 5, the container receiver 72 is divided into four portions in a width direction W perpendicular to the longitudinal direction (attachment/detachment direction) of the toner container. Groove portions 74 as container placing portions are formed along the longitudinal direction of the container bodies 33 so as to extend from the insertion port part 71 to the container-cover receiver 73. The toner containers 32Y, 32M, 32C, and 32K of the respective colors are configured to be slidable in the longitudinal direction on the groove portions 74.

Figure 20:
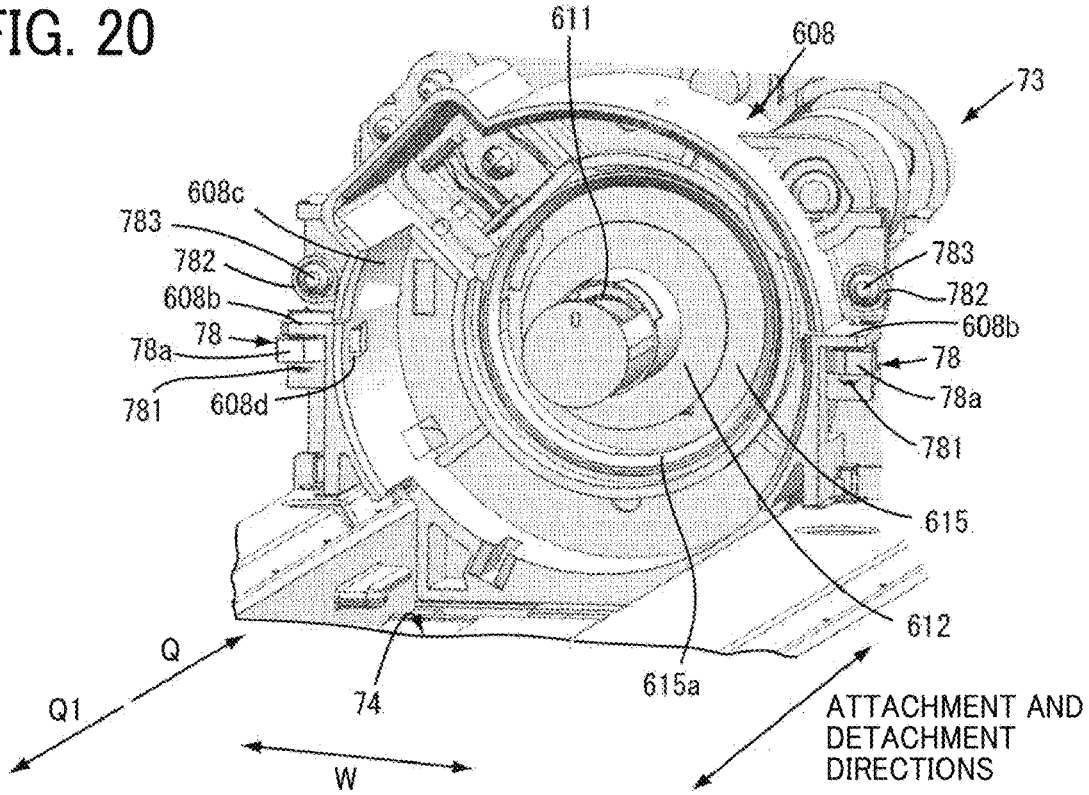
FIG. 20 is a partially enlarged perspective view of a toner container mount.

As illustrated in FIG. 20, the container-cover receiver 73 includes mounting covers 608Y, 608M, 608C, and 608K corresponding to the respective colors. In the center of the mounting cover 608, the conveying nozzle 611 is disposed so as to protrude into the container-cover receiver 73 from a downstream end surface 615*b* of a container setting portion 615 in the attachment direction toward the detachment direction of the toner container 32.

The container setting portion 615 is formed at the base of the conveying nozzle 611 when viewed from the attachment direction. A container mouth 33*a* described below is fitted into the container setting portion 615 in the state in which the toner container 32 is attached to the toner supply device 60. The container setting portion 615 includes an inner peripheral surface 615*a* (second cover inner periphery) and the end surface 615*b* located downstream from the inner peripheral surface 615*a* in the attachment direction of the toner container 32. The inner peripheral surface 615*a* and an outer peripheral surface of the container mouth 33*a* of the toner container 32 are slidably fitted to each other. This fitting positions the toner container 32 with respect to the toner supply device 60 in a plane direction perpendicular to the rotation axis of the toner container 32. When the toner container 32 rotates, the outer peripheral surface of the container mouth 33*a* of the toner container 32 functions as a rotation shaft portion, and the container setting portion 615 functions as a bearing. At this time, the outer peripheral surface of the container mouth 33*a* of the toner container 32 slidingly contacts the container setting portion 615, and the position where the toner container 32 is positioned with respect to the toner supply device 60 as indicated by a in FIG. 9. As illustrated in FIG. 1, the container setting portion 615 includes an inner peripheral surface 615*a* that is fitted to the outer peripheral surface of the container mouth 33*a* of the toner container 32 when the toner container 32 is set. Accordingly, the container body 33 can be driven to rotate in the state of being held by the container setting portion 615.

The toner container 32 is described below.

Figure 10:
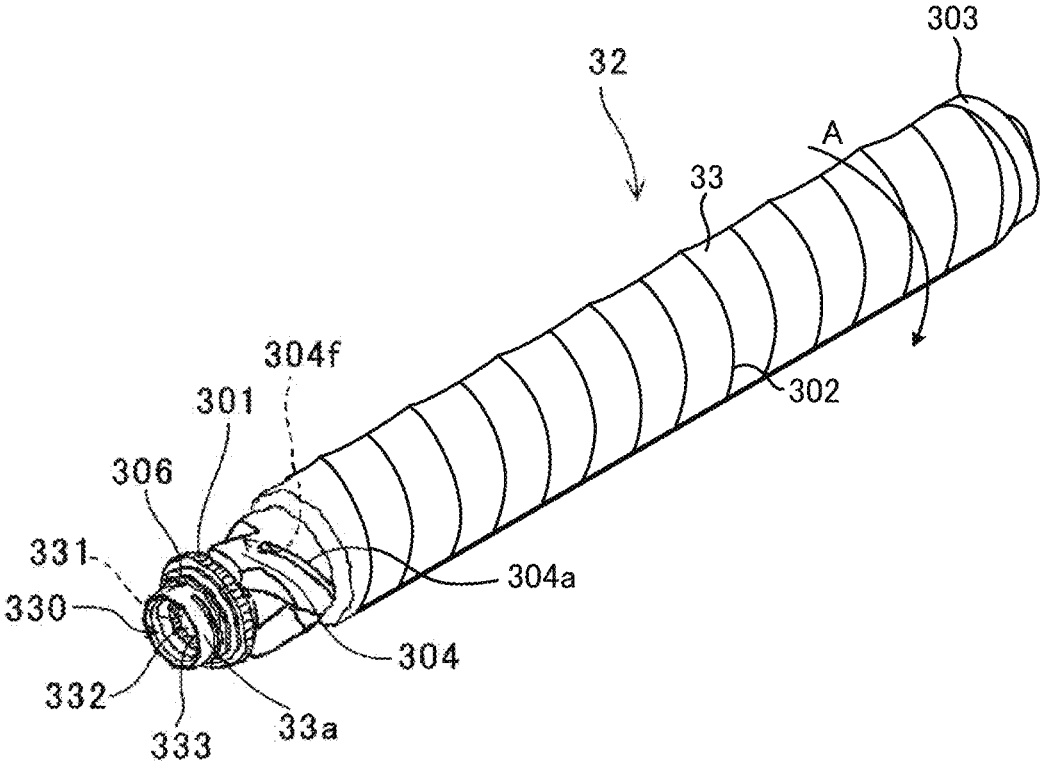
FIG. 10 is a perspective view of the toner container of FIG. 6 from which a container cover is removed.

As described above, the toner container 32 mainly includes the container body 33 in which toner is stored and the container front-end cover 34. FIG. 10 is a perspective view illustrating the toner container 32 in a state where the container front-end cover 34 is removed from the state illustrated in FIG. 6.

Figure 11:
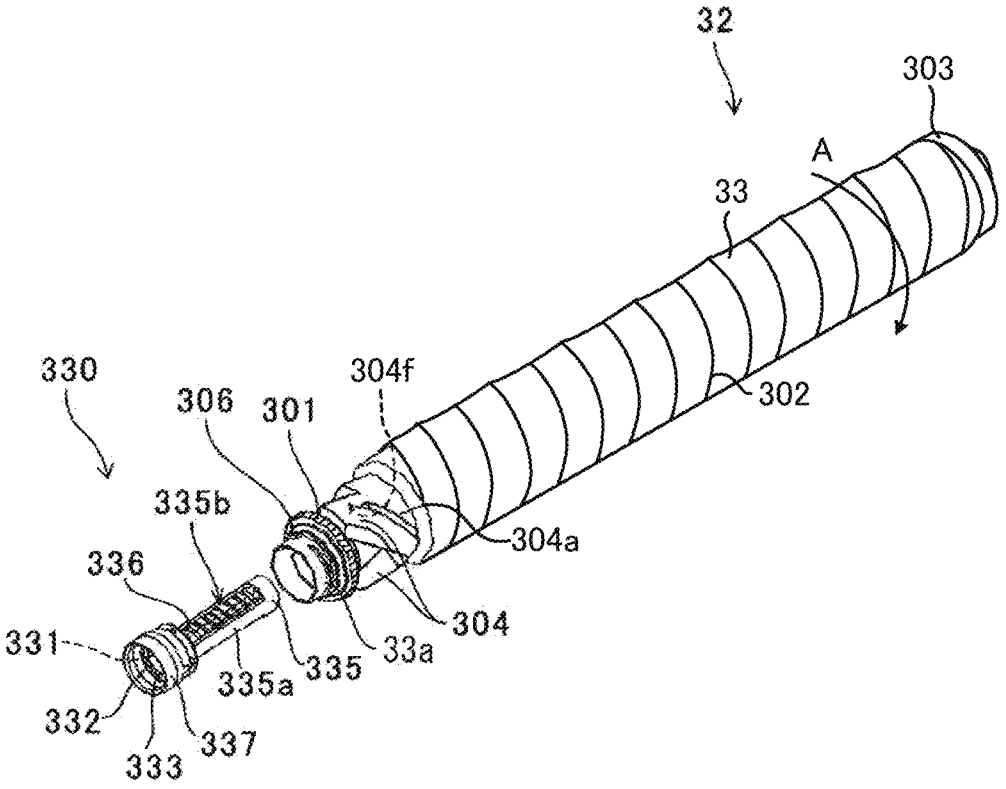
FIG. 11 is a perspective view of the toner container of FIG. 6 in which a nozzle receiver is removed from a container body.
Figure 12:
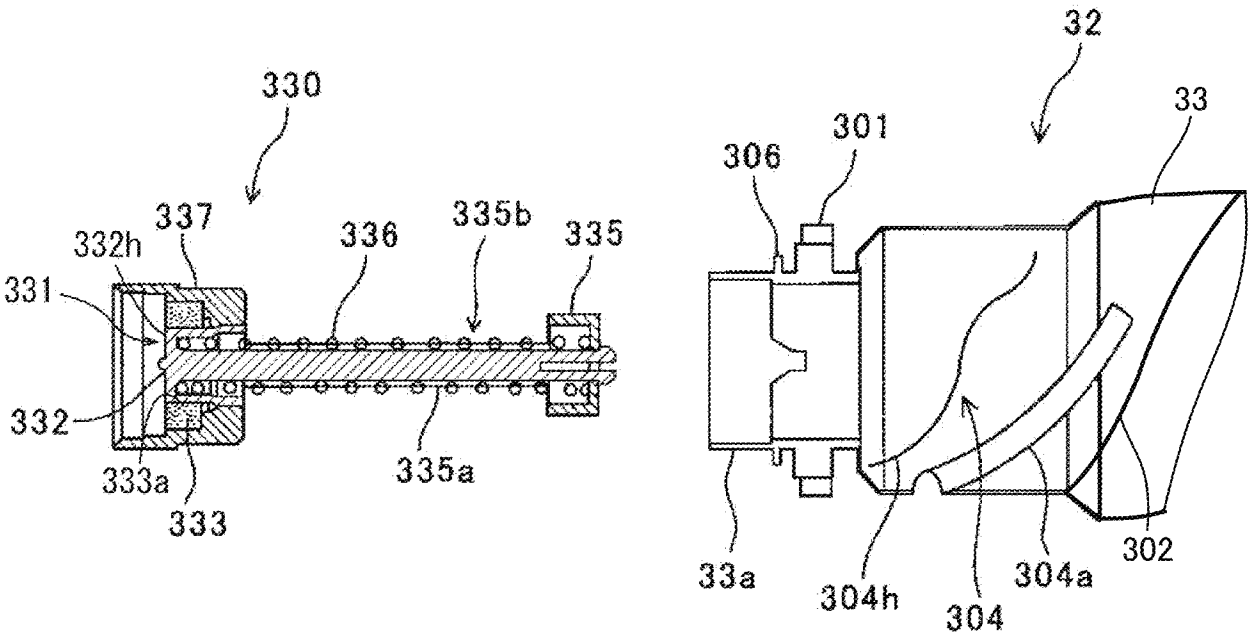
FIG. 12 is a cross-sectional view of the toner container of FIG. 6 in a state in which the nozzle receiver is removed from the container body.
Figure 13:
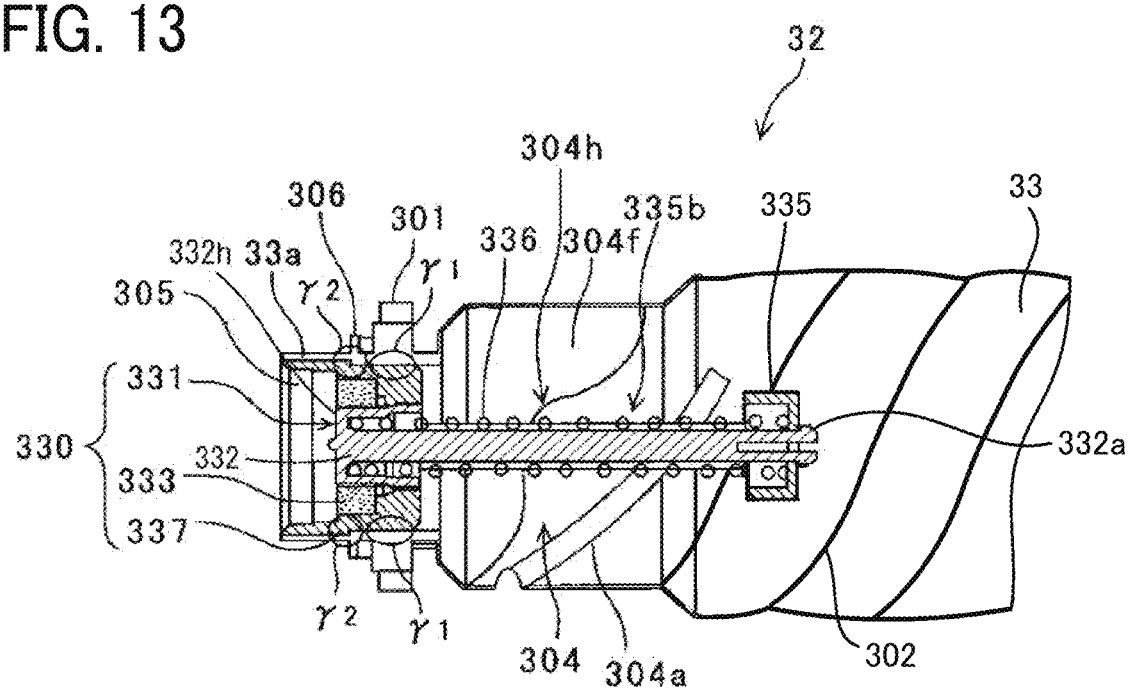
FIG. 13 is a cross-sectional view of the toner container in a state in which the nozzle receiver is attached to the container body from the state of FIG. 12.

FIG. 11 is a perspective view of the toner container 32 in a state where the nozzle receiver 330 as a tube insertion member is removed from the container body 33 from the state of FIG. 10. FIG. 12 is a cross-sectional view of the toner container 32 and the nozzle receiver 330 in the state where the nozzle receiver 330 is removed from the container body 33. FIG. 13 is a cross-sectional view of the toner container 32 in a state where the nozzle receiver 330 is attached to the container body 33 from the state of FIG. 12 (the toner container 32 in the state where the container front-end cover 34 is removed as in FIG. 10).

As illustrated in FIGS. 10 and 11, the container body 33 has a substantially polygonal cylindrical shape (i.e., a substantially polygonal shape in a cross section orthogonal to the rotation axis R) and is configured to rotate around a central axis of the substantially polygonal cylindrical shape as serving the rotation axis R. Here, the "substantially polygonal shape" includes a polygonal shape or a regular polygonal shape, and also means that the effects described below are exhibited by the specific shape configuration. The rotation axis R that is the central axis of the substantially polygonal cylinder is a longitudinal axis according to the present embodiment. The container body 33 of the toner container 32, which is the powder container according to the present embodiment, is configured to rotate around the rotation axis R, which is the longitudinal axis.

Hereinafter, a direction parallel to the rotation axis R is referred to as a "longitudinal direction" or "rotation axis direction". An end of the toner container 32 on which the nozzle receiving port 331 is formed (an end on which the container front-end cover 34 is disposed) in the rotation axis direction is referred to as "container front end".

An end of the toner container 32 on which the grip portion 303 is disposed (an end opposite to the front end of the toner container 32) is referred to as "container rear end". Note that the longitudinal direction and the attachment or detachment direction of the toner container 32 described above are the rotation axis direction. In a state where the toner container 32 is attached to the toner supply device 60, the rotation axis direction is a horizontal direction.

A portion (i.e., a large diameter portion) of the container body 33 closer to the container rear end than (in other words, upstream in the attachment direction Q from) the container gear 301 is larger in outer diameter than the front end of the container body 33, and the spiral rib 302 according to the present embodiment is disposed on the inner peripheral surface of the large diameter portion. As the container body 33 rotates in the direction A illustrated in FIG. 10, the spiral rib 302 gives the toner in the container body 33 a conveyance force from one end (the container rear end) to the other end (the container front end) in the axial direction. Note that the specific shapes of the inner peripheral surface and the outer peripheral surface of the container body 33, the spiral ribs 302 formed on the inner peripheral surface and the outer peripheral surface, and the like will be further described in detail below.

The inner wall in the container front end of the container body 33 includes a scooping portion 304 to lift (scoop) the toner being conveyed to the front end of the toner container 32 by the spiral rib 302 as the container body 33 rotates in the direction A in FIGS. 10 and 11. As illustrated in FIG. 13, the scooping portion 304 includes a convex portion 304*h* and a scooping wall surface 304*f*. The convex portion 304*h* is a portion (raised portion) that is raised inside the container body 33 so as to form a ridge of mountain toward the rotation center of the container body 33 while forming a spiral. The scooping wall surface 304*f* is a downstream wall surface, when viewed from the rotation direction of the toner container 32, of a wall surface of a contact portion continuous from the convex portion 304*h* (ridge) to the inner wall surface of the peripheral surface of the container body 33. When the scooping wall surface 304*f* is downward, the toner that has entered the internal space facing the scooping portion 304 due to the conveyance force of the spiral rib 302 is scooped upward by the scooping wall surface 304*f* in accordance with the rotation of the container body 33. As a result, toner can be drawn up above the inserted conveying nozzle 611.

As illustrated in FIG. 1 and FIG. 10, a scooping-portion spiral rib 304*a* formed in a spiral shape is also formed on the inner peripheral surface of the scooping portion 304 to convey the toner inside in the same manner as the spiral rib 302.

The container gear 301 is disposed at a position closer to the front end of the toner container 32 than the scooping portion 304 in the container body 33. The container front-end cover 34 has a gear exposing opening 34*a* to expose a part of the container gear 301 (on the back side in FIG. 10) in the state in which the container front-end cover 34 is attached to the container body 33. When the toner container 32 is attached to the toner supply device 60, the container gear 301 exposed from the gear exposing opening 34*a* is engaged with the main-body-side container drive gear 601 on the main body of the toner supply device 60.

The cylindrical container mouth 33*a* is disposed at a position closer to the front end of the toner container 32 than the container gear 301 in the container body 33. A receiver securing portion 337 of the nozzle receiver 330 is press-fitted in the container mouth 33*a* to secure the nozzle receiver 330 to the container body 33. The method of securing the nozzle receiver 330 is not limited to press fitting. Alternatively, the nozzle receiver 330 may be glued or screwed to the container body 33, for example.

After the toner is replenished from the container mouth 33*a* into the container body 33, the nozzle receiver 330 is secured to the container mouth 33*a* of the container body 33.

A cover-hook catch 306 is disposed at an end of the container mouth 33*a* of the container body 33 closer to the container gear 301. The container front-end cover 34 is attached from the front side of the toner container 32 (e.g., the lower left side in FIG. 10) to the toner container 32 (the container body 33) being in the state illustrated in FIG. 10.

Accordingly, the container body 33 penetrates the container front-end cover 34 in the longitudinal direction. Cover hooks 341 disposed at three positions around the container front-end cover 34 are hooked to corresponding cover-hook catches 306. The cover-hook catches 306 are formed over the entire outer circumference of the container mouth 33*a*. With the cover hooks 341 hooked to the cover-hook catches 306, the container body 33 can rotate relative to the container front-end cover 34.

As illustrated in FIG. 7, slide guides 361 are formed on both side surfaces of a lower portion of the container front-end cover 34 of the toner container 32. The pair of slide guides 361 support the toner container 32 placed on the groove on the container receiver 72 so as to be slidable in the attachment and detachment directions when the toner container 32 is attached to the toner container mount 70.

As illustrated in FIG. 7, container locking portions 339 for positioning the toner container 32 in the axial direction with respect to the toner supply device 60 are formed on the outer peripheral surface 34*b* of the container front-end cover 34. When the toner container 32 is attached to the toner supply device 60, each of the container locking portions 339 engages a corresponding supply-device-side lock member 78 on the mounting cover 608.

Next, the nozzle receiver 330 secured to the container body 33 is described below.

Figure 14:
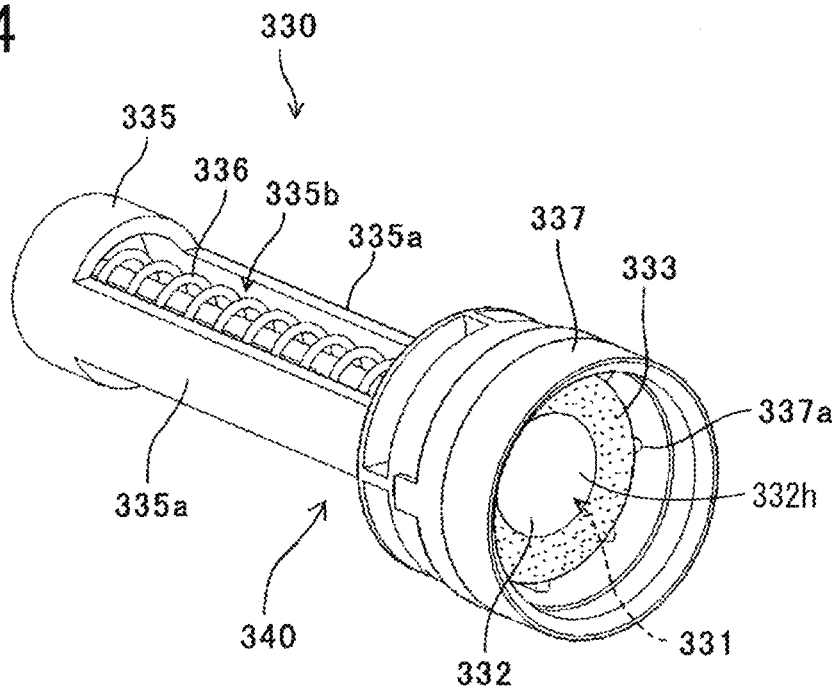
FIG. 14 is a perspective view of the nozzle receiver seen from a front end side of the toner container.
Figure 15:
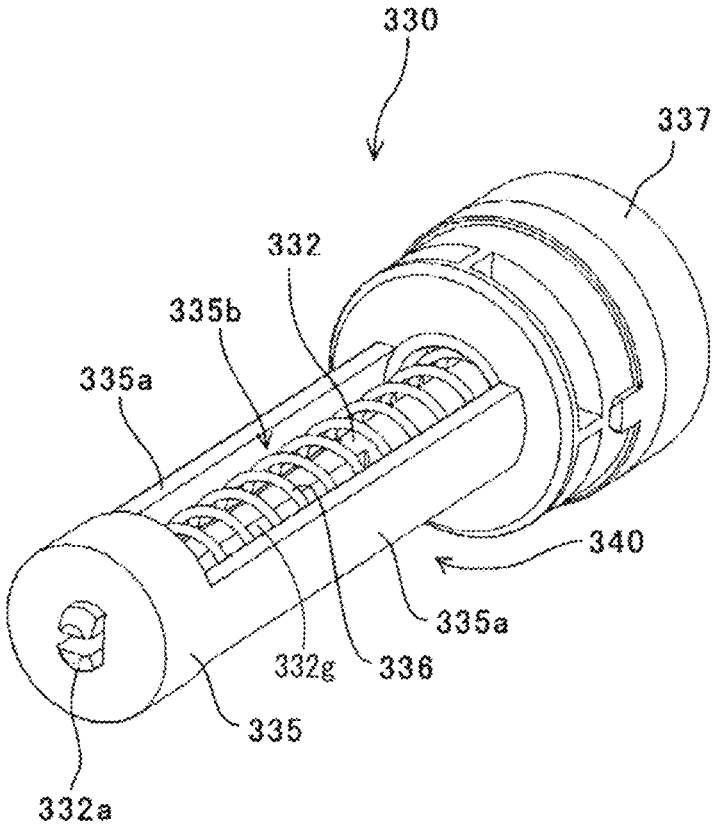
FIG. 15 is a perspective view of the nozzle receiver seen from a rear end side of the toner container.
Figure 16:
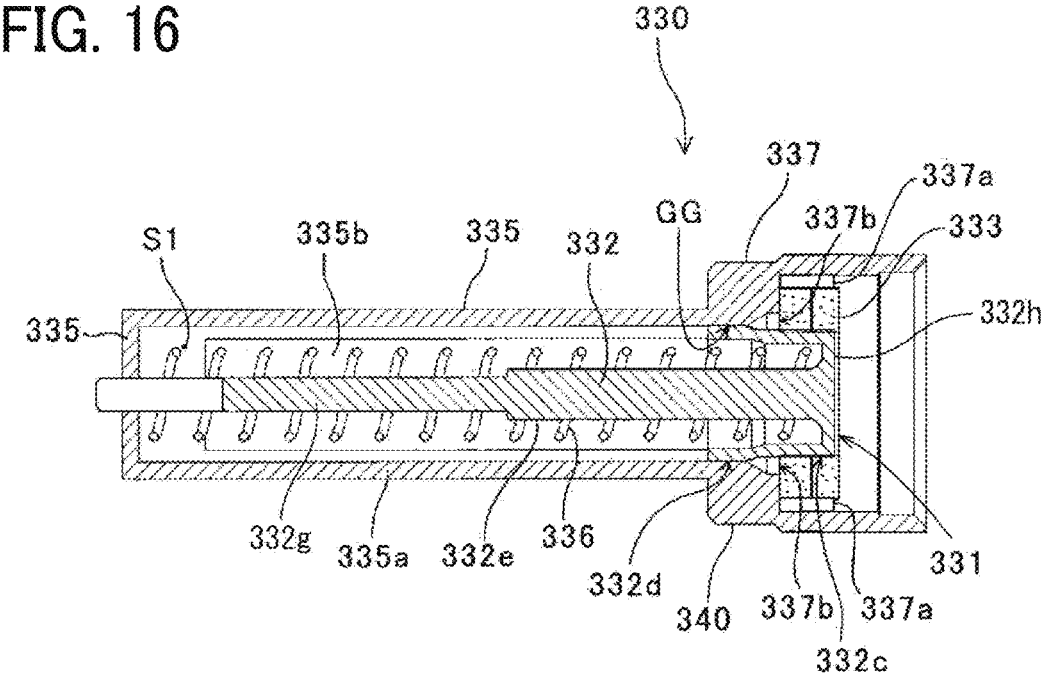
FIG. 16 is a top cross-sectional view of the nozzle receiver in the state illustrated in FIG. 13.
Figure 17:
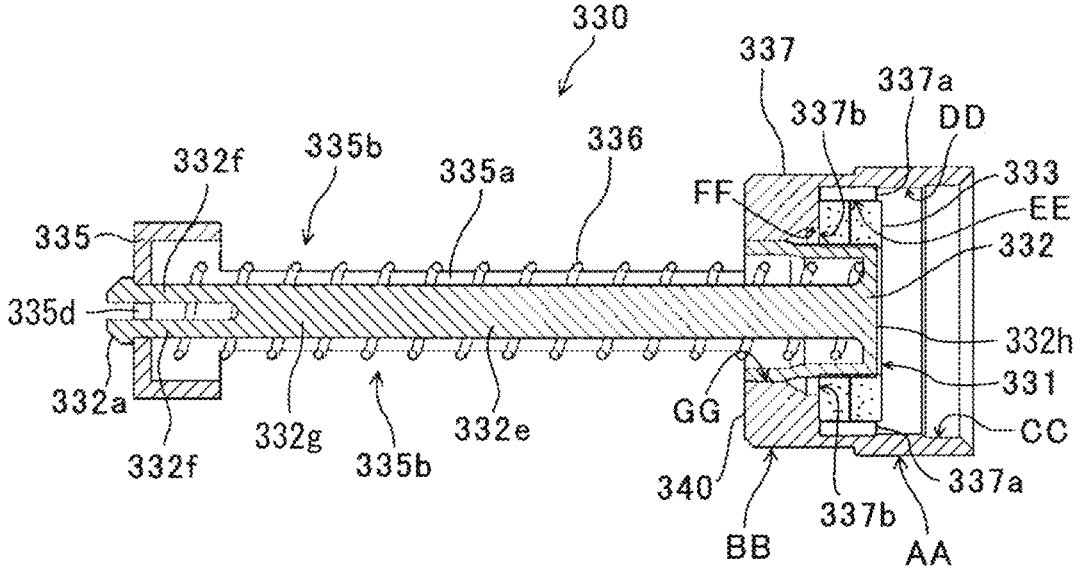
FIG. 17 is a cross-sectional view of the nozzle receiver in the state illustrated in FIG. 13.
Figure 18:
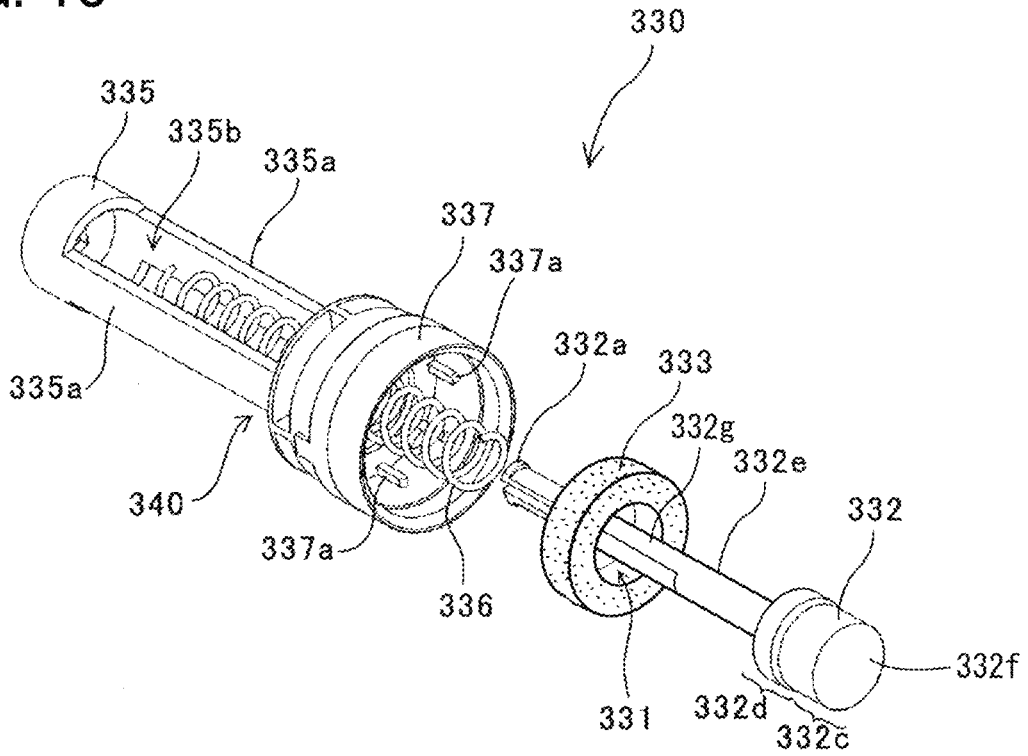
FIG. 18 is an exploded perspective view of the nozzle receiver.

FIG. 14 is a perspective view of the nozzle receiver 330 as viewed from the front side of the toner container 32. FIG. 15 is a perspective view of the nozzle receiver 330 as viewed from the rear side of the toner container 32. FIG. 16 is an upper cross-sectional view of the nozzle receiver 330 in the state illustrated in FIG. 13 as viewed from above. FIG. 17 is a lateral cross-sectional view of the nozzle receiver 330 in the state illustrated in FIG. 13 (back side in FIG. 13). FIG. 18 is an exploded perspective view of the nozzle receiver 330.

The nozzle receiver 330 includes a container shutter support 340 serving as a support, the container shutter 332, a container seal 333 serving as a seal member, a container shutter spring 336 serving as a biasing member, and the receiver securing portion 337. The container shutter support 340 includes a shutter rear-end support 335 serving as a rear end portion, a pair of shutter side supports 335*a* serving as lateral side portions, and shutter support openings 335*b* serving as side openings, and the receiver securing portion 337. The container shutter spring 336 is, for example, a coil spring.

The shutter side support 335*a* and the shutter support opening 335*b* of the container shutter support 340 are arranged adjacent to each other in the direction of rotation of the toner container 32. The two shutter side supports 335*a* facing each other form a part of the cylindrical shape. The cylindrical shape is largely cut out at the portions (two places) of the shutter support openings 335*b*. Such a shape allows the container shutter 332 to be guided to move in the axial direction in a columnar space S1 (see FIG. 16) formed inside the cylindrical shape.

The nozzle receiver 330 secured to the container body 33 rotates with the container body 33 as the container body 33 rotates. At this time, the shutter side supports 335*a* of the nozzle receiver 330 rotate around the conveying nozzle 611 of the toner supply device 60. Accordingly, the shutter side supports 335*a* pass a space close to and above the nozzle opening 610 located in the upper portion of the conveying nozzle 611. If the toner momentarily accumulates above the nozzle opening 610, the shutter side supports 335*a* cross and break the accumulated toner. This structure can reduce the aggregation of accumulated toner while the copier 500 is left unused, thus preventing the poor conveyance of toner at restart of the copier 500. On the other hand, when the shutter side supports 335*a* are positioned on the lateral sides of the conveying nozzle 611 and the nozzle opening 610 faces the shutter support opening 335*b*, toner is supplied from the container body 33 into the conveying nozzle 611 as indicated by arrow P illustrated in FIG. 9.

The container shutter 332 includes a cylindrical end portion 332*c* (serving as a closing portion), a sliding portion 332*d*, a guide rod 332*e*, and a pair of shutter retaining hooks 332*a*. The cylindrical end portion 332*c* is a part disposed on the front end of the toner container 32 to tightly contact a cylindrical opening (the nozzle receiving port 331) of the container seal 333.

The sliding portion 332*d* is a cylindrical portion which is formed closer to the rear end side of the container than the cylindrical end portion 332*c*, has a slightly larger outer radius than the cylindrical end portion 332*c*, and slides on the inner peripheral surfaces of the pair of shutter side supports 335*a*.

The guide rod 332*e* is a column standing from the inside of the cylinder of the cylindrical end portion 332*c* toward the rear end of the toner container 32, and is a rod to be inserted into the coil of the container shutter spring 336 to guide the container shutter spring 336 not to buckle.

The guide rod sliding portion 332*g* is a pair of flat surfaces formed on both sides of the column-shaped guide rod 332*e* from the middle of the column-shaped guide rod 332*e* across the central axis of the guide rod 332*e*. The guide rod sliding portion 332*g* is bifurcated at a position closer to the rear end of the toner container 32 to form a pair of cantilevers 332*f*.

Each one of the pair of shutter retaining hooks 332*a* is disposed at an end of the cantilever 332*f* opposite the rooted end of the guide rod 332*e*. The pair of shutter retaining books 332*a* is a pair of claws to prevent the container shutter 332 from slipping off the container shutter support 340.

As illustrated in FIGS. 16 and 17, a front-end portion of the container shutter spring 336 contacts an inner wall face of the container shutter 332, and a rear-end portion of the container shutter spring 336 contacts a wall face of the shutter rear-end support 335. Since the container shutter spring 336 is in a compressed state, the container shutter 332 is biased in a direction away from the shutter rear-end support 335 (in the right direction of FIGS. 16 and 17, and in a direction of the front end of the toner container 32). However, the shutter retaining hooks 332*a* at the rear end of the container shutter 332 are hooked on an outer wall of the shutter rear-end support 335. Thus, the container shutter 332 is prevented from moving away from the shutter rear-end support 335 as compared with the state illustrated in FIGS. 16 and 17.

Positioning is performed by the hook of the shutter retaining hooks 332*a* on the shutter rear-end support 335 and the biasing force of the container shutter spring 336. Specifically, the cylindrical end portion 332*c*, which prevents leak of toner from the container shutter 332, and the container seal 333 are positioned in the axial direction relative to the container shutter support 340. Accordingly, the cylindrical end portion 332*c* and the container seal 333 are positioned in close contact with each other, thus preventing leakage of toner.

The receiver securing portion 337 has a tubular shape in which the diameters of the outer peripheral surface and the inner peripheral surface gradually decrease toward the rear end of the toner container 32. The diameters decrease when viewed from the front end of the toner container 32 toward the rear end of the toner container 32. As illustrated in FIG. 17, the outer peripheral surface has two outer diameter portions, in other words, outer peripheral surfaces AA and BB in order from the front end of the toner container. The inner peripheral surface has five inner diameter portions, in other words, inner peripheral surfaces CC, DD, EE, FF, and GG in order from the front end of the toner container. The boundary of the outer peripheral surface between the outer peripheral surface AA and the outer peripheral surface BB is continuous via a tapered surface. The boundary of the inner peripheral surface between the fourth inner peripheral surface (inner diameter portion) FF and the fifth inner peripheral surface (inner diameter portion) GG is also continuous via a tapered surface. The inner peripheral surface (inner diameter portion) FF and the tapered surface continuous to the inner peripheral surface (inner diameter portion) FF correspond to a seal entrainment prevention space 337*b* described below. The ridges of the inner peripheral surface (inner diameter portion) FF and the tapered surface correspond to the sides of the pentagonal cross section described below.

As illustrated in FIGS. 16 to 18, the pair of shutter side supports 335*a* face each other in an area closer to the rear end of the toner container 32 than the receiver securing portion 337. The pair of shutter side supports 335*a* have a shape of sections cutout in the axial direction and project from the receiver securing portion 337. Ends of the two shutter side supports 335*a* on the rear side of the toner container 32 are coupled to the shutter rear-end support 335 having a cup shape. The shutter rear-end support 335 has an oval hole in the middle of the bottom. As the two shutter side supports 335*a* face each other, the columnar space S1 is defined by the cylindrical inner faces of the shutter side supports 335*a* and a virtual cylindrical face extending therefrom. The receiver securing portion 337 has the fifth inner peripheral surface (inner diameter portion) GG from the tip as a cylindrical inner peripheral surface having an inner diameter of the same size as the diameter of the columnar space S1. The sliding portion 332*d* of the container shutter 332 slidingly moves in the columnar space S1 and on the inner peripheral surface GG. The third inner peripheral surface EE of the receiver securing portion 337 is a virtual circumferential surface passing through the longitudinal tops of the nozzle shutter contact ribs 337*a* arranged at equal intervals of 45 degrees distribution. The cylindrical (circular and tubular) container seal 333 having a quadrangular cross section (cross section of the cross-sectional views in FIGS. 16 and 17) is arranged corresponding to the inner peripheral surface EE of the inner peripheral surface. The container seal 333 is fixed to a vertical surface connecting from the third inner peripheral surface EE to the fifth inner peripheral surface FF of the inner circumferential surface with an adhesive, double-sided tape, or the like. The exposed surface on the side opposite to the attachment of the container seal 333 (right side in FIGS. 16 and 17) forms the inner bottom of the cylindrical opening of the cylindrical receiver securing portion 337 (container mouth).

As illustrated in FIGS. 16 and 17, the seal entrainment prevention space 337*b* (pinching prevention space) is formed corresponding to the inner peripheral surface FF of the receiver securing portion 337 and the tapered surface continuous to the inner peripheral surface FF. The seal entrainment prevention space 337*b* is a ring-shaped sealed space surrounded by three different members. That is, the inner peripheral surface of the receiver securing portion 337 (the fourth inner peripheral surface FF and the tapered surface continuous to the fourth inner peripheral surface FF), the vertical surface on the sticking side of the container seal 333, and a ring-shaped space surrounded by the outer peripheral surface from the cylindrical end portion 332*c* of the container shutter 332 to the sliding portion 332*d*. The cross section of this ring-shaped space (cross section in the cross sections of FIGS. 16 and 17) has a pentagonal shape. Bothe of an angle formed by the inner peripheral surface of the receiver securing portion 337 and the end face of the container seal 333 and an angle formed by the outer peripheral surface of the container shutter 332 and the end face of the container seal 333 are 90 degrees.

A function of the seal entrainment prevention space 337*b* is described below. When the container shutter 332 moves in a direction toward the rear end of the toner container 32 from the state of closing the nozzle receiving port 331, the inner peripheral surface of the container seal 333 slides on the cylindrical end portion 332*c* of the container shutter 332. Accordingly, the inner peripheral surface of the container seal 333 is pulled by the container shutter 332 and elastically deformed so as to move toward the rear end of the toner container 32.

At this time, in a case where there is no seal entrainment prevention space 337*b* and the vertical surface (the attachment surface of the container seal 333) continuous from the third inner peripheral surface EE is continuous and orthogonal to the fifth inner peripheral surface GG of the inner peripheral surface, there is a concern that the following state might be caused. That is, there is a possibility that an elastically deformed portion of the container seal 333 is sandwiched between the inner peripheral surface of the receiver securing portion 337 that slides with the container shutter 332 and the outer peripheral surface of the container shutter 332, and is caught therein. When the container seal 333 is caught in a portion where the receiver securing portion 337 and the container shutter 332 slide, that is, between the cylindrical end portion 332*c* and the inner peripheral surface GG, the container shutter 332 is locked with respect to the receiver securing portion 337, and the nozzle receiving port 331 cannot be opened or closed.

On the other hand, the nozzle receiver 330 according to the present embodiment includes a seal entrainment prevention space 337*b* in an inner peripheral portion thereof. Since the inner diameters of the seal entrainment prevention space 337*b* (the inner diameters of the inner peripheral surface EE and the tapered surface continuous thereto) are smaller than the outer diameter of the container seal 333, the entire container seal 333 does not enter the seal entrainment prevention space 337*b*. In addition, there is a limit to the region of the container seal 333 that is pulled by the container shutter 332 and elastically deformed, and the container seal returns by its own elasticity before reaching the inner peripheral surface GG and being rolled in. Such action can prevent the nozzle receiving port 331 from becoming unable to be opened and closed due to the container shutter 332 being locked with respect to the receiver securing portion 337.

As illustrated in FIGS. 16 to 18, a plurality of nozzle shutter contact ribs 337*a* are formed on the inner peripheral surface of the receiver securing portion 337 at positions adjacent to the outer periphery of the container seal 333 so as to extend radially. As illustrated in FIGS. 16 and 17, in a state in which the container seal 333 is secured to the receiver securing portion 337, a vertical surface of the container seal 333 on the container front side slightly protrudes in the rotation axis direction from a front end portion of the nozzle shutter contact rib 337*a* closer to the container front end.

As illustrated in FIG. 9, when the toner container 32 is attached to the toner supply device 60, a nozzle shutter spring 613 biases a nozzle shutter flange 612*a* of the nozzle shutter 612 of the toner supply device 60, and the nozzle shutter flange 612*a* compresses a projecting portion of the container seal 333. The nozzle shutter flange 612*a* further advances to contact the front end portion of the nozzle shutter contact rib 337*a*, and covers a front end face of the container seal 333 closer to the container front end to block the inside from the outside of the toner container 32. Thus, sealing around the conveying nozzle 611 in the nozzle receiving port 331 can be secured at the time of installation, thus preventing toner leakage.

As the rear side (opposite a nozzle-shutter-spring receiving surface 612*f* to receive the nozzle shutter spring 613) of the nozzle shutter flange 612*a* being biased by the nozzle shutter spring 613 contacts the nozzle shutter contact ribs 337*a*, the position of the nozzle shutter 612 is determined relative to the toner container 32 in the axial direction. Thus, the positions of the front end face of the container seal 333 and the front end face of a front opening 305 (see FIG. 10) relative to the nozzle shutter 612 in the axial direction are determined. The front opening 305 is a space inside the cylindrical receiver securing portion 337 disposed in the container mouth 33*a*.

Figure 19A:
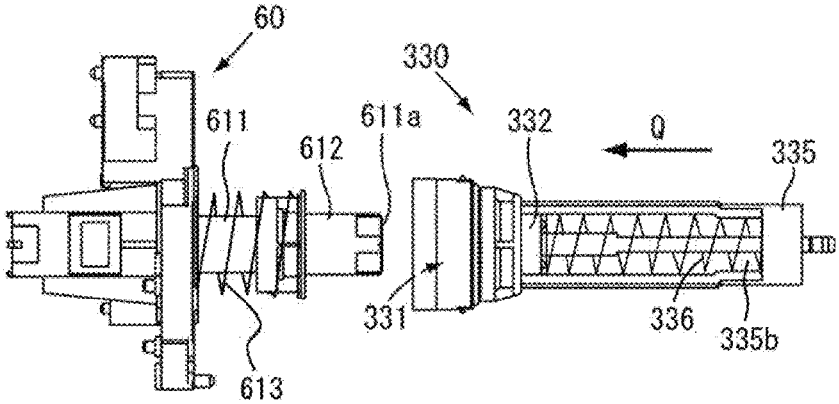
FIGS. 19A, 19B, 19C, and 19D are plan views of the toner supply device and the nozzle receiver seen from above, illustrating states of an opening-and-closing member and a conveyance tube during an attachment operation.
Figure 19B:
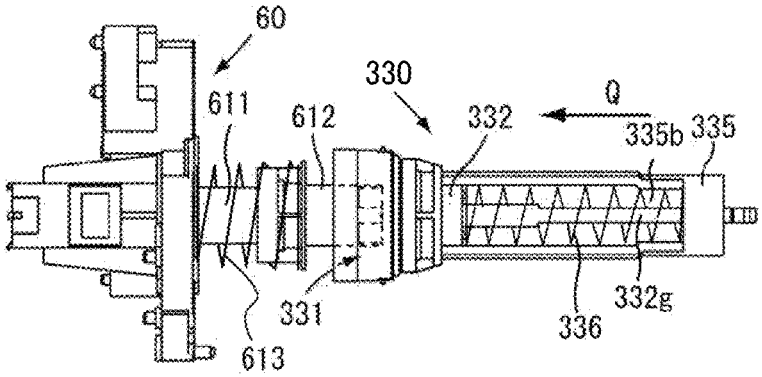
Figure 19C:
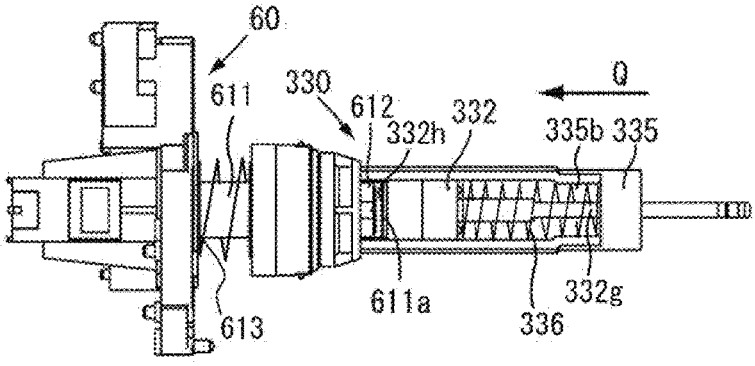
Figure 19D:
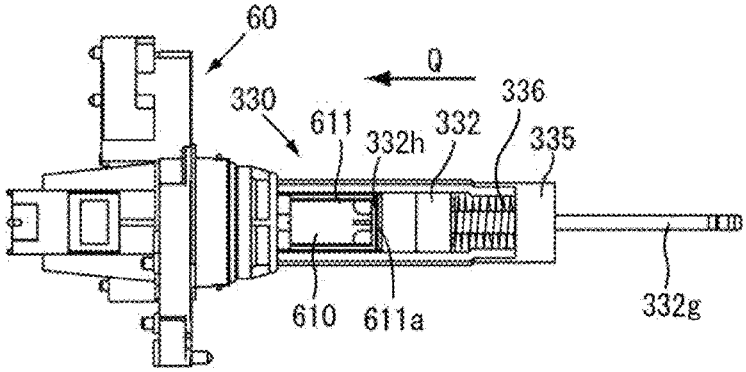

Next, operations of the container shutter 332 and the conveying nozzle 611 are described with reference to FIGS. 1, 9, and 19A to 19D. Before the toner container 32 is attached to the toner supply device 60, as illustrated in FIG. 1, the container shutter 332 is biased by the container shutter spring 336 toward a closing position where the container shutter 101 closes the nozzle receiving port 331. FIG. 19A illustrates the external appearance of the container shutter 332 and the conveying nozzle 611 in such a state. When the toner container 32 is attached to the toner supply device 60, as illustrated in FIG. 19B, the conveying nozzle 611 is inserted into the nozzle receiving port 331. When the toner container 32 is further pushed into the toner supply device 60, an end face 332*h* of the cylindrical end portion 332*c* serving as an end face of the container shutter 332 contacts a front end face 611*a* of the conveying nozzle 611 in the insertion direction. When the toner container 32 is further pushed in from this state, the container shutter 332 is pushed in as illustrated in FIG. 19C and the conveying nor/le 611 is inserted into the nozzle receiver 330 from the nozzle receiving port 331 as illustrated in FIG. 19D. Accordingly, the conveying nozzle 611 is inserted into the container body 33 and attached as illustrated in FIG. 9. At this time, as illustrated in FIG. 19D, the nozzle opening 610 communicates with the inside of the container body 33.

Thereafter, when the container body 33 rotates, the toner that has been scooped up above the conveying nozzle 611 by the scooping portion 304 falls and is introduced into the conveying nozzle 611 from the nozzle opening 610. The toner introduced into the conveying nozzle 611 is conveyed through the conveying nozzle 611 toward the downward toner conveyance passage 64 by the rotation of the conveying screw 614, and is dropped and supplied from the downward toner conveyance passage 64 to the developing device 50.

In the above-described embodiment, the toner container 32 including the container body 33 provided with the spiral rib 302 and the container front-end cover 34 rotatably attached to the container body 33 is exemplified as the powder container. However, the powder container is not limited to this configuration and may be, for example, a container body provided with a conveying member such as a screw inside the powder container.

Next, a holding mechanism of an identification (ID) tag (ID chip) 700 included in the toner container 32 is described.

Figure 21:
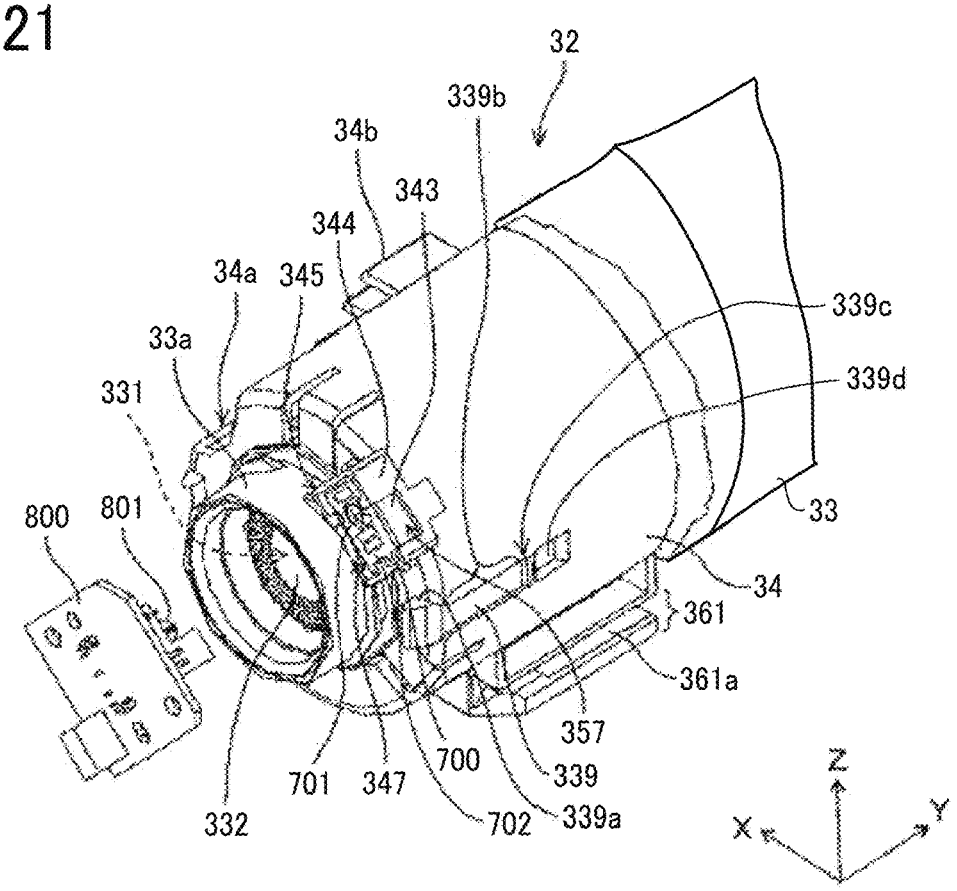
FIG. 21 is a perspective view of a connector secured to the toner supply device and a container front end of the toner container.

FIG. 21 is a perspective view of a connector 800 secured to the toner supply device 60 and the container front end of the toner container 32. As illustrated in FIG. 21, the toner container 32 includes a container body 33 and a container front-end cover 34 attached to the container body 33 so as to expose the container mouth 33*a* provided with the nozzle receiving port 331 as a toner discharge port formed in the container body 33. Further, the toner container 32 includes an ID tag 700 and an ID-tag holding mechanism 345. The ID tag 700 serves as an information storage device attached to the front end of the container front-end cover 34. The ID-tag holding mechanism 345 holds the ID tag 700.

The communication system of the ID tag 700 according to the present embodiment is a contact system. For this reason, the connector 800 is disposed at a position facing the front end face of the container front-end cover 34 on the main body side of the toner supply device 60.

Figure 22:
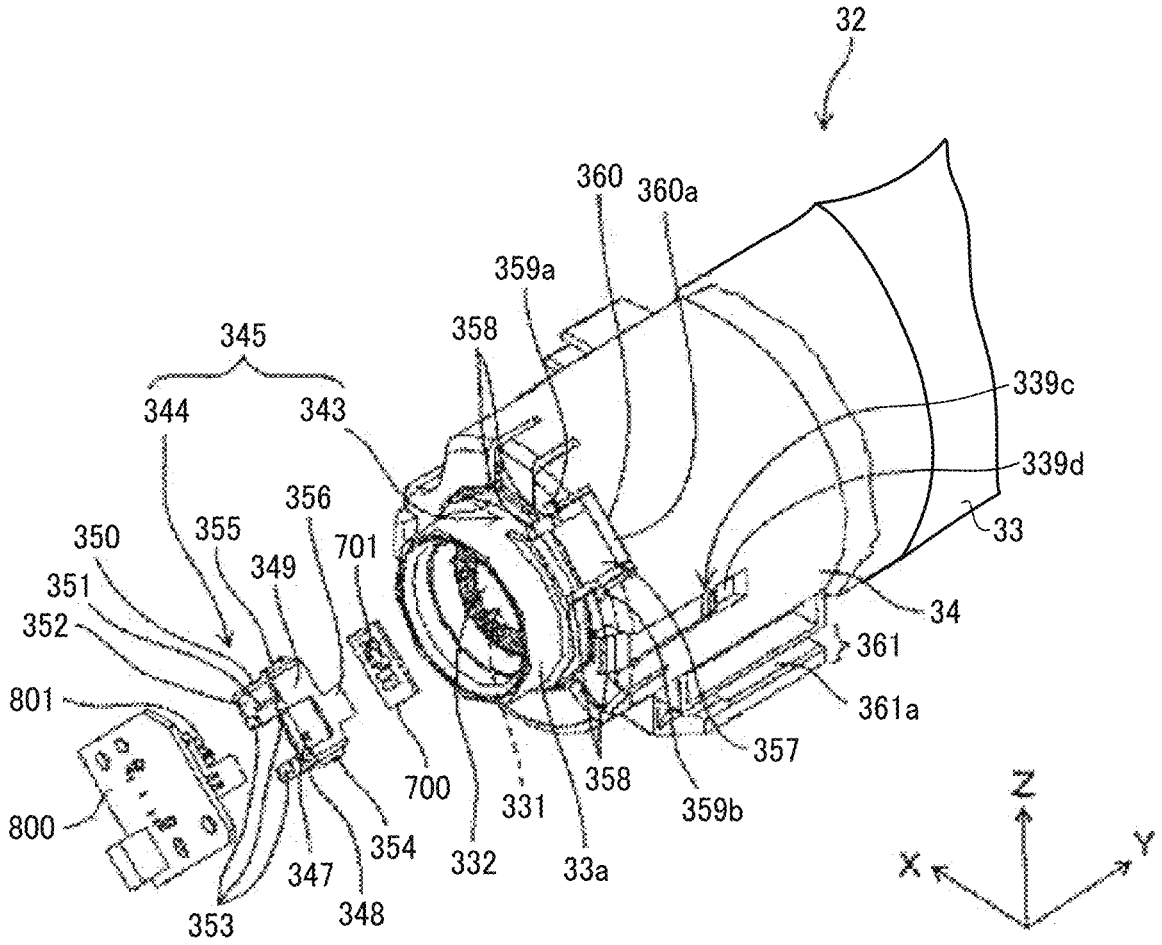
FIG. 22 is a perspective view of a front end of the toner container and the connector, illustrating a state where an identification (ID) tag holding mechanism is disassembled.

FIG. 22 is a perspective view of the front end of the toner container 32 and the connector 800, illustrating a state where the ID-tag holding mechanism 345 is disassembled. As illustrated in FIG. 22, the ID tag 700 has an ID tag hole 701 for positioning. When the toner container 32 is attached to the toner supply device 60, a positioning pin 801 of the connector 800 is inserted into the ID tag hole 701.

The ID-tag holding mechanism 345 includes a holding portion 343 and a holding member 344. The holding portion 343 has pedestals 358 that hold the ID tag 700. The holding member 344 serves as a cover that holds the ID tag 700 to be movable in the X-Z direction in FIG. 22 and is detachably fitted to the holding portion 343. The ID tag 700 and the ID-tag holding mechanism 345 are disposed in a space diagonally above the right side of the container front-end cover 34 when the toner container 32 is viewed from the container front end along the rotation axis. This is because the ID-tag holding mechanism 345 is disposed on the container front-end cover 34 by utilizing a space diagonally above the right side that is a dead space when the toner container 32 is disposed together with another toner container 32 for a different color. Such a configuration can provide a compact toner supply device in which the cylindrical toner containers 32 can be arranged close to each other. Note that the container gear 301 and the main-body-side container drive gear 601 on the main body side are disposed in a space diagonally above and to the left side of the container front-end cover 34. To prevent adjacent toner supply systems from interfering with each other, the ID tag 700, the ID-tag holding mechanism 345, and a main-body-side terminal 804 are arranged so as not to interfere with the main-body-side container drive gear 601 on the main body of the toner supply device 60.

Figure 23:
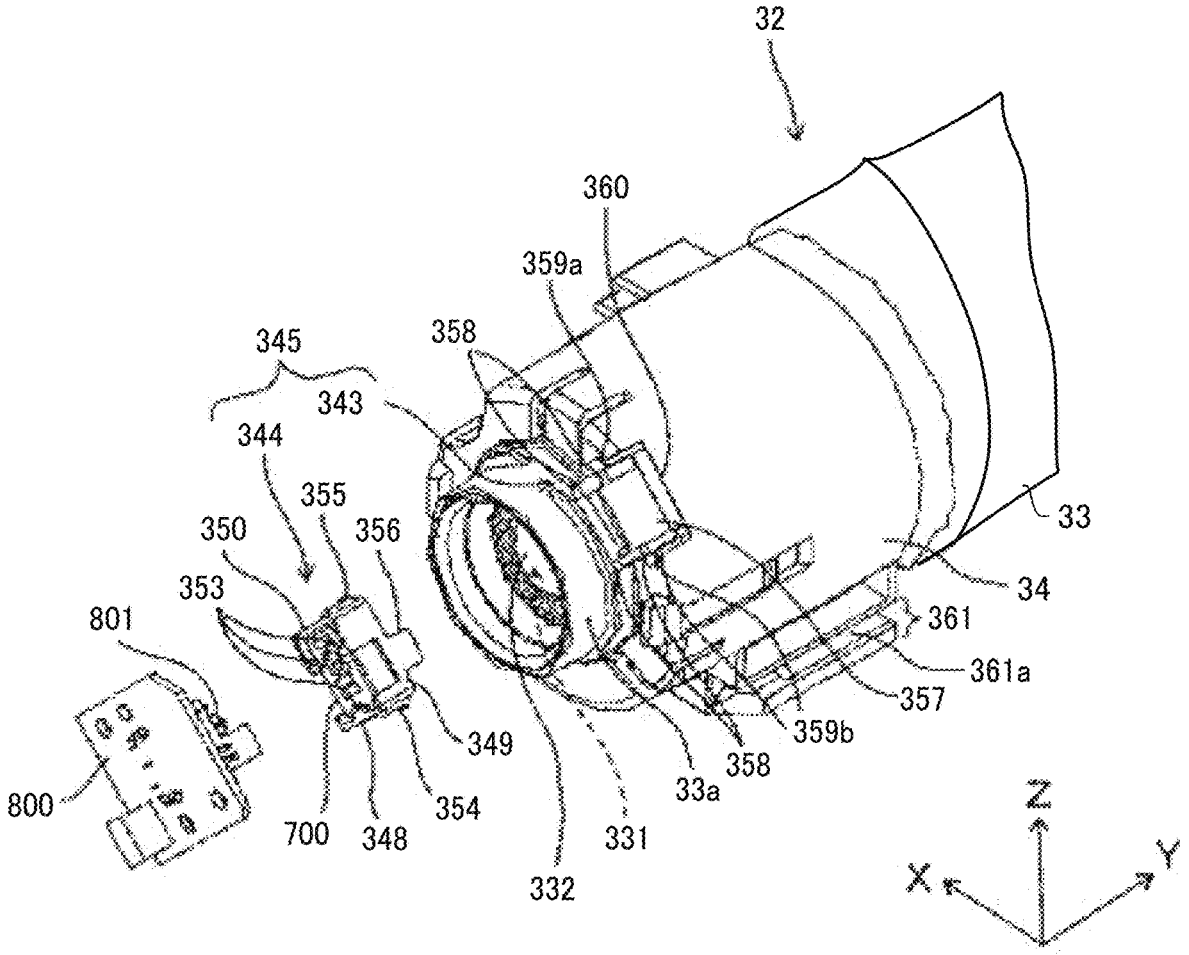
FIG. 23 is a perspective view of the front end of the toner container and the connector, illustrating a state where an ID tag is temporarily held by the ID tag holding mechanism.

FIG. 23 is a perspective view of the container front end of the toner container 32 and the connector 800 in a state where the ID tag 700 is temporarily secured to the holding member 344. As illustrated in FIG. 23, the holding portion 343 is formed on an ID-tag attachment surface 357 of the front end of the container front-end cover 34 and includes the pedestals 358 made of four rectangular columns supporting a board surface without wiring on the back side of the ID tag 7M). The holding member 344 includes a frame 352 (see FIG. 22) and a holding-member protruding portion 353. The frame 352 is a frame that is fitted to the holding portion 343 to surround the pedestals 358 from the outside and prevent the ID tag 700 from coming off. The holding-member protruding portion 353 is a portion that protrudes from the inner wall surface of the frame 352 to cover a region of the surface of the ID tag 70) where there is no terminal. The frame 352 of the holding member 344 has such a size that an ID tag having a rectangular outer shape can be housed inside the frame 352. When the ID tag 700 is set inside the frame 352, the ID tag 700 is held to be movable to some extent in the X-Z direction.

The ID-tag holding mechanism 345 is further described in more detail.

The frame 352 of the holding member 344 is formed to be longer than the length of the pedestal 358 in the Y-axis direction in FIG. 22, in other words, the height from the ID-tag attachment surface 357. Accordingly, when the ID tag 700 is installed on the pedestals 358, the ID tag 700 is not secured to the container front-end cover 34. Further, the ID tag 700 is installed in a state of having a gap from the frame 352 surrounding the outside of the ID tag 700 in the X-Z direction. In addition, since the ID tag 700 has a slight gap with respect to the holding-member protruding portion 353 of the holding member 344, the ID tag 700 is not secured to the container front-end cover 34 but is not detached therefrom. When the toner container 32 is lightly shaken, the ID tag 70) is held in the holding member 344 to such an extent that the ID tag 101 moves in a rattling manner.

When the ID tag 700 is assembled, as illustrated in FIG. 23, the ID tag 70) is hooked on an inner wall rib 351 (see FIG. 22) of the holding member 344 and is assembled to the pedestals 358 of the holding portion 343 in a temporarily secured state. At this time, the outside of the pedestals 358 including the four rectangular columns serves as a guide for the holding member 344, and the ID tag 70) having being assembled to the pedestals 358 is separated from the inner wall rib 351 and placed on the front end faces of the four pedestals 358 closer to the container front end.

Next, attachment of the holding member 344 is described in detail.

In the toner container 32 according to the present embodiment, the holding member 344 is not secured to the container front-end cover 34 by processing such as heat caulking or by fastening with a fastening member, but is secured by a fitting method using a claw member.

As illustrated in FIG. 22, the holding member 344 includes a holding-member upper claw 355, a holding-member lower claw 354, and a holding-member right-side claw 356 on a holding-member upper portion 350, a holding-member lower portion 348, and a holding-member right-side portion 349, respectively.

Around the ID-tag attachment surface 357 on the container front-end cover 34, three hook portions are formed at positions facing the three claws of the holding-member upper claw 355, the holding-member lower claw 354, and the holding-member right-side claw 356. More specifically, an attachment-surface upper hook portion 359*a* is formed at a position facing the holding-member upper claw 355 around the ID-tag attachment surface 357. Further, an attachment-surface lower hook portion 359*b* is formed at a position facing the holding-member lower claw 354 around the ID-tag attachment surface 357, and an attachment-surface lateral hook portion 360 is formed at a position facing the holding-member right-side claw 356.

When the holding member 344 is set on the container front-end cover 34, the three claws 355, 354, and 356 of the holding member 344 are engaged with and secured to the three hook portions 359*a*, 359*b*, and 360 on the container front-end cover 34. With respect to the three hooking portions, two portions of the attachment-surface upper hook portion 359*a* and the attachment-surface lower hook portion 359*b* have a hole shape, and one portion of the attachment-surface lateral hook portion 360 has a claw shape.

The holding-member upper claw 355 and the holding-member lower claw 354 are set to the attachment-surface upper hook portion 359*a* and the attachment-surface lower hook portion 359*b* having the hole shape by utilizing the inclination of the tips of the two claws of the holding-member upper claw 355 and the holding-member lower claw 354 and the elasticity of the claws. In addition, the holding-member right-side claw 356 is set to the attachment-surface lateral hook portion 360 having the claw shape by utilizing the inclination of the tip of the holding-member right-side claw 356 and an inclined surface 360*a* of the attachment-surface lateral hook portion 360.

In such a configuration, as illustrated in FIG. 23, the ID tag 700 is temporarily set inside the frame 352 of the holding member 344, and the holding member 344 is moved along the pedestals 358 on the container front-end cover 34. Accordingly, the claws 355, 354, and 356 formed on the holding member 344 are engaged with the hook portions 359*a*, 359*b*, and 360 formed on the container front-end cover 34. The holding member 344 can be secured to the container front-end cover 34 by engagement of the claws 355, 354, and 356 and the hook portions 359*a*, 359*b*, and 360.

In the example described with reference to FIGS. 21 to 23, the two upper and lower points and the one right point of the holding member 344 are the fitting points of the claws 355, 354, and 356 and the hook portions 359*a*, 359*b*, and 360. The fitting points of the holding member 344 are not limited to the combination of the upper and lower sides and the right side, and may be only the upper and lower sides, only the left and right sides, or the upper, lower, left, and right sides of the holding member 344. The fitting points and the number thereof are not limited to those in the present embodiment.

As described above, in the present embodiment, a fitting method using claw members has been described. However, depending on the case, the holding member 344 can be secured to the container front-end cover 34 by processing such as thermal caulking or by fastening using a fastening member. Further, there may be a case where it is desired to more firmly attach the holding member 344 of the ID tag or a case where there is a jig that can be rewritten without being detached from the container front-end cover 34 when the ID tag is recycled.

Next, the ID tag 700 as an information storage device included in the toner container 32 according to the present embodiment is described with reference to FIGS. 24A, 24B. 24C, 25, 26, 27A, 27B, 28A, and 28B.

In the following description, a "substantially rectangular metal plate" is defined to include not only a rectangular metal plate but also a substantially rectangular metal plate. Therefore, the "substantially rectangular metal plate" also includes a rectangular metal plate having all or part of its corners chamfered or rounded.

Figure 24A:
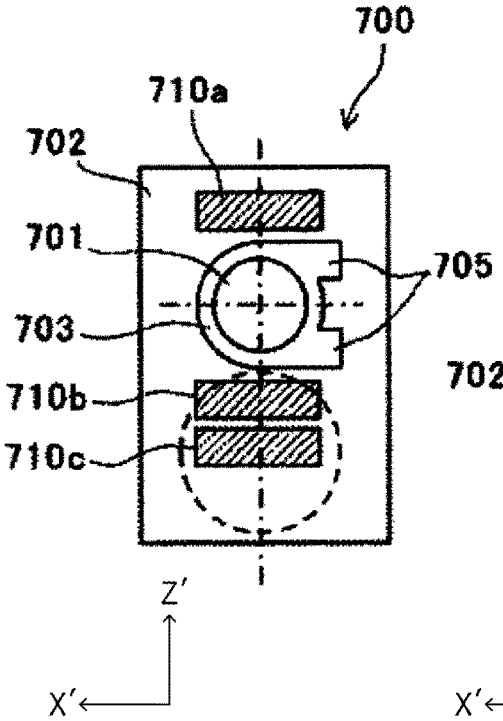
FIGS. 24A, 24B, and 24C are three views, that is, a front view, a side view, and a back view of the ID tag.
Figure 24B:
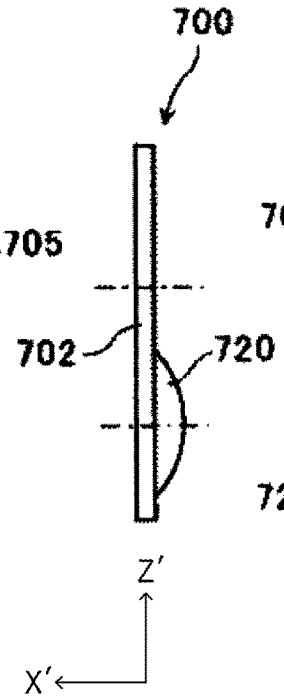
Figure 24C:
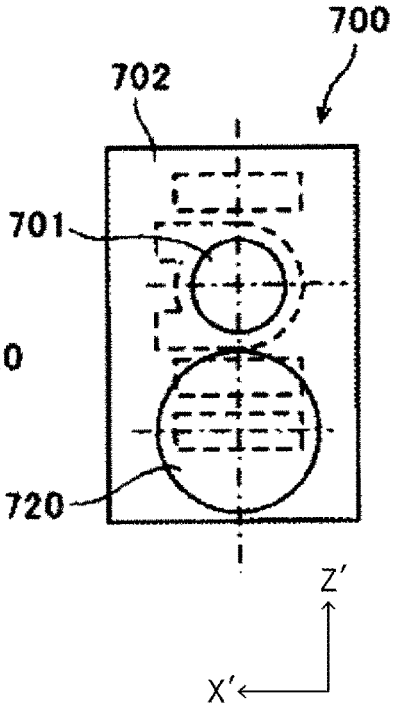

FIGS. 24A, 24B, and 24C are three view diagrams of the ID tag 700. FIG. 24A is a front view of the ID tag 700 viewed from the connector 800 side. FIG. 24B is a side view of the ID tag 700 viewed from a direction orthogonal to the attachment direction (in other words, an obliquely upper right direction in FIG. 21). FIG. 24C is a rear view of the ID tag 700 viewed from the side on which the container front-end cover 34 is disposed.

Figure 25:
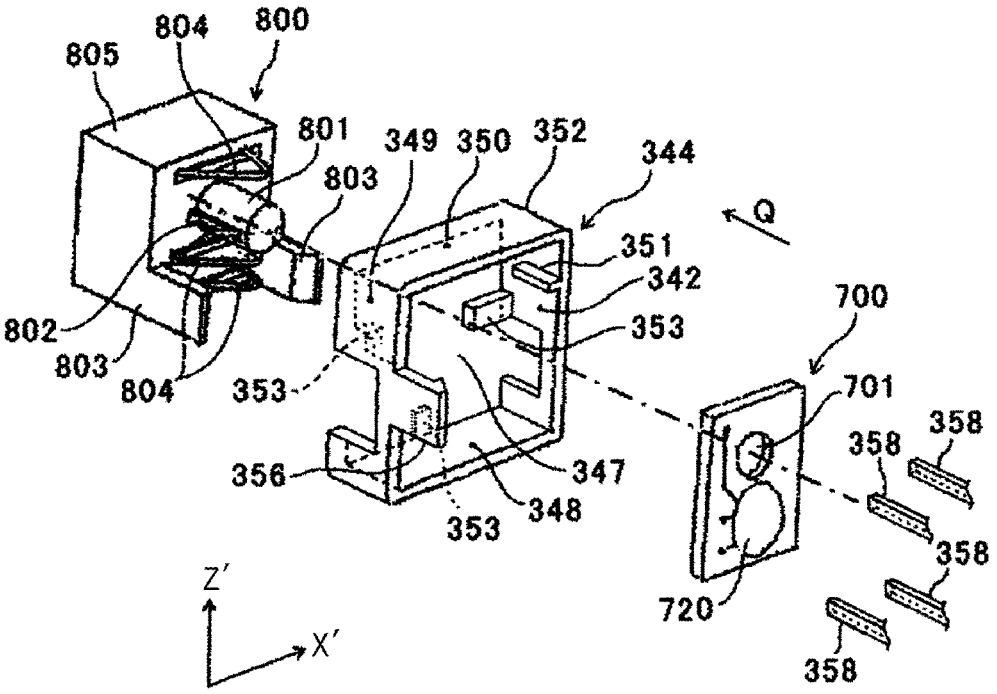
FIG. 25 is a perspective view of the ID tag, a holding member, and the connector, illustrating relative positions thereof.

FIG. 25 is a perspective view of the ID tag 700, the holding member 344, and the connector 800, illustrating relative positions of the ID tag 700, the holding member 344, and the connector 800. In FIG. 25, the holding-member upper claw 355 and the holding-member lower claw 354 illustrated in FIGS. 22 and 23 are omitted for simplicity.

Figure 26:
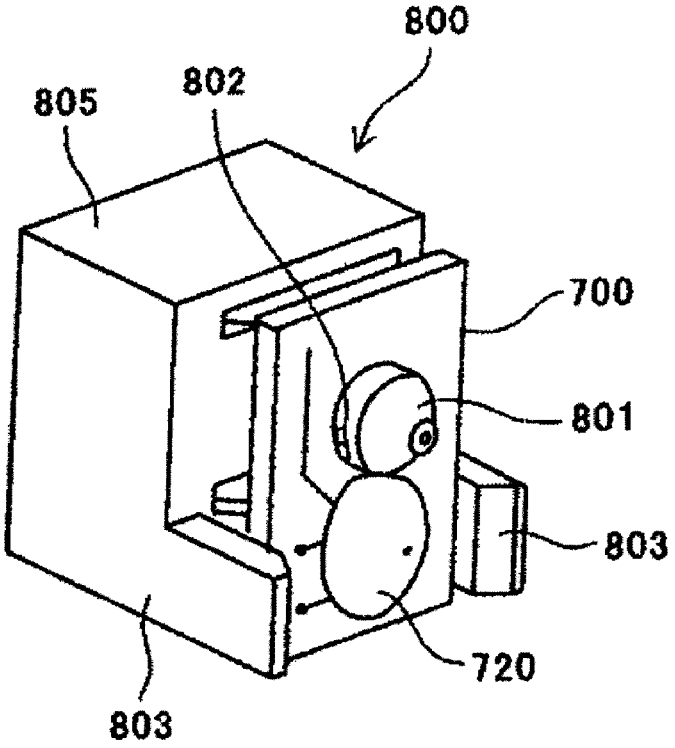
FIG. 26 is a perspective view of the ID tag engaged with the connector.
Figure 27A:
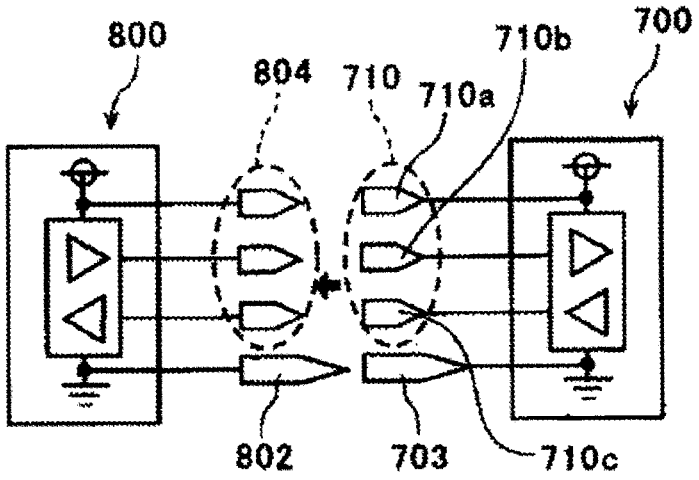
FIGS. 27A and 27B are circuit diagrams illustrating examples of an electric circuit of the ID tag and an electric circuit of the connector.
Figure 27B:
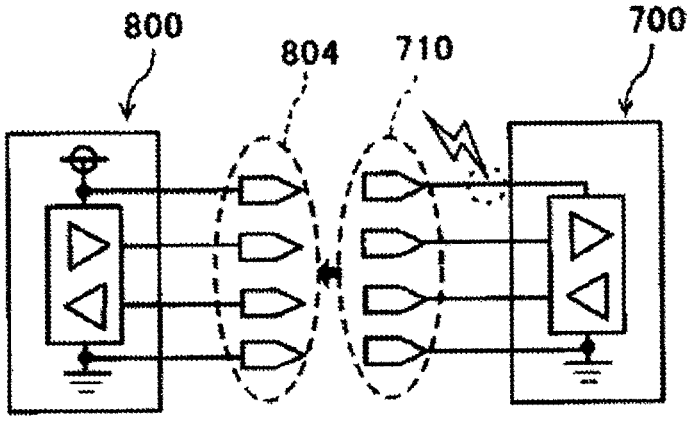

FIG. 26 is a perspective view of the ID tag 700 engaged with the connector 800. FIGS. 27A and 27B are circuit diagrams of an electric circuit of the ID tag 700 and an electric circuit of the connector 800.

Figure 28A:
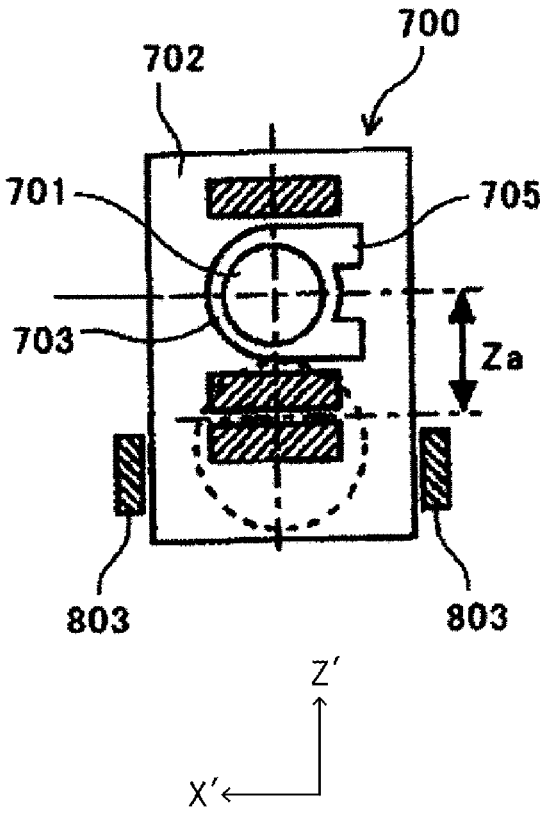
FIG. 28A is a front view of the ID tag held by the connector.
Figure 28B:
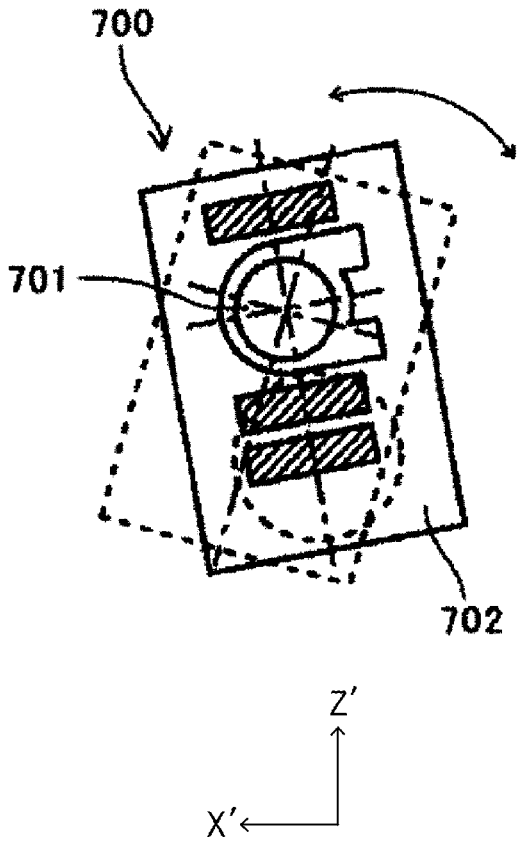
FIG. 28B is a front view of the ID tag rotated around an ID tag hole for positioning.

FIG. 28A is a front view of the ID tag 700 held by the connector 800. FIG. 28B is a front view of the ID tag 700 rotating around the ID tag hole 701 for positioning.

In the ID tag 700 according to the present embodiment, only one ID tag hole 701 is formed in the board 702. The ID tag hole 701 is disposed between a plurality of metal pads 710*a*, 710*b*, and 710*c*, which are also collectively referred to as metal pads 710, formed of rectangular metallic plates.

As illustrated in FIG. 21, the toner container 32 according to the present embodiment is arranged such that the long side of the rectangular ID tag 700 is not parallel to the vertical direction but is inclined. For this reason, in the state in which the ID tag 700 is disposed in the toner container 32, the longitudinal direction of the ID tag 700 does not coincide with the vertical direction. However, in the following description, for convenience, a direction parallel to the long side of the ID tag 700 (i.e., the Z'-axis direction in FIGS. 24A, 24B, and 24C) is referred to as a chip vertical direction, and a direction parallel to the short side of the ID tag 700 (the X'-axis direction in FIGS. 24A, 24B, and 24C) is referred to as a chip horizontal direction. The same applies to the connector 800 disposed obliquely with respect to the toner supply device 60.

As illustrated in FIG. 24A, the ID tag 700 as an information storage device according to the present embodiment has the ID tag hole 701 at a position vertically above the center of gravity of the board 702 in the chip vertical direction. A ground terminal 703 for grounding (earth) made of a metal terminal is disposed on an inner diameter portion and a periphery of the ID tag hole 701. As illustrated in FIG. 24A, the ground terminal 703 on the surface of the board 702 according to the present embodiment is formed such that two ground-terminal protruding portions 705 extend in the chip vertical direction with respect to an annular portion of the ground terminal 703.

One rectangular metal pad 710, that is, a first metal pad 710*a* in FIG. 24A is disposed at a position above the ID tag hole 701 in the chip vertical direction. Two metal pads 710, that is, a second metal pad 710*b* and a third metal pad 710*c* inf FIG. 24A are also disposed at positions below the ID tag hole 701 in the chip vertical direction.

As illustrated in FIG. 24*c*, a protective member 720 made of a resin material such as epoxy in a hemispherical shape is disposed on the back surface of the board 702 to cover and protect an information storage unit. Since the protective member 720 includes an information storage unit such as an integrated circuit (IC) therein, the protective member 720 is a component having the largest size and weight and is disposed on the back surface of the ID tag 700. The ID tag hole 701 is disposed above the protective member 720 in the chip vertical direction.

Thus, as described above, the positional relationship is obtained in which the ID tag hole 701 is located vertically above the center of gravity of the ID tag 700 in the chip vertical direction. The arrangement of the ID tag hole 701 depends on, for example, the shape of the board 702 and the configuration and arrangement of the back surface of the protective member 720.

Specifically, as illustrated in FIG. 28A, the ID tag 700 according to the present embodiment is formed such that the center position of the ID tag hole 701 is located above the center of gravity of the ID tag 700 by a distance Za in the chip vertical direction.

As illustrated in FIG. 25, the connector 800 has a connector body 805 that is a hollow box made of resin. A positioning pin 801 serving as a positioning protrusion is disposed on the connector body 805 to stand in the horizontal direction. The positioning pin 801 is one hollow cylinder and has a tapered shape at its tip. The positioning pin 801 is provided with a grounding main-body-side terminal 802. The grounding main-body-side terminal 802 is a platy (or linear) metal member. A part of the grounding main-body-side terminal 802 is housed in a hollow portion of the positioning pin 801 molded with the connector body 805 as a single component. A curved portion of the grounding main-body-side terminal 802 is exposed from a slit-shaped opening formed in a part of the peripheral surface of the hollow cylinder and protrudes from the outer peripheral surface of the hollow cylinder of the positioning pin 801. One main-body-side terminal 804 is disposed at a position vertically above the positioning pin 801 (or the grounding main-body-side terminal 802) in the chip vertical direction. Two main-body-side terminals 804 are disposed at positions vertically below the positioning pin 801 in the chip vertical direction. The main-body-side terminals 804 are platy (or linear) metal members.

In addition, a pair of ribs are formed below the connector body 805 at positions on both sides of the positioning pin 801 in the chip horizontal direction. The ribs are disposed such that tapered surfaces on inner sides of tips of the ribs are line-symmetrical to each other. Further, vibration preventing members 803 serving as a pair of regulating members are disposed on lateral end surfaces of the ID tag 700 at positions below the center of the ID tag hole 701 in the chip vertical direction.

The holding member 344 is secured to the container front-end cover 34 of the toner container 32 and is positioned between the connector 800 and the ID tag 700 in the state where the toner container 32 is attached to the toner supply device 60. The holding member 344 holds the ID tag 70) to be movable (with a certain degree of looseness).

As illustrated in FIG. 25, the holding member 344 includes a holding-member protruding portion 353 on each of the holding-member lower portion 348, the holding member left side surface portion 342, and the holding member right side surface portion 349. The three holding-member protruding portions 353, which are disposed on the holding-member lower portion 348, the holding member left side portion 342, and the holding-member right-side portion 349, prevent the ID tag 70) from falling off from the holding member 344 toward the connector 800.

Further, a holding-member opening portion 347 is formed in an end portion (a wall surface including the holding-member protruding portions 353) of the holding member 344 closer to the connector 800. The holding-member opening portion 347 has a shape in which most of the end portion of the holding member 344 closer to the connector 800, which includes a region facing four terminals (i.e., the three main-body-side terminals 804 and the one grounding main-body-side terminal 802) on the connector 800, is open. The holding-member opening portion 347 of the holding member 344 has a shape opened to portions corresponding to the vibration preventing members 803 of the connector 800. When the toner container 32 is attached, the positioning pin 801 passes through the opening position of the holding-member opening portion 347, and then the vibration preventing members 803 also pass through the opening position of the holding-member opening portion 347 and enters the holding member 344.

The four pedestals 358 facing the back side (having the protective member 720) of the ID tag 700 are parts of the container front-end cover 34, and are members extending from the holding portion 343 toward the connector 800. The four pedestals 358 are configured to press the vicinities of the four corners of the rectangular board 702, and have a shape capable of avoiding interference with the protective member 720 secured to the ID tag 700 and the vibration preventing member 803 entering at the time of connection with the connector 800.

On the other hand, when the positioning pin 801 is inserted into the ID tag hole 701 of the ID tag 700, the ID tag 700 is pushed toward the rear end of the toner container 32 by the grounding main-body-side terminal 802 and the main-body-side terminals 804 of the positioning pin 801. At this time, since the four pedestals 358 support the back surface of the board 702, the contact state between the terminals can be maintained.

FIG. 26 is a schematic perspective view of the connector 800 and the ID tag 700 in a state in which positioning of the connector 800 and the ID tag 700 on the toner supply device 60 side is completed in a state in which the toner container 32 is attached to the toner supply device 60 (the main body of the copier 500). The state illustrated in FIG. 26 is a state in which the terminals on the main body side (i.e., the main-body-side terminal 804 and the grounding main-body-side terminal 802) are connected to the terminals on the ID tag 700 side (i.e., the metal pads 710 and the ground terminal 703). In FIG. 26, the holding member 344 and the three metal pads 710 between the connector 800 and the ID tag 700 are omitted for ease of understanding.

In the toner container 32 according to the present embodiment, the container mouth 33*a* protrudes beyond the container front-end cover 34. When the toner container 32 in the non-attached state is to be moved in the direction of arrow Q in FIG. 20 or 25 and attached to the toner supply device 60, first, the outer peripheral surface of the container mouth 33*a* and the container setting portion 615 are fitted to each other. Thus, the position of the toner container 32 with respect to the toner supply device 60 in the direction orthogonal to the rotation axis direction is determined. Thereafter, the toner container 32 is further moved in the direction indicated by arrow Q in FIG. 20 or 25. Accordingly, the connection between the ID tag 70) and the connector 800 is started.

After the toner container 32 is positioned in the direction orthogonal to the rotation axis direction and the position of the container front-end cover 34 in the direction orthogonal to the rotation axis direction is determined, the ID tag 700 is positioned in the direction orthogonal to the rotation axis direction. Specifically, after the position of the container front-end cover 34 in the direction orthogonal to the rotation axis direction is determined, the ID tag hole 701 of the ID tag 700 is fitted to the positioning pin 801 of the connector 800 so as to be caught by the taper of the distal end of the positioning pin 801. This fitting determines the positions of the ID tag 700 in the chip vertical direction and the chip horizontal direction at the same time. That is, the ID tag 700 is positioned in the directions orthogonal to the rotation axis direction.

Further, as illustrated in FIG. 28A, the vibration preventing members 803 of the connector 800 enter lower edge portions that are located on both left and right sides of the board 702 in the chip horizontal direction and are located below the center of the ID tag hole 701 in the chip vertical direction. At this time, even if the posture of the ID tag 700 is shifted as illustrated in FIG. 28B, the tapered surface of the distal end of one of the rib-shaped vibration preventing members 803 contacts one of the lower edge portions. Accordingly, a lower portion than the ID tag hole 701 rotates toward the side opposite to the tapered surface having contacted the lower edge portion. Then, the rotation of the ID tag 700 stops at the position where the lower edge portions uniformly contact the two tapered surfaces. Thus, the deviation of the posture of the ID tag 700 in the direction of rotation, which is rotation in the directions of the double-headed arrow illustrated in FIG. 28B, is corrected (the state illustrated in FIG. 28A). Thus, the positioning of the ID tag 700 is completed.

At this time, a part of the ground terminal 703 of the ID tag 700, which is a part corresponding to the inner diameter portion of the ID tag hole 701, contacts the grounding main-body-side terminal 802 of the positioning pin 801 illustrated in FIG. 26, and the ID tag 700 is grounded (electrically connected). Further, after the grounding is performed, as illustrated in FIG. 27A, the three metal pads 710 (i.e., the metal pads 710*a*, 710*b*, and 710*c*) of the ID tag 700 also contact the three main-body-side terminals 804, respectively, of the connector 800. Thus, information can be transmitted between the ID tag 700 and a controller (e.g., a controller 90 of the copier 500) on the toner supply device 60 including the connector 800.

First Embodiment

Figure 29:
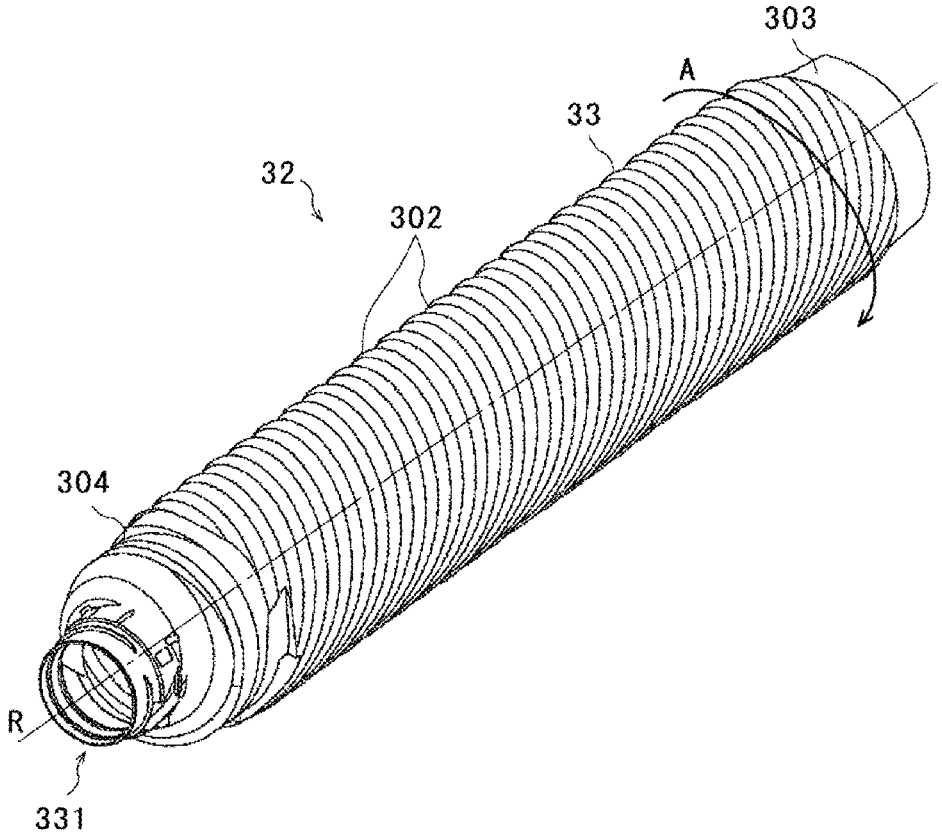
FIG. 29 is an external perspective view of a toner container according to Example 1.

Next, a toner container 32 according to Example 1 of the present disclosure is described with reference to FIGS. 29 to 33. FIG. 29 is an external perspective view of the toner container 32 according to Example 1 schematically illustrated in FIGS. 1, 6, and the like in an exaggerated manner.

The toner container 32 according to Example 1 illustrated in FIG. 29 is characterized in that the configuration of the container body 33 illustrated in FIGS. 1, 6, and the like is more clarified. The configurations of the scooping portion 304, the nozzle receiving port 331, the grip portion 303, and the like are the same as those of the embodiment illustrated in FIGS. 1 to 28 (the same applies to each example described below). Therefore, in Example 1 and so on described below, a specific configuration of the container body 33 is mainly described.

As illustrated in FIG. 29, when the container body 33 rotates in the direction indicated by arrow A, a conveying force from one end (container rear end) to the other end (container front end) in the longitudinal direction of the rotation axis R is applied to the toner stored in the container body 33 by the action of the spiral rib 302.

Figure 30:
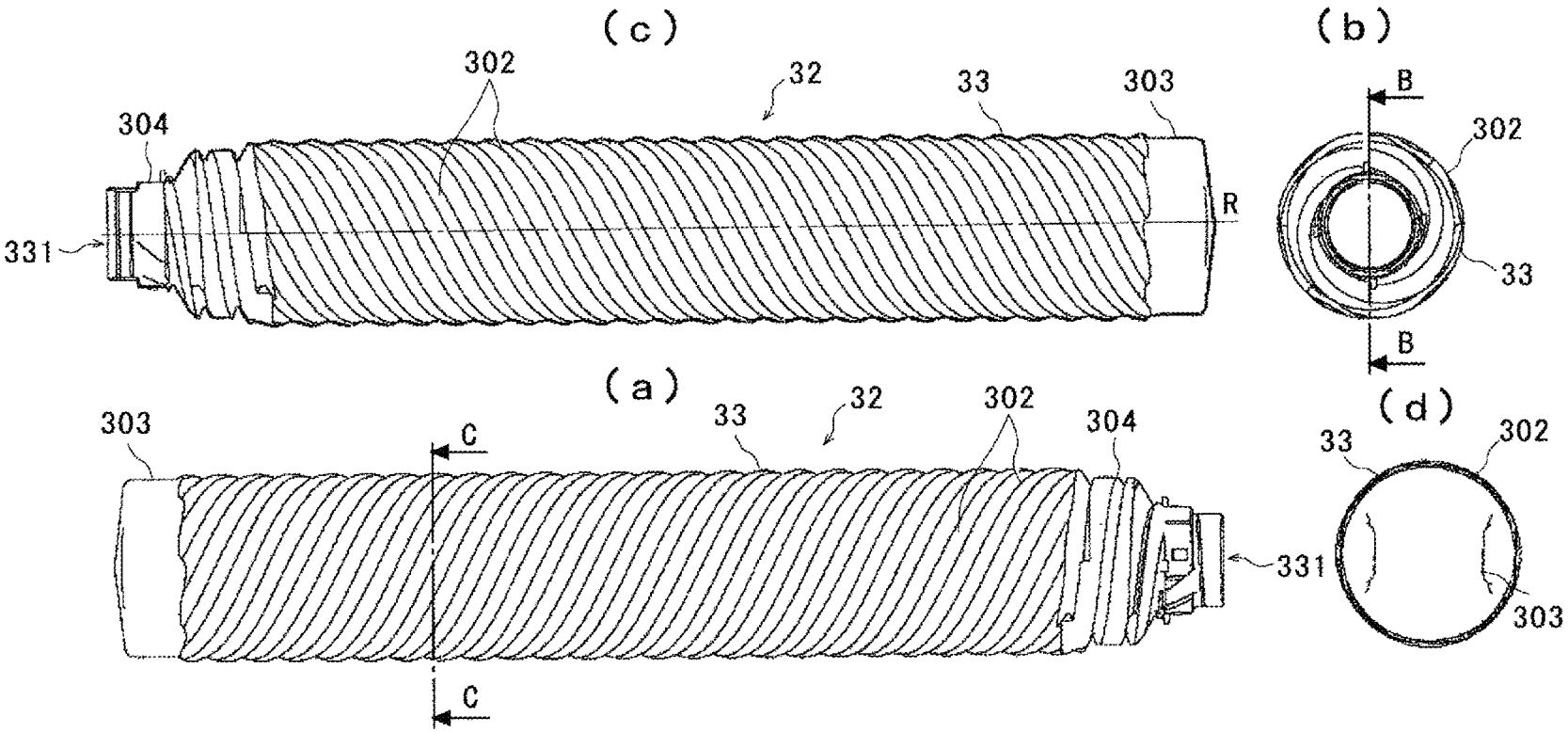
FIG. 30 includes part (a) that is a side view of the toner container of FIG. 29, part (b) that is a front view of the toner container illustrated in part (a), part (c) that is a cross-sectional view of the toner container taken along line B-B of part (b), and part (d) that is a cross-sectional view of the toner container taken along line C-C of part (a)
Figure 31A:
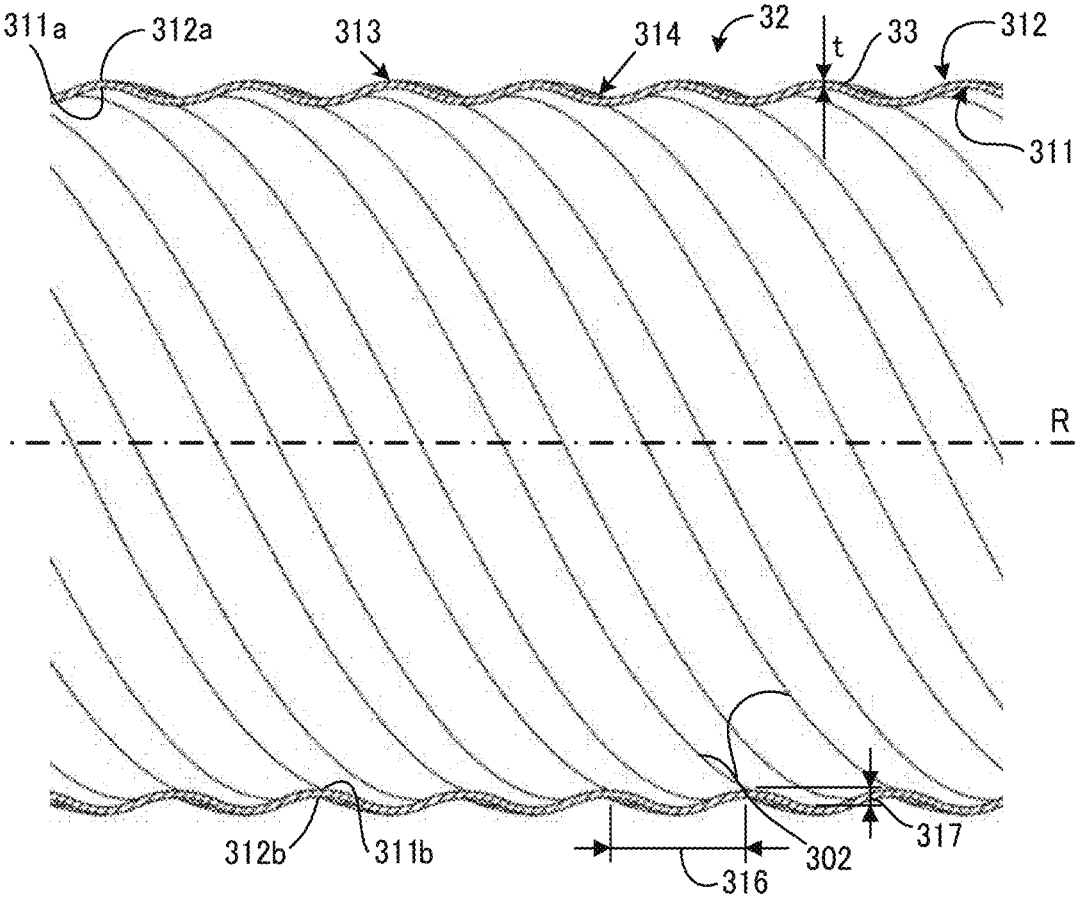
FIG. 31A is an enlarged cross-sectional view of a main part of the container body illustrated in part (c) of FIG. 30.
Figure 31B:
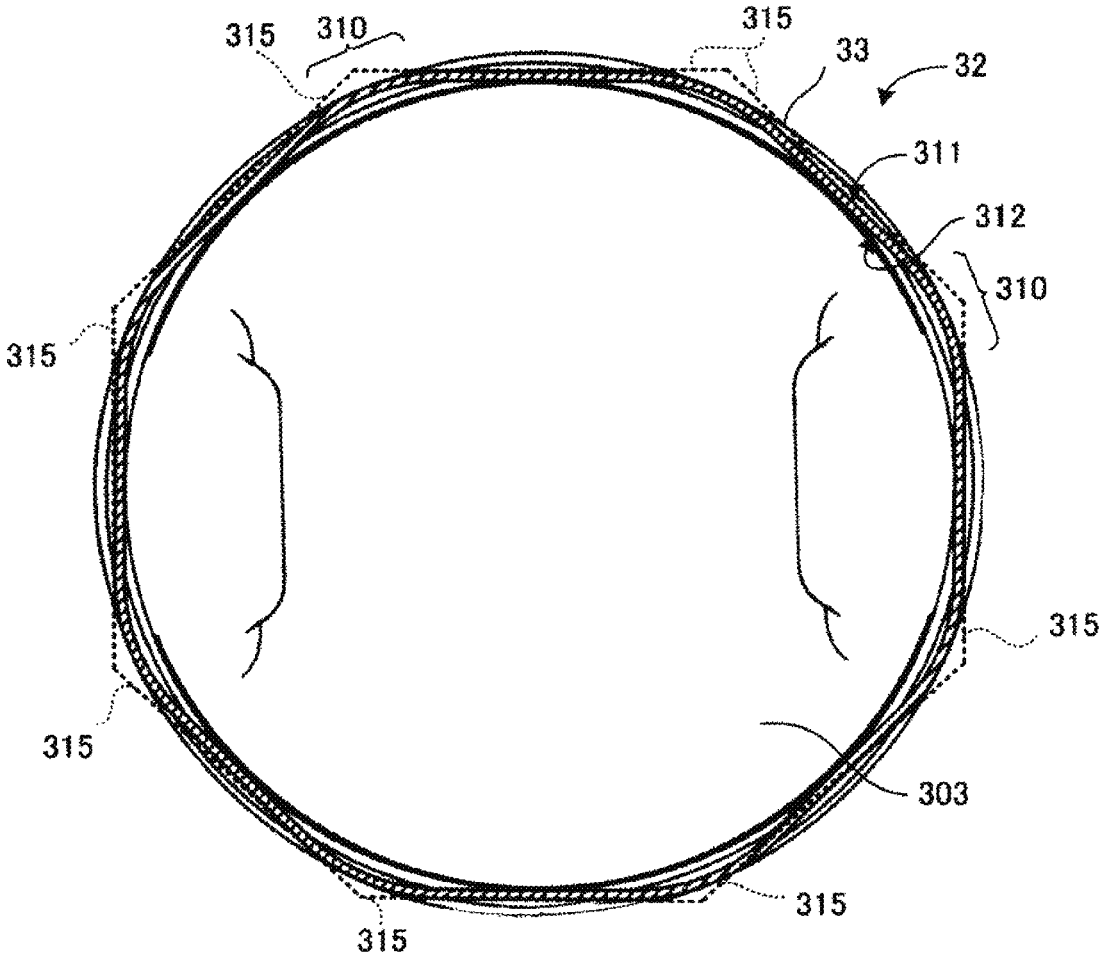
FIG. 31B is an enlarged cross-sectional view of the container body illustrated in part (d) of FIG. 30.
Figure 32B:
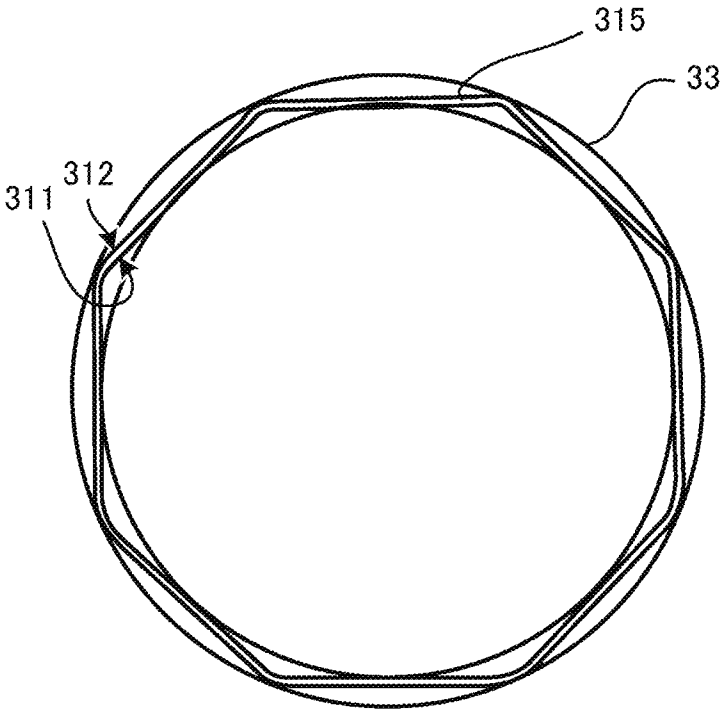
FIG. 32B is a schematic cross-sectional view of the container body, illustrating that the cross-sectional shape of the container body at a position slightly shifted from the predetermined position in FIG. 32A in the rotation axis direction is a shape obtained by rotating a substantially octagonal shape around the rotation axis R.
Figure 32A:
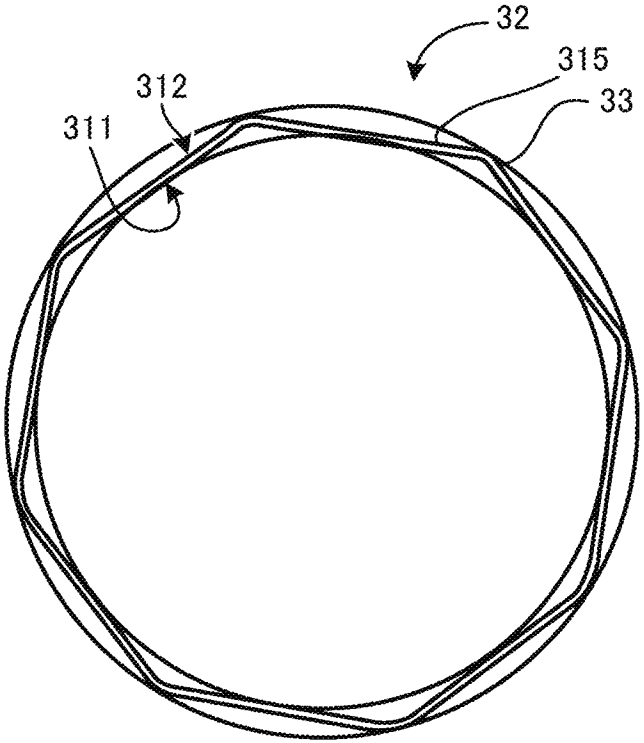
FIG. 32A is a cross-sectional view of the container body, schematically illustrating a cross-sectional shape of the container body in a direction orthogonal to the rotation axis direction at a predetermined position of the toner container of FIG. 29.
Figure 33:
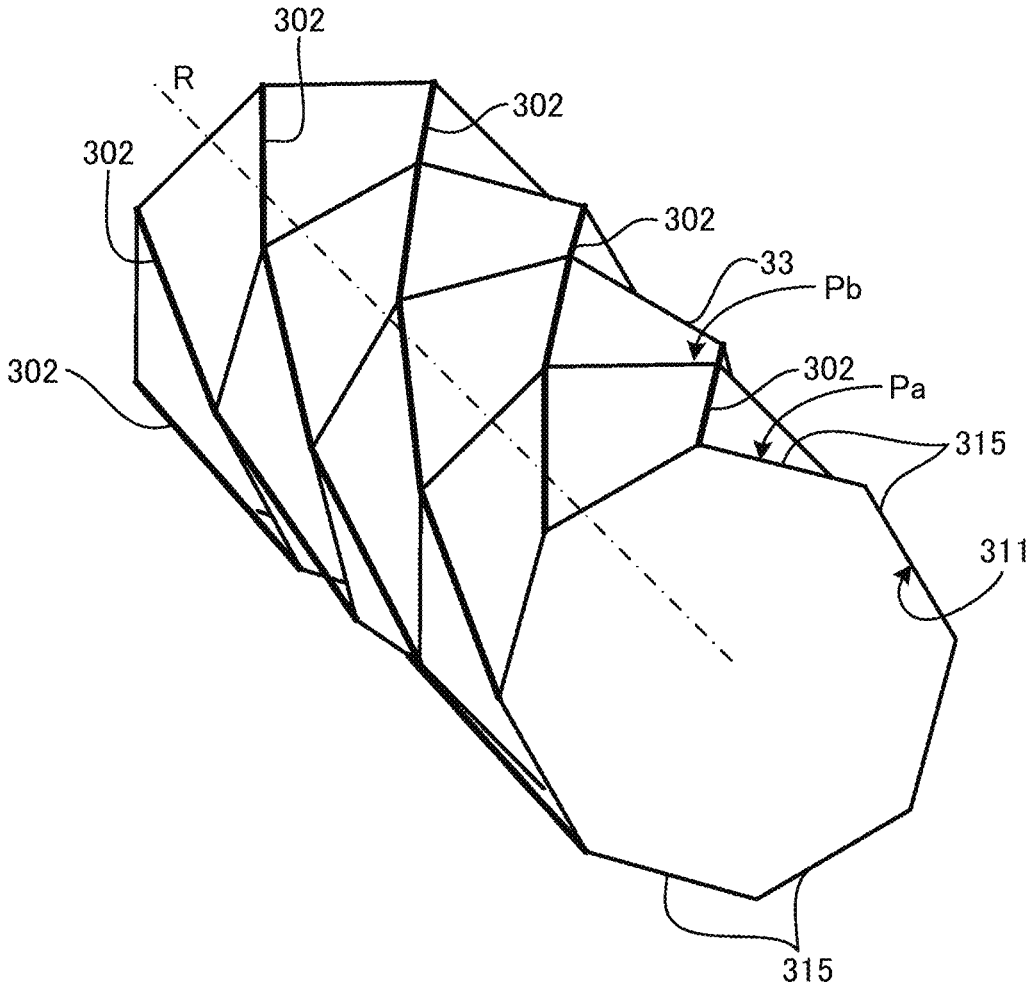
FIG. 33 is a schematic diagram illustrating how the substantially octagonal cross-sectional shape of the toner container of Example 1 changes from the state of position angle of FIG. 32A to the state of position angle of FIG. 32B.

Part (a) of FIG. 30 is a side view of the toner container 32 of FIG. 29. Part (b) of FIG. 30 is a front view of the container body 33 viewed from the nozzle receiving port 331 of the toner container 32 illustrated in part (a) of FIG. 30. Part (c) of FIG. 30 is across-sectional view of the container body 33 taken along line B-B of part (b) of FIG. 30. Part (d) of FIG. 30 is a cross-sectional view of the container body 33 taken along line C-C at a predetermined position of part (a) of FIG. 30. FIG. 31A is an enlarged cross-sectional view of a main part of the container body 33 illustrated in part (c) of FIG. 30. FIG. 31B is an enlarged cross-sectional view of the container body 33 illustrated in part (d) of FIG. 30. FIG. 32A is a cross-sectional view of the container body 33, schematically illustrating a cross-sectional shape of the container body 33 in a direction orthogonal to the rotation axis direction at a predetermined position of the toner container 32 of FIG. 29. FIG. 32B is a schematic cross-sectional view of the container body 33, illustrating that the cross-sectional shape of the container body 33 at a position slightly shifted from the predetermined position in FIG. 32A in the rotation axis direction is a shape obtained by rotating a substantially octagonal shape around the rotation axis R. FIG. 33 is a schematic diagram illustrating how the substantially octagonal cross-sectional shape of the toner container 32 of FIG. 29 changes from the state of the position angle of FIG. 32A to the state of the position angle of FIG. 32B.

As illustrated in part (b) of FIG. 30, the toner container 32 according to Example 1 has a substantially circular outer shape when viewed from the rotation axis direction. Broken lines (dotted lines) in FIG. 31B indicate sides 315 of the substantially octagonal shape.

In the toner container 32 according to Example 1, as illustrated in FIG. 31B, a cross-sectional shape of an inner peripheral surface 311 (or an outer peripheral surface 312) in a direction orthogonal to the rotation axis direction at a predetermined position is a substantially octagonal shape in which corners 310 are rounded among substantially polygonal shapes according to embodiments of the present disclosure. A corner 310 is a cross-sectional shape in the vicinity of an apex portion connecting two sides 315 of the substantially octagonal shape, and the corner 310 is rounded.

In the toner container 32 according to Example 1, the number of threads of the spiral rib 302 as the spiral shape is eight while the number of threads of the spiral shape according to embodiments of the present disclosure is three or more. Further, the number of sides of the substantially polygonal shape according to embodiments of the present disclosure is eight corresponding to the substantially octagonal shape.

As illustrated in FIG. 31A, in the toner container 32 according to Example 1, a cross section of the inner peripheral surface 311 (or the outer peripheral surface 312) passing through the rotational axis R in a direction parallel to the longitudinal direction of the rotational axis R forms a convex portion having a relatively large round shape as a corner R313 and forms a concave portion having a relatively large round shape as a corner R314. In other words, the round shape as the corner R313 forms a relatively large convex portion, and the round shape as the corner R314 has a relatively large concave portion. Thus, as illustrated in FIG. 31B, the cross-sectional shape in the direction orthogonal to the rotation axis direction at a predetermined position forms a substantially octagonal shape with the rounded corners 310.

As illustrated in FIGS. 30C, 31A, and 31B, the toner container 32 according to Example 1 includes the container body 33 having the outer peripheral surface 312 facing the inner peripheral surface 311 of the container body 33 with a substantially constant wall thickness t from the inner peripheral surface 311. The substantially constant wall thickness t is also the same in a forming portion (hereinafter, also referred to as a "spiral-shaped portion") of the spiral rib 302 formed to have a shape specific to the inner peripheral surface 311 and the outer peripheral surface 312. Here, the substantially constant wall thickness includes a constant wall thickness and also includes an allowable tolerance in design and manufacturing within a range in which an effect described below is obtained (the same applies to each example described below).

The wall thickness t is preferably 0.5 mm or more and 3.0 mm or less and more preferably 0.8 mm or more and 2.0 mm or less from the viewpoint of obtaining an effect of reducing deflection of the container body 33 even when the toner container 32 including the spiral-shaped portion is thinned (the same applies to each example described below).

Hereinafter, the container body 33 of the toner container 32 according to Example 1 (hereinafter, also simply referred to as "container body 33 according to Example t") includes the inner peripheral surface 311 and the outer peripheral surface 312 facing each other with the substantially constant wall thickness t therebetween as described above. Therefore, the inner peripheral surface 311 and the outer peripheral surface 312 have similar shapes with the substantially constant wall thickness t therebetween. Therefore, hereinafter, the inner peripheral surface 311 is described as a representative (the same applies to each example described below).

In the container body 33 according to Example 1, as illustrated in FIG. 32A, the cross-sectional shape of the inner peripheral surface 311 in the direction orthogonal to the rotation axis direction at the predetermined position Pa is a substantially octagonal shape with rounded corners in the state of the position angle illustrated in FIG. 32A. As illustrated in FIG. 32B, the cross-sectional shape of the inner peripheral surface 311 at a position Pb shifted by a predetermined amount within one pitch 316 of the spiral rib 302 in the rotation axis direction from the substantially octagonal cross-sectional shape at the predetermined position Pa is a shape obtained by rotating the substantially octagonal shape around the rotation axis R.

As schematically illustrated on the frontmost side in FIG. 33, the cross-sectional shape of the inner peripheral surface 311 of the container body 33 in the direction orthogonal to the rotation axis direction at the predetermined position Pa is substantially octagonal. The cross-sectional shape of the inner peripheral surface 311 of the container body 33 at a position Pb where the substantially octagonal cross-sectional shape positioned at the predetermined position Pa is slightly shifted to the back side of FIG. 33 in the rotation axis direction (shifted by a predetermined amount within one pitch 316 of the spiral rib 302) is a shape obtained by rotating the substantially octagonal shape around the rotation axis R. A ridge line portion (indicated by a thick solid line in FIG. 33) connecting apexes of the sides 315 of the substantially octagonal shape having different angles has a specific shape forming the spiral rib 302.

In other words, when the position of the substantially octagonal cross section of the inner peripheral surface 311 is different in the longitudinal direction of the rotation axis R, the angle of the substantially octagonal cross section is different. The ridge line portions connecting the apexes of the substantially octagonal cross sections having different angles form the spiral rib 302.

That is, as illustrated in FIGS. 32A, 32B, and 33, the inner peripheral surface 311 of the container body 33 according to Example 1 has a region where the cross-sectional shape of the inner peripheral surface 311 at the position Pb shifted from the predetermined position Pa by a predetermined amount within one pitch 316 of the spiral rib 302 in the rotation axis direction is a shape obtained by rotating the substantially octagonal shape around the rotation axis R (hereinafter, referred to as a "first characteristic configuration").

Further, as illustrated in FIG. 31A, the inner peripheral surface 311 of the container body 33 according to Example 1 is characterized in that a cross section passing through the rotation axis R in a direction parallel to the longitudinal direction of the rotation axis R does not have a straight line (described below) parallel to the rotation axis R (hereinafter, referred to as "second characteristic configuration").

The inner peripheral surface 311 of the container body 33 according to Example 1 has a convex 311*a* in which a cross section passing through the rotational axis R in a direction parallel to the longitudinal direction bulges in an arc shape. The outer peripheral surface 312, which the inner peripheral surface 311 faces, also has a convex 312*a*. Accordingly, the cross section passing through the rotation axis R in the direction parallel to the longitudinal direction of the rotation axis R does not have a straight line parallel to the rotation axis R.

On the inner peripheral surface 311 (or the outer peripheral surface 312) of the container body 33 illustrated in FIG. 31A, the convex 311*a* (or the convex 312*a*) bulging in an arc shape and a concave 311*b* (or a concave 312*b*) recessed in an arc shape are alternately and continuously formed in the longitudinal direction. Accordingly, in the toner container 32 according to Example 1, the cross section passing through the rotation axis R in the direction parallel to the longitudinal direction of the rotation axis R does not have a straight line parallel to the longitudinal direction of the rotation axis R.

Figure 34B:
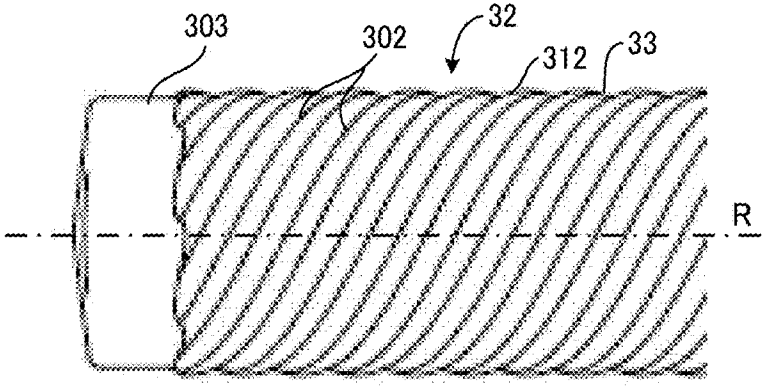
FIG. 34B is a front view of a main part of a toner container according to a comparative example.
Figure 34A:
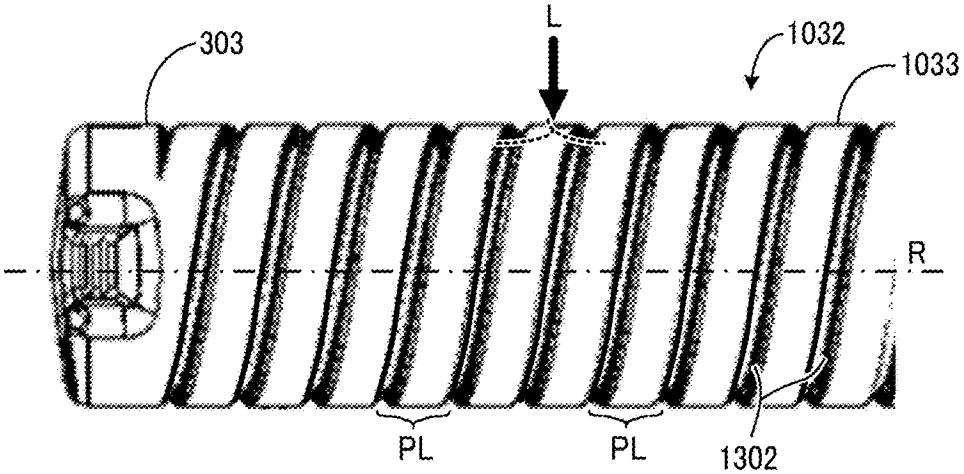
FIG. 34A is a front view of a main part of the toner container according to Example 1.

FIG. 34A is a front view of a main part of the toner container 32 according to Example 1. FIG. 34B is a front view of a main pan of a toner container 1032 according to a comparative example.

As illustrated in FIG. 34B, an outer peripheral surface 312 of a container body 1033 of the toner container 1032 according to the comparative example has a straight line PL parallel to the rotation axis R.

Therefore, assuming a case where the toner container 1032 of the comparative example in which a spiral groove is formed on the cylindrical shape is molded in a thin wall thickness, when a load L perpendicular to the straight line PL parallel to the longitudinal direction of the rotation axis R of the toner container 1032 is applied to the circumferential direction in which the groove is not formed, a curved surface portion may be recessed toward the inner wall and plastically deformed.

On the other hand, in the outer peripheral surface 312 of the container body 33 according to Example 1, as illustrated in FIG. 34A, the outer peripheral surface 312 of the cross section passing through the rotation axis R in the direction parallel to the longitudinal direction of the rotation axis R does not have a straight line PL parallel to the rotation axis R (or can be significantly reduced as compared with the comparative example).

According to Example 1 having such a specific shape, when viewed in the longitudinal direction of the rotation axis R, there is no straight line PL horizontal to the center direction of the rotation axis R of the toner container 1032, and the outer peripheral surface 312 of the cross section passing through the rotation axis R in the direction parallel to the longitudinal direction of the rotation axis R is a curved surface, thus facilitating the load to be dispersed. Accordingly, the amount of deformation of the container body 33 decreases, and plastic deformation does not occur even when a load similar to that in the comparative example is applied. Therefore, even if the toner container 32 is thinned, the bending of the toner container 32 can be reduced (the same applies to each example described below).

Figure 35:
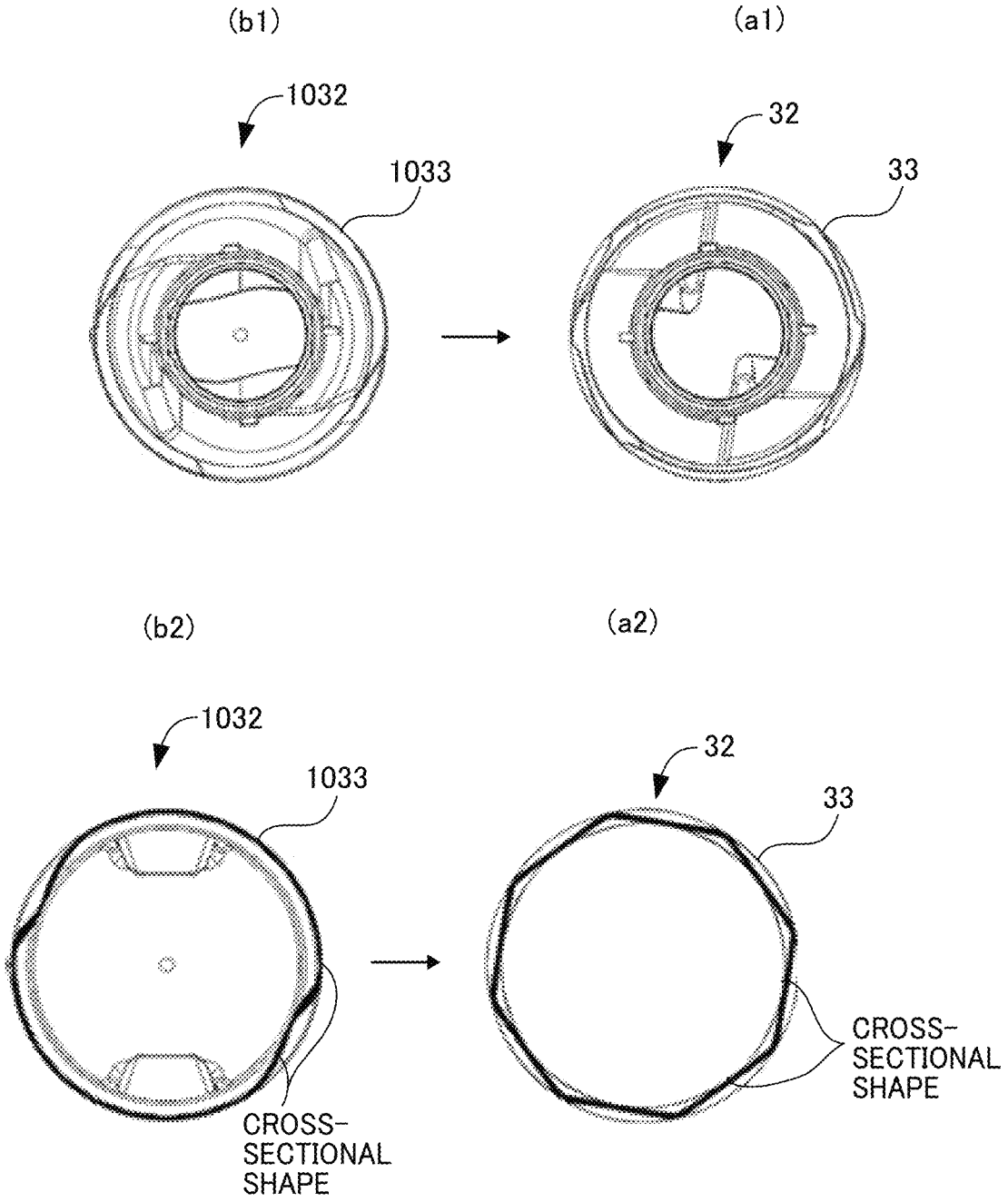
FIG. 35 includes part (a1) that is a view of the outer shape of the toner container according to Example 1, part (a2) that is a cross-sectional view of the toner container of part (a1), part (b1) that is a view illustrating the outer shape of the toner container of the comparative example, and part (b2) that is a cross-sectional view of the toner container of part (b1)

Part (a1) of FIG. 35 is a diagram illustrating an outer shape of the toner container 32 according to Example 1 viewed from the rotational axis R direction. Part (a2) of FIG. 35 is a diagram illustrating a cross-sectional shape of the toner container 32 according to Example 1 in the direction orthogonal to the longitudinal direction of the rotational axis R at a predetermined position. Part (b1) of FIG. 35 is a diagram illustrating an outer shape of the toner container 1032 of the comparative example viewed from the rotational axis R direction. Part (b2) of FIG. 35 is a diagram illustrating a cross-sectional shape of the toner container 1032 of the comparative example in the direction orthogonal to the longitudinal direction of the rotational axis R at a predetermined position.

As illustrated in parts (b1) and (a1) of FIG. 35, each of the comparative example and Example 1 has a substantially circular outer shape when viewed from the rotational axis R direction.

On the other hand, as illustrated in part (b2) of FIG. 35, the cross-sectional shape in the direction orthogonal to the longitudinal direction of the rotational axis R at the predetermined position is a substantially octagonal shape with rounded corners in the toner container 32 according to Example 1 as illustrated in FIG. 35 (a2), while the toner container 1032 of the comparative example is a substantially circular shape.

Figure 36A:
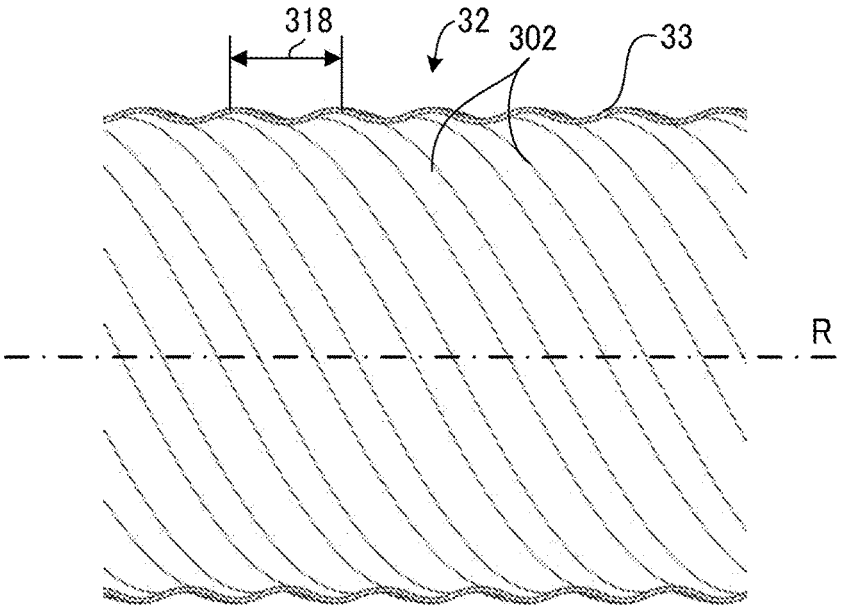
FIG. 36A is a cross-sectional view of a container body according to Example 1, illustrating a cutting width thereof.
Figure 36B:
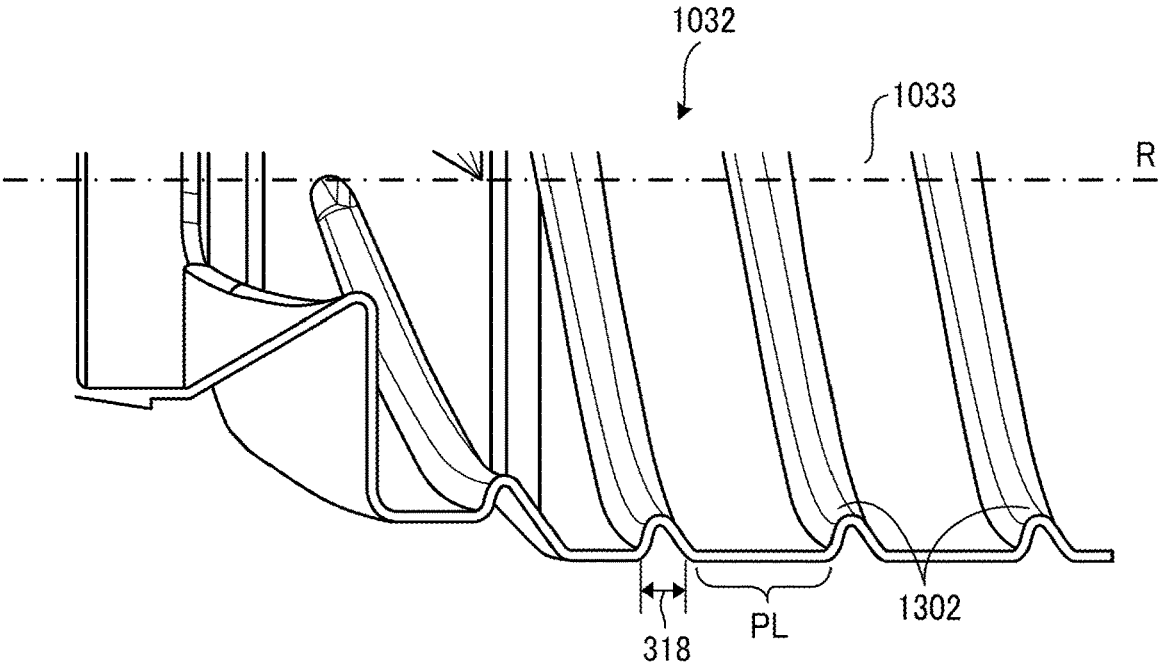
FIG. 36B is a cross-sectional view of a container body according to the comparative example, illustrating a cutting width thereof.

FIG. 36A is a cross-sectional view of the container body 33 according to Example 1, illustrating a cut width 318 formed in the inner peripheral surface 311 of the container body 33. FIG. 36B is a cross-sectional view of the container body 1033 according to the comparative example, illustrating a cut width 318 formed in the inner peripheral surface 311 of the container body 1033. The cut width 318 refers to a region having a height difference in the radial direction of the rotation axis R.

It can be seen from FIGS. 36A and 36B that the cut width 318 according to Example 1 is formed wider than that of the comparative example.

Figure 37:
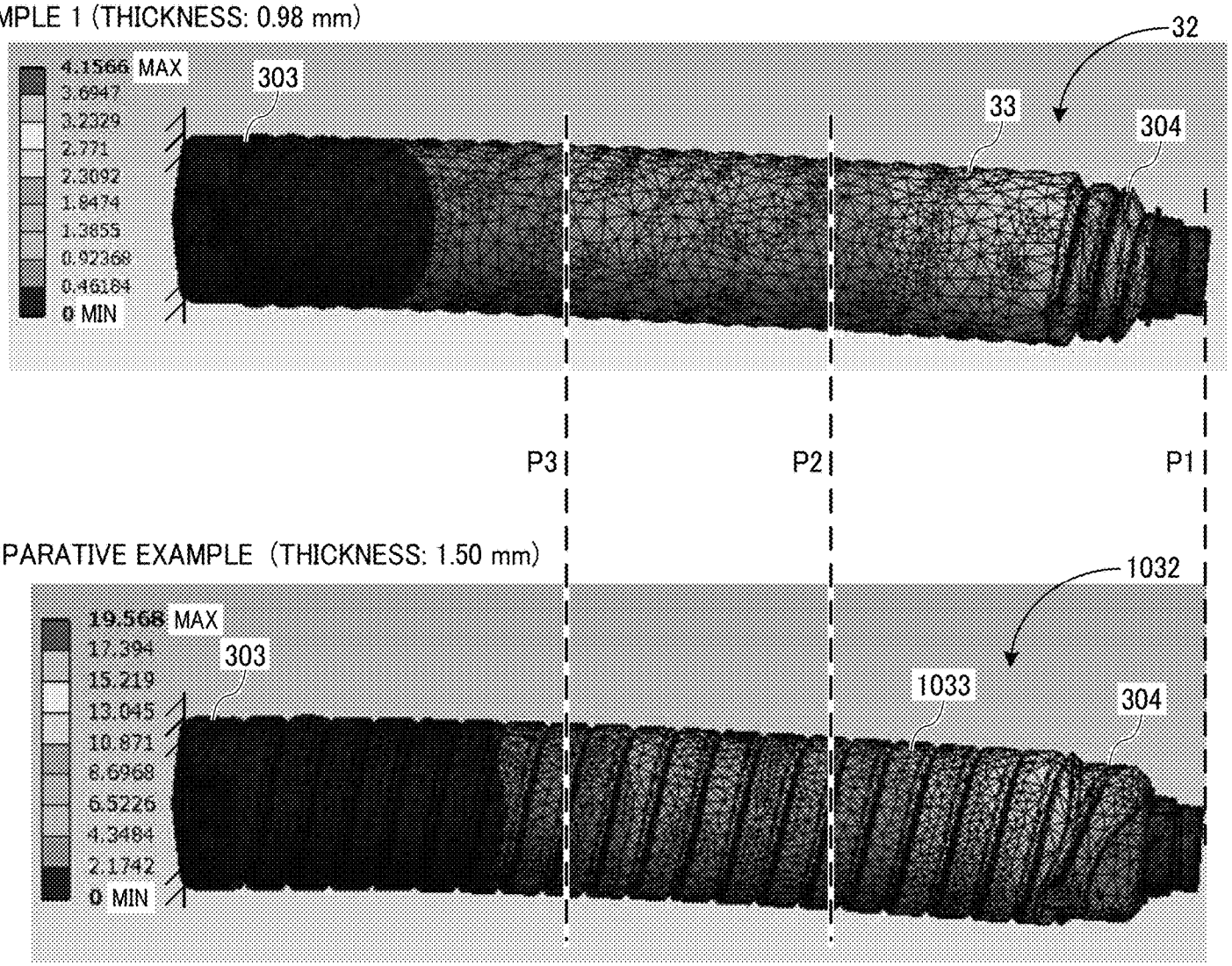
FIG. 37 is a diagram illustrating results of simulation tests related to static structural analysis performed on the toner container according to Example 1 and the toner container according to the comparative example.

Parts (a) and (b) of FIG. 37 illustrates results of simulation tests related to a static structure analysis performed on the container body 33 of the toner container 32 according to Example 1 and the container body 1033 of the toner container 1032 according to the comparative example, respectively. In Example 1 and the comparative example, the same polyethylene (PE) was used as a molding material, and the container body 33 and the container body 1033 were manufactured by direct blow molding under the same molding conditions. However, in Example 1, the wall thickness was molded at 0.98 mm, and in the comparative example, the wall thickness was molded at 1.50 mm.

In each of Example 1 and the comparative example, the grip portion 303 was secured, and the same load corresponding to the maximum weight of toner to be contained was applied to an end portion of the scooping portion 304 for a predetermined time in a cantilever state in which the scooping portion 304 was on the free end side. Then, deflections at the same portions P1, P2, and P3 in the longitudinal direction of the container bodies 33 and 1033 illustrated in FIG. 37 were measured.

The maximum deflection at the measurement site P1 was 4.1566 mm in Example 1 and 19.568 mm in the comparative example. The deflection at the measurement site P2 was 1.8474 mm in Example 1 and 8.6968 mm in the comparative example. The deflection at the measurement site P3 was 0.46184 mm in Example 1 and 2.1742 mm in the comparative example. From the result of the simulation test related to the static structure analysis, it was found that Example 1 is superior to the comparative example, and the strength can be maintained and the deflection can be reduced in the toner container having a thinner wall than the comparative example.

In addition, Example 1 is superior to the comparative example in terms of deflection because the cut width 318 in the radial direction of the rotation axis R illustrated in FIG. 36 is wider than the comparative example, and the strength can be improved or maintained with a thinner wall than the comparative example (the same applies to each example described below).

As described above, the container body 33 according to Example 1 is made of polyethylene (PE) and is formed by direct blow molding. For example, an embodiment of the present disclosure can also be applied to products manufactured using other materials such as high-density polyethylene (HDPE) or other blow molding methods such as biaxial stretch blow molding.

Figure 38:
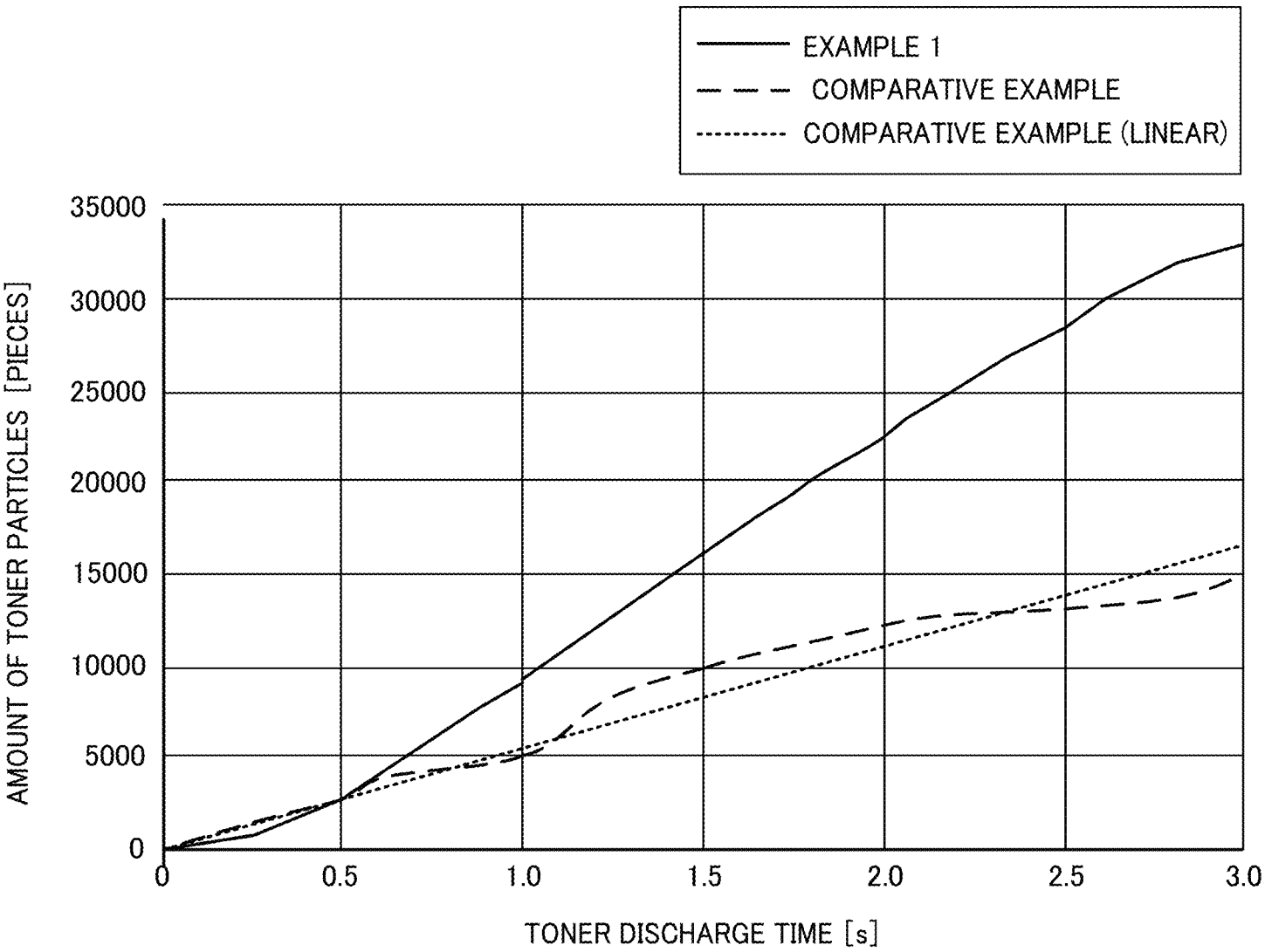
FIG. 38 is a graph illustrating the result of a simulation test on toner conveyance performance using the toner container according to Example 1 and the toner container according to the comparative example.

FIG. 38 is a graph illustrating the result of a simulation test on toner conveyance performance using the toner container 32 according to Example 1 of the present disclosure and the toner container 1032 according to the comparative example.

As illustrated in FIG. 31, the toner container 32 according to Example 1 was manufactured such that the cross-sectional shape of the container body 33 was substantially octagonal, the spiral pitch 316 was 195 mm, and the spiral height 317 was 2.46 mm. On the other hand, in the toner container 1032 of the comparative example, as illustrated in FIG. 39, the cross-sectional shape of the container body 1033 was circular, the spiral pitch 316 was 25 mm, and the spiral height 317 was 5.0 mm.

The test conditions were the same in both Example 1 and Comparative Example, that is, 60,000 toner particles having a predetermined toner particle size of 1.0 mm were accommodated in the range of 150 mm from the lower portion of each of the container bodies 33 and 1033, and a simulation test was performed for a total of 7 seconds in which the movement of each of the toner containers 32 and 1032 was stopped for 1 second, rotated for 5 seconds, and then stopped for 1 second. The toner conveyance performance of the toner containers 32 and 1032 was determined based on the amount of toner particles discharged from the simulation range.

In the graph of FIG. 38, a comparative example (linear) indicated by a dotted line indicates an approximate straight line of a curve of toner discharge amount indicated by a broken line as a comparative example. From the result of the simulation test on the toner conveyance performance, it was found that Example 1 had a toner conveyance and supply performance about 2.23 times that of the comparative example.

Figure 39:
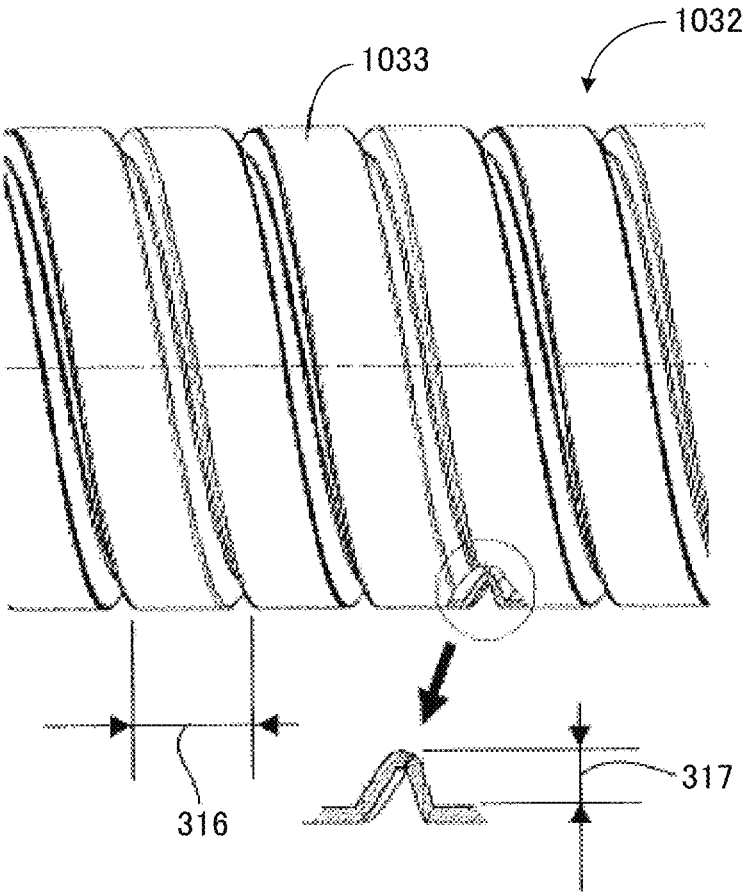
FIG. 39 is a diagram illustrating a spiral pitch and a spiral height of the toner container of the comparative example.

FIG. 39 is a diagram illustrating a spiral pitch 316 and a spiral height 317 formed in the container body 1033 of the comparative example. The spiral pitch 316 and the spiral height 317 of Example 1 are as illustrated in FIG. 31A.

The spiral height 317 refers to a height difference of a convex shape or a concave shape in a cross section passing through the rotation axis R in a direction parallel to the longitudinal direction.

If the spiral height 317 is too high, the processing accuracy of the toner container is deteriorated. In this respect, the spiral height 317 is preferably 2.0 to 10 mm, and particularly preferably 2.0 mm or more and 5.0 mm or less (the same applies to each example described below).

Example 2

Figure 40:
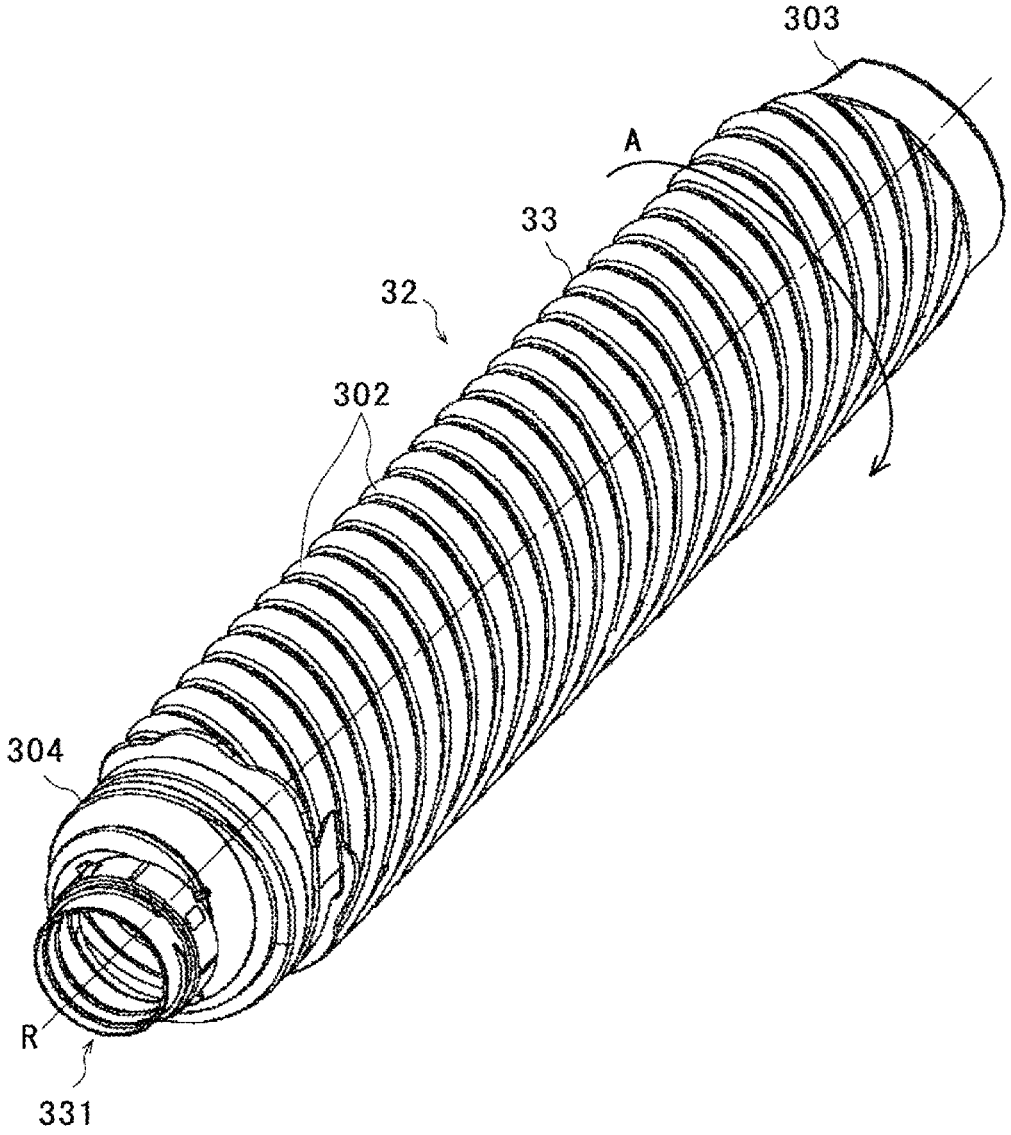
FIG. 40 is an external perspective view of a toner container according to Example 2.

Next, a toner container 32 according to Example 2 of the present disclosure is described with reference to FIGS. 40 to 42. FIG. 40 is an external perspective view of the toner container 32 according to Example 2 of the embodiment schematically illustrated in FIGS. 1, 6, and the like in an exaggerated manner.

Similarly to Example 1, as illustrated in FIG. 40, when the container body 33 of the toner container 32 according to Example 2 rotates in the direction indicated by arrow A in FIG. 40, a conveying force from one end (container rear end) to the other end (container front end) in the longitudinal direction of the rotation axis R is applied to toner stored in the container body 33 by the action of the spiral rib 302.

Hereinafter, the toner container 32 according to Example 2 is described focusing on the differences from the toner container 32 according to Example 1. Details of the toner container 32 according to Example 2 that are not particularly described are similar to, even if not the same as, those in Example 1 (the same applies to Example 3 described below).

Figure 41:
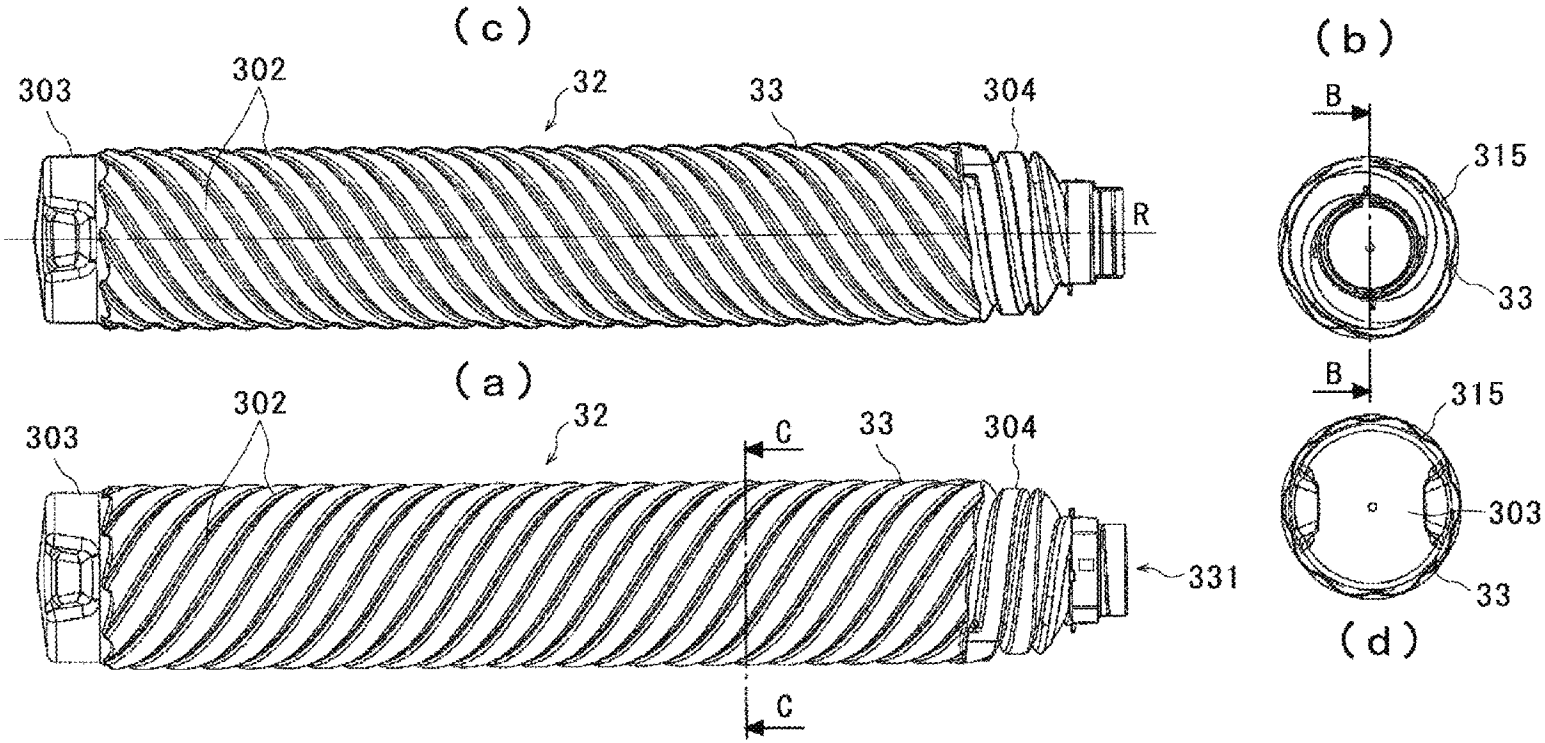
FIG. 41 includes part (a) that is a side view of the toner container of FIG. 40, part (b) that is a front view of the toner container illustrated in part (a), part (c) that is a cross-sectional view of the toner container taken along line B-B of part (b), and part (d) that is a cross-sectional view of the toner container taken along line C-C of part (a)
Figure 42A:
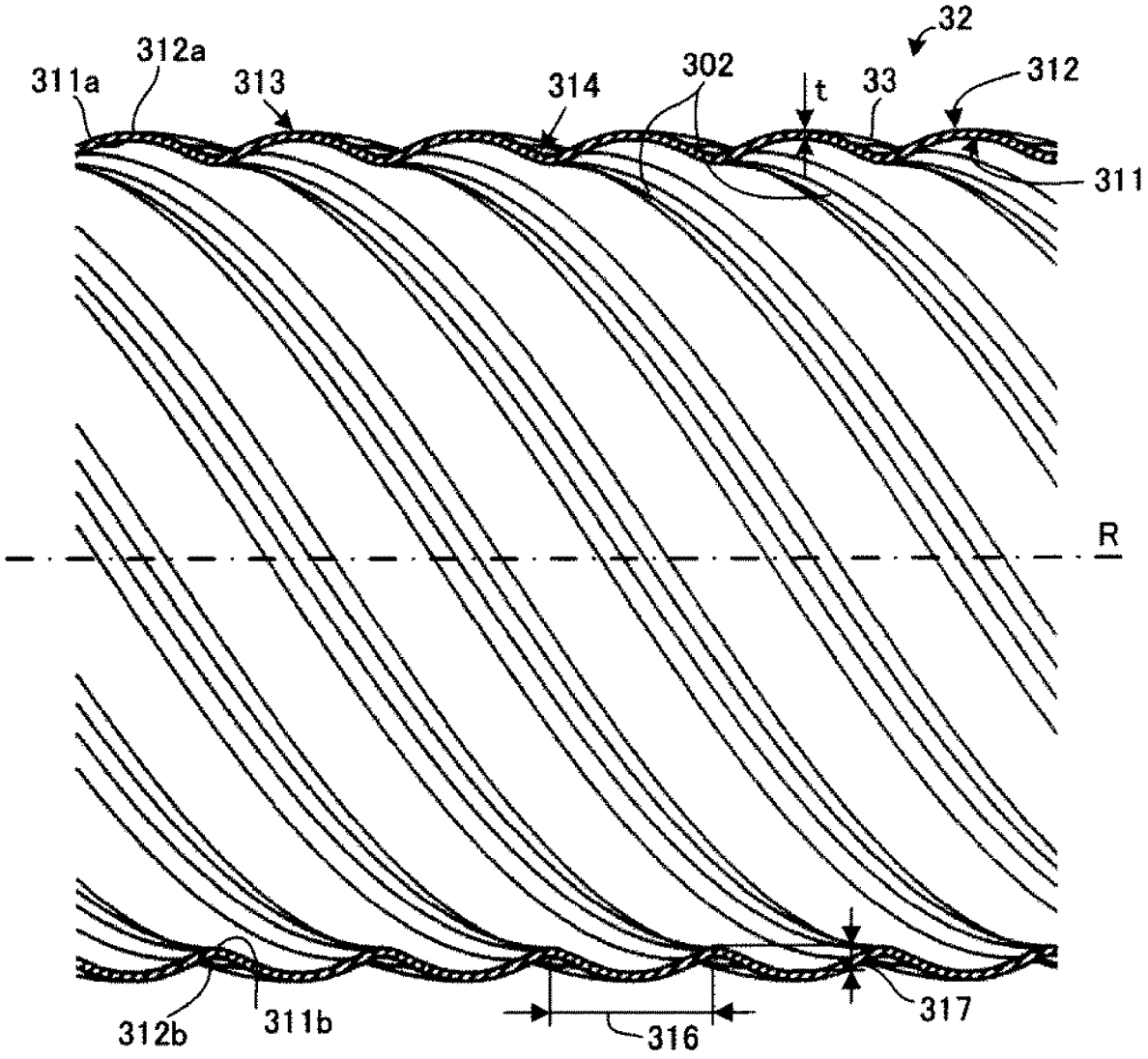
FIG. 42A is an enlarged cross-sectional view of a main pan of the container body illustrated in part (c) of FIG. 41.
Figure 42B:
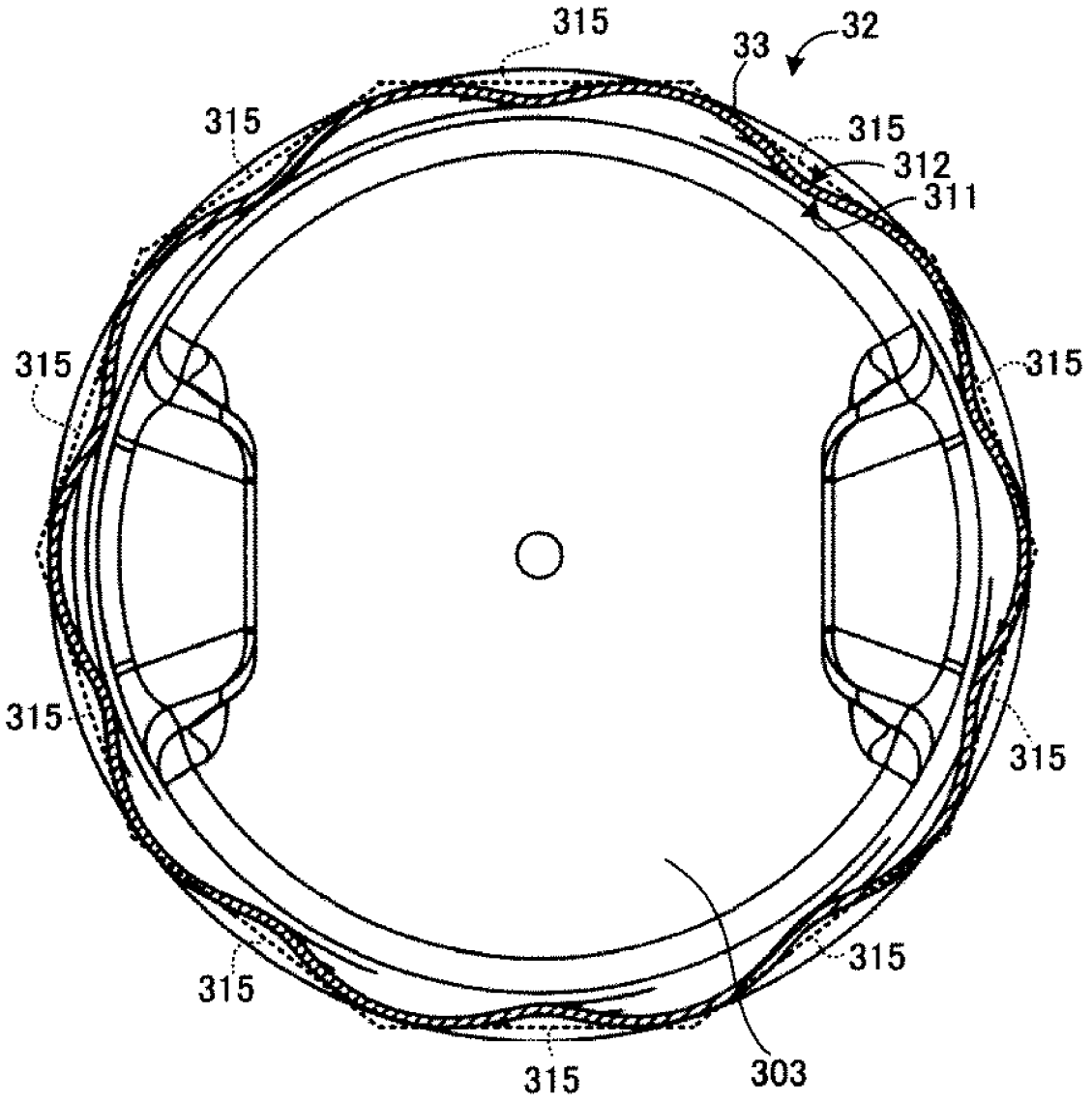
FIG. 42B is an enlarged cross-sectional view of the container body illustrated in part (d) of FIG. 41.

Part (a) of FIG. 41 is a side view of the toner container 32 according to Example 2. Part (b) of FIG. 41 is a front view of the container body 33 viewed from the nozzle receiving port 331 of the toner container 32 illustrated in part (a) of FIG. 41. Part (c) of FIG. 41 is a cross-sectional view of the container body 33 taken along line B-B of part (b) of FIG. 41. Part (d) of FIG. 41 is a cross-sectional view of the container body 33 taken along line C-C at a predetermined position of part (a) of FIG. 41. FIG. 42A is an enlarged cross-sectional view of a main part of the container body 33 in part (c) of FIG. 41. FIG. 42B is an enlarged cross-sectional view of the container body 33 illustrated in part (d) of FIG. 41.

As illustrated in part (b) of FIG. 41, the toner container 32 according to Example 2 has a substantially circular outer shape when viewed from the rotation axis direction. Broken lines (dotted lines) in FIG. 42B indicate sides 315 of a substantially decagon.

The toner container 32 of Example 2 is mainly different from the toner container 32 (having the substantially octagonal shape with rounded corners 310) according to Example 1 illustrated in FIGS. 29 to 31 in that the toner container 32 of Example 2 has a substantially decagonal shape with recessed sides 315.

In the toner container 32 according to Example 2, the number threads of the spiral rib 302 as the spiral shape is 10. The number of sides of the substantially polygonal shape according to the present embodiment is 10 corresponding to the substantially decagonal shape.

As illustrated in FIG. 428, in the toner container 32 according to Example 2, a cross-sectional shape of an inner peripheral surface 311 (or an outer peripheral surface 312) in a direction orthogonal to a rotation axis direction at a predetermined position is a substantially decagonal shape in which each side 315 is recessed.

As illustrated in FIG. 42A, in the toner container 32 according to Example 2, a cross section of the inner peripheral surface 311 (or the outer peripheral surface 312) passing through the rotational axis R in a direction parallel to the longitudinal direction of the rotational axis R forms a convex portion having a relatively large round shape as a corner R313 and forms a concave portion having a relatively small round shape as a corner R314. In other words, the round shape as the corner R313 has a relatively large convex portion, and the round shape as the corner R314 has a relatively small concave portion. Thus, as illustrated in FIG. 42B, the cross-sectional shape in the direction orthogonal to the rotation axis direction at a predetermined position forms a substantially decagon in which a central portion of each side 315 is recessed.

In FIGS. 32A and 32B, the inner peripheral surface 311 of the container body 33 of Example 2 has a substantially decagonal shape instead of a substantially octagonal shape. The inner peripheral surface 311 is characterized in that the cross-sectional shape of the inner peripheral surface 311 at a position shifted from the predetermined position by a predetermined amount within one pitch 316 of the spiral rib 302 in the rotation axis direction has a region having a shape obtained by rotating a substantially decagonal shape around the rotation axis R (a first characteristic configuration corresponding to Example 2).

As illustrated in FIG. 42A, the inner peripheral surface 311 of the container body 33 of Example 2 does not have a straight line (described below) parallel to the rotation axis R in a cross-section passing through the rotation axis R in a direction parallel to the longitudinal direction of the rotation axis R (second characteristic configuration corresponding to Example 2).

The inner peripheral surface 311 of the container body 33 according to Example 2 has a convex 311*a* in which a cross section passing through the rotational axis R in a direction parallel to the longitudinal direction bulges in an arc shape. The outer peripheral surface 312, which the inner peripheral surface 311 faces, also has a convex 312*a*. Accordingly, the cross section passing through the rotation axis R in the direction parallel to the longitudinal direction of the rotation axis R does not have a straight line parallel to the rotation axis R.

On the inner peripheral surface 311 (or the outer peripheral surface 312) of the container body 33 illustrated in FIG. 42A, the convex 311*a* (or the convex 312*a*) bulging in an arc shape and a concave 311*b* (or a concave 312*b*) recessed in an arc shape are alternately and continuously formed in the longitudinal direction. Accordingly, in the toner container 32 according to Example 2, the cross section passing through the rotation axis R in the direction parallel to the longitudinal direction of the rotation axis R does not have a straight line parallel to the longitudinal direction of the rotation axis R.

As a result of performing a simulation test related to static structure analysis similar to that described with reference to FIG. 37 using the toner container 32 of Example 2, similar results to those according to Example 1 were obtained also in Example 2. That is, Example 2 is superior to the comparative example, and it was found that the strength can be maintained and the bending can be reduced in the toner container thinner than the comparative example.

In addition, as a result of performing a simulation test with respect to the toner conveyance performance in the same manner as described with reference to FIG. 38 using the toner container 32 of Example 2, the same results as those according to Example 1 were obtained also in Example 2. That is, it was found that Example 2 has sufficient toner conveyance and supply performance as compared with the comparative example.

Example 3

Figure 43:
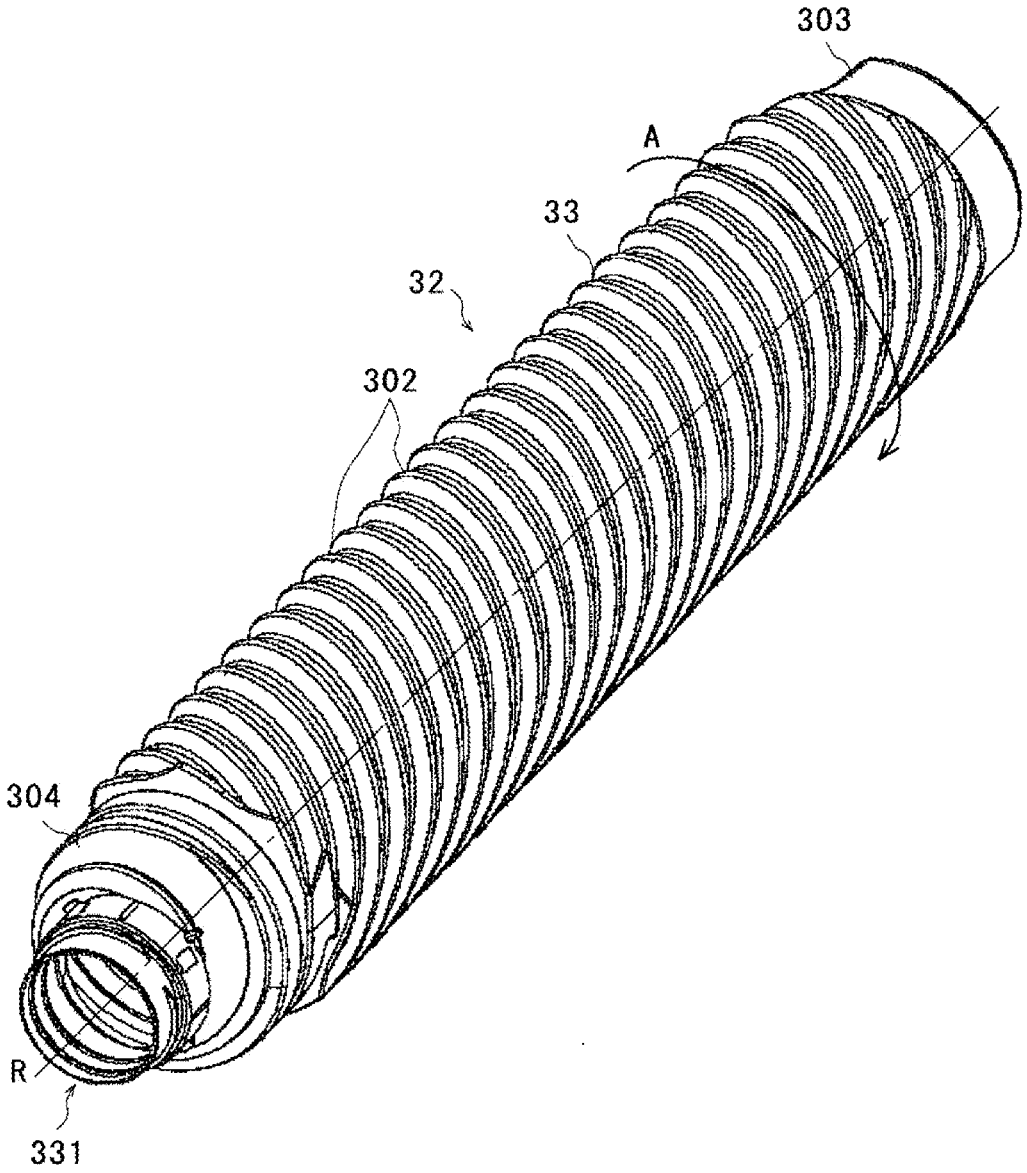
FIG. 43 is an external perspective view of a toner container according to Example 3.

Next, a toner container 32 according to Example 3 of the present disclosure is described with reference to FIGS. 43 to 45B. FIG. 43 is an external perspective view of the toner container 32 according to Example 3 schematically illustrated in FIGS. 1, 6, and the like in an exaggerated manner.

As illustrated in FIG. 43, when the container body 33 of the toner container 32 according to Example 3 rotates in the direction indicated by arrow A in FIG. 43, a conveying force from one end (container rear end) to the other end (container front end) in the longitudinal direction of the rotation axis R is applied to toner stored in the container body 33 by the action of the spiral rib 302.

Hereinafter, the toner container 32 according to Example 3 is described focusing on the differences from the toner container 32 according to Example 2. Details of the toner container 32 according to Example 3 that are not particularly described are similar to, even if not the same as, those in Examples 1 and 2.

Figure 44:
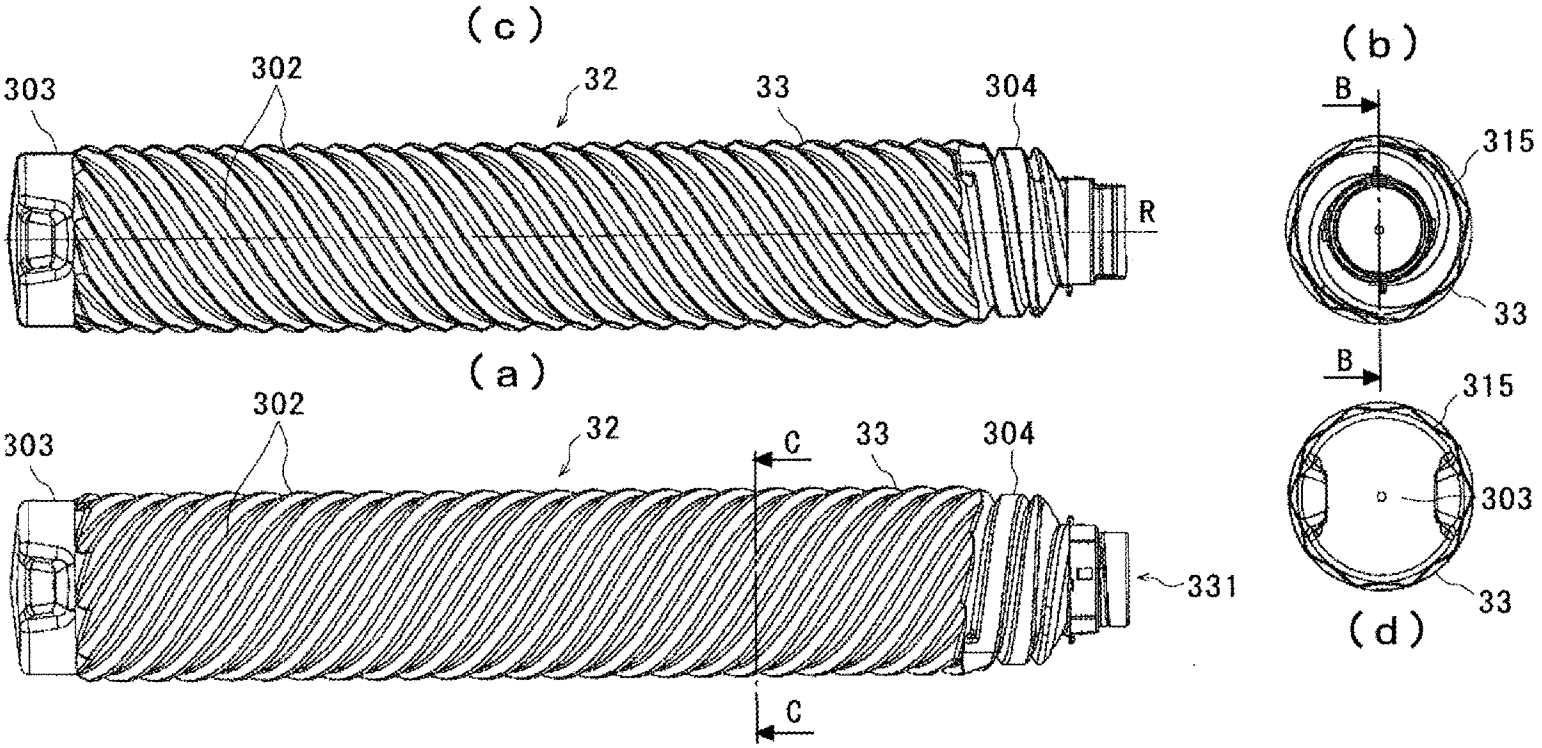
FIG. 44 includes part (a) that is a side view of the toner container of FIG. 43, part (b) that is a front view of the toner container illustrated in part (a), part (c) that is a cross-sectional view of the toner container taken along line B-B of part (b), and part (d) that is a cross-sectional view of the toner container taken along line C-C of part (a)
Figure 45A:
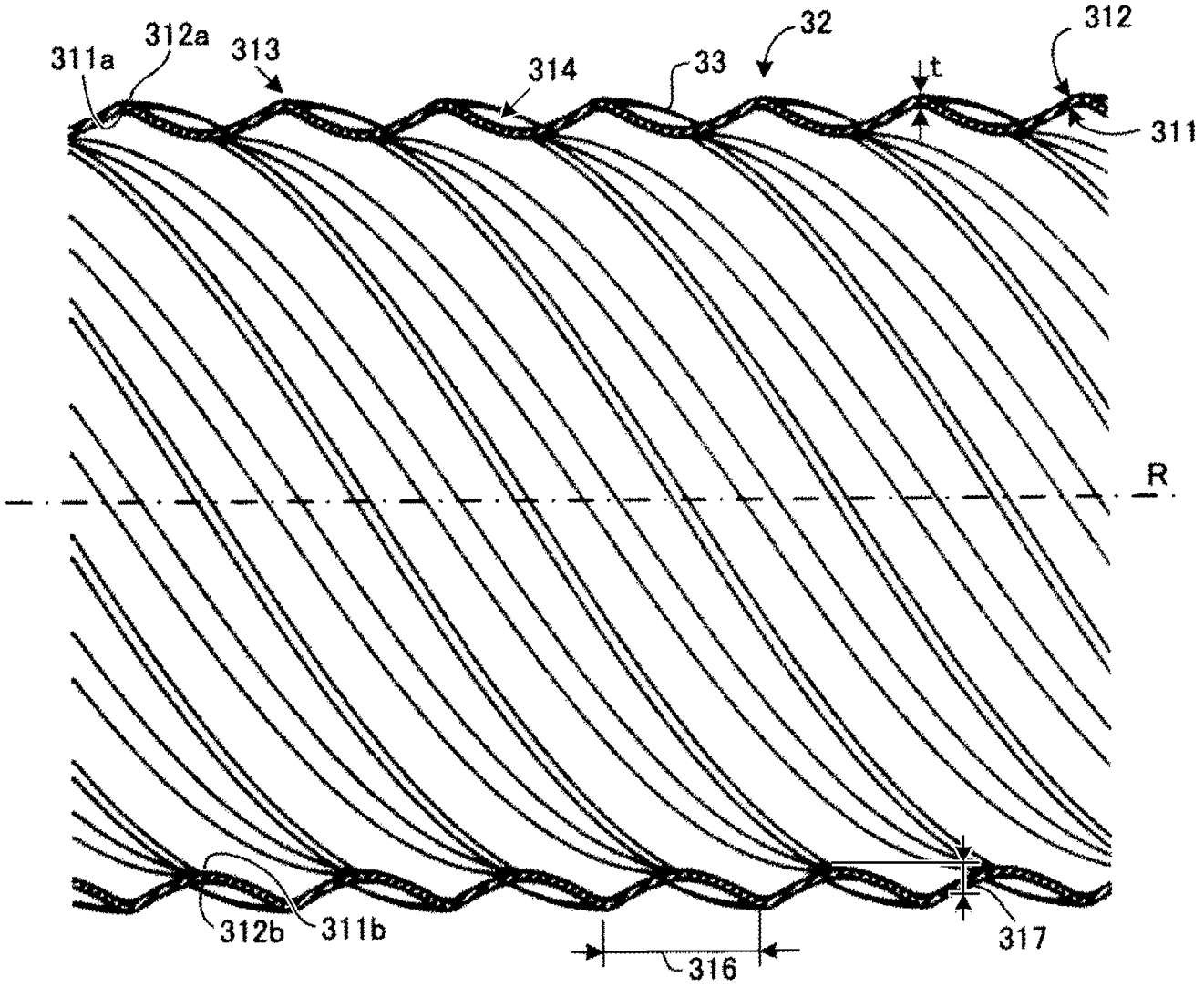
FIG. 45A is an enlarged cross-sectional view of a main part of the container body illustrated in part (c) of FIG. 44.
Figure 45B:
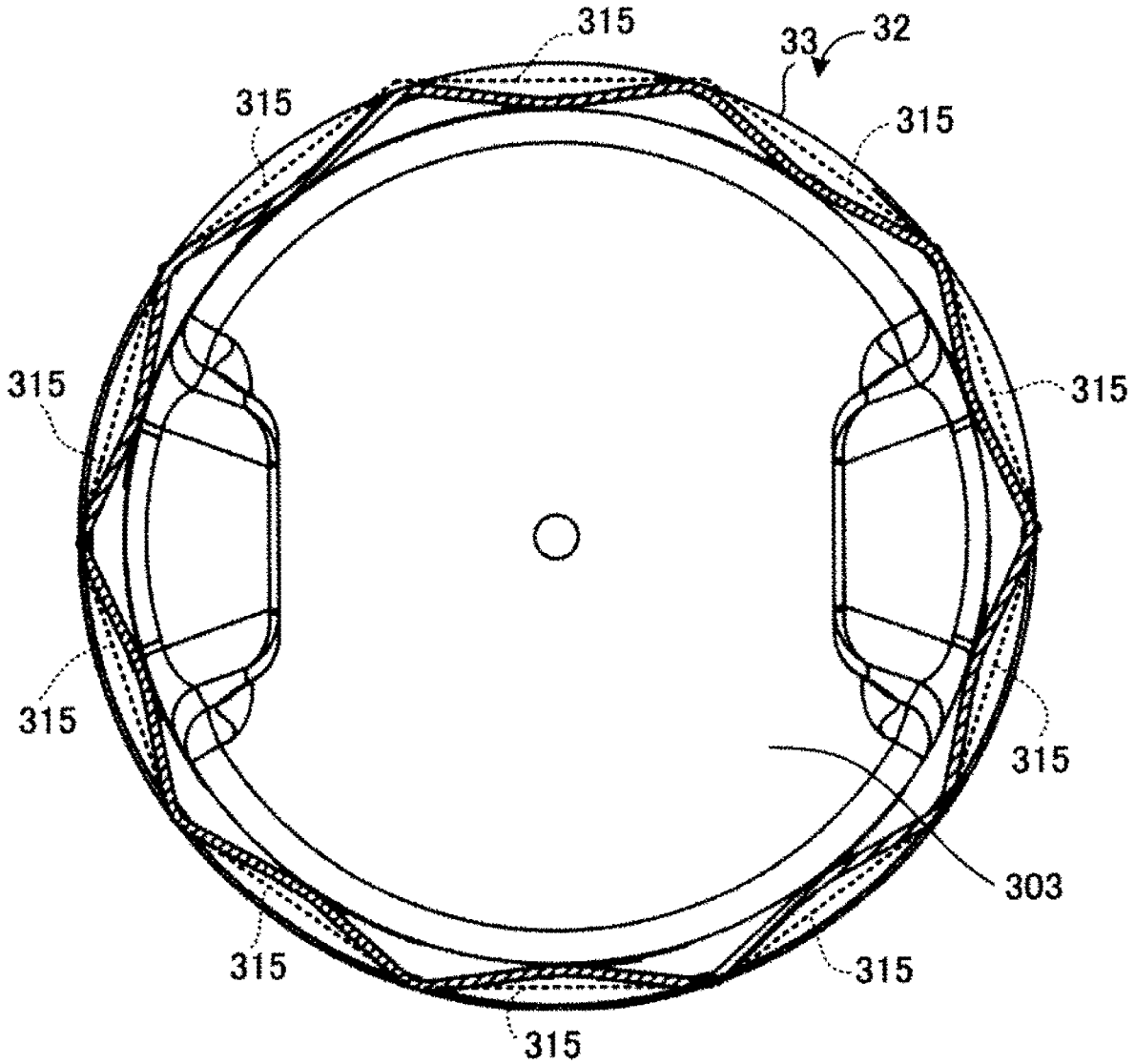
FIG. 45B is an enlarged cross-sectional view of the container body illustrated in part (d) of FIG. 44.

Part (a) of FIG. 44 is a side view of the toner container 32 of FIG. 43. Part (b) of FIG. 44 is a front view of the container body 33 viewed from the nozzle receiving port 331 of the toner container 32 illustrated in part (a) of FIG. 44. Part (c) of FIG. 44 is a cross-sectional view of the container body 33 taken along line B-B of part (b) of FIG. 44. Part (d) of FIG. 44 is a cross-sectional view of the container body 33 taken along line C-C at a predetermined position of part (a) of FIG. 44. FIG. 45A is an enlarged cross-sectional view of a main part of the container body 33 in part (c) of FIG. 44. FIG. 45B is an enlarged cross-sectional view of the container body 33 illustrated in part (d) of FIG. 44.

As illustrated in part (b) of FIG. 44, the toner container 32 according to Example 3 has a substantially circular outer shape when viewed from the rotation axis direction. Broken lines (dotted lines) in FIG. 45B indicate sides 315 of a substantially decagon.

The toner container 32 according to the Example 3 is different from the toner container 32 according to Example 2 illustrated in FIGS. 40 to 42 (having a substantially decagonal shape in which a side 315 is recessed) only in the following points.

As illustrated in FIG. 45A, in the toner container 32 according to the Example 3, a cross section of the inner peripheral surface 311 (or the outer peripheral surface 312) passing through the rotational axis R in a direction parallel to the longitudinal direction of the rotational axis R forms a convex portion having a relatively small round shape as a corner R313 and forms a concave portion having a relatively large round shape as a corner R314. In other words, the round shape as the corner R313 has a relatively small convex portion, and the round shape as the corner R314 has a relatively large concave portion. Thus, as illustrated in FIG. 45B, the cross-sectional shape in the direction orthogonal to the rotation axis direction at a predetermined position forms a substantially decagon in which a central portion of each side 315 is recessed. This difference appears as a difference in shape of outer appearance between the toner container 32 of Example 2 illustrated in FIG. 40 and the toner container 32 of Example 3 illustrated in FIG. 43.

The inner peripheral surface 311 of the container body 33 according to the Example 3 has a substantially decagonal shape, similarly to Example 2, instead of a substantially octagonal shape in FIGS. 32A and 32B. Accordingly, the inner peripheral surface 311 is characterized in that the cross-sectional shape of the inner peripheral surface 311 at a position 1) shifted from the predetermined position by a predetermined amount within one pitch 316 of the spiral rib 302 in the rotation axis direction has a region having a shape obtained by rotating a substantially decagonal shape around the rotation axis R (a first characteristic configuration corresponding to Example 3).

As illustrated in FIG. 45A, the inner peripheral surface 311 of the container body 33 of Example 3 does not have a straight line parallel to the rotation axis R in a cross-section passing through the rotation axis R in a direction parallel to the longitudinal direction of the rotation axis R (second characteristic configuration corresponding to Example 3).

The inner peripheral surface 311 of the container body 33 according to Example 3 has a convex 311*a* in which a cross section passing through the rotational axis R in a direction parallel to the longitudinal direction bulges in an arc shape. The outer peripheral surface 312, which the inner peripheral surface 311 faces, also has a convex 312*a*. Accordingly, the cross section passing through the rotation axis R in the direction parallel to the longitudinal direction of the rotation axis R does not have a straight line parallel to the rotation axis R.

On the inner peripheral surface 311 (or the outer peripheral surface 312) of the container body 33 illustrated in FIG. 45A, the convex 311*a* (or the convex 312*a*) bulging in an arc shape and a concave 311*b* (or a concave 312*b*) recessed in an arc shape are alternately and continuously formed in the longitudinal direction. Accordingly, in the toner container 32 according to Example 3, the cross section passing through the rotation axis R in the direction parallel to the longitudinal direction of the rotation axis R does not have a straight line parallel to the longitudinal direction of the rotation axis R.

As a result of performing a simulation test related to static structure analysis similar to that described with reference to FIG. 37 using the toner container 32 of Example 3, similar results to those according to Example 1 were obtained also in Example 3. That is, Example 3 is superior to the comparative example, and it was found that the strength can be maintained and the bending can be reduced in the toner container thinner than the comparative example.

In addition, as a result of performing a simulation test with respect to the toner conveyance performance in the same manner as described with reference to FIG. 38 using the toner container 32 of Example 3, the same results as those according to Example 1 were obtained also in Example 3. That is, it was found that Example 3 has sufficient toner conveyance and supply performance as compared with the comparative example.

In Examples 1 to 3 described above, a specific case has been described in which the cross-sectional shape of the inner peripheral surface of the container body is a substantially octagonal shape or a substantially decagonal shape among substantially polygonal shapes. However, it is needless to say that the cross-sectional shape is not limited to the substantially octagonal shape or the substantially decagonal shape. The above-described simulation tests (static structure analysis and toner conveyance performance) were carried out to investigate the polygonal shapes from a triangular shape (spiral shape of three stripes) to a twenty-sided shape (spiral shape of twenty threads).

As a result of investigation, from the viewpoints of toner conveyance performance, strength, ease of processing of a toner container, and the like, three- to twelve-sided polygons are preferable, five- to ten-sided polygons are particularly preferable, and an eight-sided polygon is most suitable.

The above-described embodiment and Examples 1 to 3 relating to the powder container and the image forming apparatus described above are illustrative examples, and embodiments of the present disclosure may exhibit effects due to configurations unique to the following aspects. In addition, it can be said that technical matters from which the invention according to appended claims can be derived are substantially described.

A powder container according to aspect A is a powder container such as the toner container 32 that includes an inner peripheral surface such as the inner peripheral surface 311 having a spiral shape such as the spiral rib 302 and rotates around a longitudinal axis such as the rotation axis R to convey stored powder such as developer G or toner by the spiral shape in one direction. A cross-sectional shape of the inner peripheral surface in a direction orthogonal to a longitudinal direction of the longitudinal axis at a predetermined position is a substantially polygonal shape having rounded corners such as the corners 310 or a shape in which sides such as the sides 315 of the substantially polygonal shape are recessed. The inner peripheral surface has a region in which the cross-sectional shape at a position shifted from the predetermined position by a predetermined amount within one pitch of the spiral shape in the longitudinal direction is a shape obtained by rotating, around the longitudinal axis, the substantially polygonal shape having rounded corners or the shape in which sides of the substantially polygonal shape are recessed.

With this configuration, according to the aspect A, a powder container can be provided capable of reducing bending even when the powder container is thinned.

The powder container according to aspect B is a powder container such as the toner container 32 that includes an inner peripheral surface such as the inner peripheral surface 311 having a spiral shape such as the spiral rib 302 and rotates around a longitudinal axis such as the rotation axis R to convey stored powder such as developer G or toner by the spiral shape in one direction. A cross section of the inner peripheral surface passing through the longitudinal axis in a direction parallel to the longitudinal direction of the longitudinal axis does not have a straight line parallel to the longitudinal axis.

With this configuration, according to the aspect B, a powder container can be provided capable of reducing bending even when the powder container is thinned.

The powder container according to aspect C is a powder container such as the toner container 32 that includes an inner peripheral surface such as the inner peripheral surface 311 having a spiral shape such as the spiral rib 302 and rotates around a longitudinal axis such as the rotation axis R to convey stored powder such as developer G or toner by the spiral shape in one direction. A cross-sectional shape of the inner peripheral surface in a direction orthogonal to a longitudinal direction of the longitudinal axis at a predetermined position is a substantially polygonal shape having rounded corners such as the corners 310 or a shape in which sides of the substantially polygonal shape are recessed. The inner peripheral surface has a region in which the cross-sectional shape at a position shifted from the predetermined position by a predetermined amount within one pitch of the spiral shape in the longitudinal direction is a shape obtained by rotating, around the longitudinal axis, the substantially polygonal shape having rounded corners or the shape in which sides such as the sides 315 of the substantially polygonal shape are recessed. A cross section of the inner peripheral surface passing through the longitudinal axis in a direction parallel to the longitudinal direction does not include a straight line parallel to the longitudinal axis.

With this configuration, according to the aspect C, a powder container can be provided capable of reducing bending even when the powder container is thinned.

A powder container according to aspect D is the powder container according to any one of aspects A to C, in which the powder container has a substantially circular outer shape when viewed from a direction orthogonal to the longitudinal direction.

A powder container according to aspect E is the powder container according to aspect B or D, in which the number of threads of the spiral shape is two or more.

A powder container according to aspect F is the powder container according to any one of aspects A to E, in which the number of threads of the spiral shape is three or more.

A powder container according to aspect G is the powder container according to any one of aspects A and C to F, in which the number of sides of the substantially polygonal shape is three or more.

A powder container according to aspect H is the powder container according to aspect F, in which the number of threads of the spiral shape is eight to ten.

A powder container according to aspect I is the powder container according to aspect G, in which the number of sides of the substantially polygonal shape is eight to ten.

A powder container according to aspect J is the powder container according to any one of aspects A to I, in which the inner peripheral surface has a convex shape such as the convex 311*a* in which a cross section passing through the longitudinal axis in a direction parallel to the longitudinal direction bulges in an arc shape.

A powder container according to aspect K is the powder container according to any one of aspects A to L, in which the inner peripheral surface has a concave shape such as the concave 311*b* in which a cross section passing through the longitudinal axis in a direction parallel to the longitudinal direction is recessed in an arc shape.

A powder container according to aspect L is the powder container according to any one of aspects A to K, further including an outer peripheral surface such as the outer peripheral surface 312 facing the inner peripheral surface with a thickness such as the substantially constant wall thickness t therebetween.

A powder container according to aspect M is the powder container according to aspect L, in which a thickness of a forming portion of the spiral shape is 0.5 mm or greater and 3.0 mm or less.

A powder container according to aspect N is the powder container according to aspect L, in which a thickness of a forming portion of the spiral shape is 0.8 mm or greater and 2.0 mm or less.

A powder container according to aspect O is the powder container according to aspect J or K, in which a height difference of the convex shape or the concave shape in a cross section passing through the longitudinal axis in a direction parallel to the longitudinal direction is 2.0 mm or more and 5.0 mm or less.

An image forming apparatus according to aspect P is an image forming apparatus such as the copier 500 including a powder container such as the toner container 32 that stores powder for image formation, an image forming device such as the image forming unit 46 that forms an image on an image bearer such as the photoconductor 41 using powder conveyed from the powder container, and a powder supply device such as the toner supply device 60 that conveys powder from the powder container to the image forming device. The powder container according to any one of aspects A to O is used as the powder container of the image forming apparatus.

Although several embodiments of the present disclosure have been described above, embodiments of the present disclosure are not limited to the above-described embodiments and examples, and unless specifically limited in the description above, the above-described embodiments and examples can be variously transformed and modified within the scope of the present disclosure as described in the claims. For example, the technical matters described in the above-described embodiments and examples may be appropriately combined.

The effects appropriately described in the above-described embodiments and examples of the present disclosure are merely listing examples of the effects obtained from embodiments of the present disclosure, and the effects according to the present disclosure are not limited to those described in the embodiments and examples of the present disclosure.

The invention claimed is:

1. A powder container comprising a container body configured to store powder, the container body including an inner peripheral surface of a spiral shape and being configured to rotate around a longitudinal axis to convey the powder by the spiral shape in one direction, the inner peripheral surface having a substantially polygonal shape having rounded corners or a shape in which sides of the substantially polygonal shape are recessed, in cross section orthogonal to a longitudinal direction of the longitudinal axis at a predetermined position, the inner peripheral surface having a region in which the cross-sectional shape at a position shifted from the predetermined position by a predetermined amount within one pitch of the spiral shape in the longitudinal direction is a shape obtained by rotating the substantially polygonal shape having the rounded corners or the shape in which the sides of the substantially polygonal shape are recessed, around the longitudinal axis.

2. The powder container according to claim 1, wherein the container body has a substantially circular outer shape when viewed from a direction orthogonal to the longitudinal direction.

3. The powder container according to claim 1, wherein a number of threads of the spiral shape is three or more.

4. The powder container according to claim 3, wherein the number of threads of the spiral shape is eight to ten.

5. The powder container according to claim 1, wherein a number of sides of the substantially polygonal shape is three or more.

6. The powder container according to claim 5, wherein the number of sides of the substantially polygonal shape is eight to ten.

7. The powder container according to claim 1, wherein the inner peripheral surface has a convex shape in which a cross section passing through the longitudinal axis in a direction parallel to the longitudinal direction bulges in an arc shape.

8. The powder container according to claim 7, wherein a height difference of the convex shape in a cross section passing through the longitudinal axis in a direction parallel to the longitudinal direction is 2.0 mm or more and 5.0 mm or less.

9. The powder container according to claim 1, wherein the inner peripheral surface has a concave shape in which a cross section passing through the longitudinal axis in a direction parallel to the longitudinal direction is recessed in an arc shape.

10. The powder container according to claim 9, wherein a height difference of the concave shape in a cross section passing through the longitudinal axis in a direction parallel to the longitudinal direction is 2.0 mm or more and 5.0 mm or less.

11. The powder container according to claim 1, wherein the container body has an outer peripheral surface facing the inner peripheral surface with a substantially constant wall thickness between the outer peripheral surface and the inner peripheral surface.

12. The powder container according to claim 11, wherein a thickness of a forming portion of the spiral shape is 0.5 mm or greater and 3.0 mm or less.

13. The powder container according to claim 11, wherein a thickness of a forming portion of the spiral shape is 0.8 mm or greater and 2.0 mm or less.

14. An image forming apparatus, comprising:

the powder container according to claim 1 configured to store powder for image formation;

an image bearer configured to bear an image thereon;

an image forming device configured to form an image on the image bearer, using the powder conveyed from the powder container; and a powder supply device configured to convey the powder from the powder container to the image forming device.

15. A powder container comprising a container body configured to store powder, the container body including an inner peripheral surface of a spiral shape and being configured to rotate around a longitudinal axis to convey the powder by the spiral shape in one direction, wherein a cross section of the inner peripheral surface passing through the longitudinal axis in a direction parallel to the longitudinal direction of the longitudinal axis does not include a straight line parallel to the longitudinal axis.

16. The powder container according to claim 15, wherein a number of threads of the spiral shape is two or more.

17. A powder container comprising a container body configured to store powder, the container body including an inner peripheral surface of a spiral shape and being configured to rotate around a longitudinal axis to convey the powder by the spiral shape in one direction, the inner peripheral surface having a substantially polygonal shape having rounded corners or a shape in which sides of the substantially polygonal shape are recessed, in cross section orthogonal to a longitudinal direction of the longitudinal axis at a predetermined position, the inner peripheral surface having a region in which the cross-sectional shape at a position shifted from the predetermined position by a predetermined amount within one pitch of the spiral shape in the longitudinal direction is a shape obtained by rotating, around the longitudinal axis, the substantially polygonal shape having the rounded corners or the shape in which the sides of the substantially polygonal shape are recessed, wherein a cross section of the inner peripheral surface passing through the longitudinal axis in a direction parallel to the longitudinal direction does not include a straight line parallel to the longitudinal axis.

* * * * *